US010364505B2

(12) United States Patent
Thorkelsson et al.

(10) Patent No.: US 10,364,505 B2
(45) **Date of Patent: *Jul. 30, 2019**

(54) DYNAMIC MODULATION OF CROSS FLOW MANIFOLD DURING ELECROPLATING

(71) Applicant: Lam Research Corporation, Fremont, CA (US)

(72) Inventors: Kari Thorkelsson, Portland, OR (US); Aaron Berke, Portland, OR (US); Bryan L. Buckalew, Tualatin, OR (US); Steven T. Mayer, Aurora, OR (US)

(73) Assignee: Lam Research Corporation, Fremont, CA (US)

( * ) Notice: Subject to any disclaimer, the term of this patent is extended or adjusted under 35 U.S.C. 154(b) by 252 days.

This patent is subject to a terminal disclaimer.

(21) Appl. No.: 15/225,716

(22) Filed: Aug. 1, 2016

(65) Prior Publication Data

US 2017/0342583 A1 Nov. 30, 2017

Related U.S. Application Data

(60) Provisional application No. 62/340,736, filed on May 24, 2016.

(51) Int. Cl.
*C25D 5/08* (2006.01)
*C25D 17/00* (2006.01)
(Continued)

(52) U.S. Cl.
CPC ..... *C25D 5/08* (2013.01); *C25D 5/04* (2013.01); *C25D 5/18* (2013.01); *C25D 7/126* (2013.01);
(Continued)

(58) Field of Classification Search
None
See application file for complete search history.

(56) References Cited

U.S. PATENT DOCUMENTS 3,652,442 A 3/1972 Powers et al.
3,706,651 A 12/1972 Leland
(Continued)

FOREIGN PATENT DOCUMENTS

CN 1353778 A 6/2002
CN 1463467 A 12/2003
(Continued)

OTHER PUBLICATIONS

U.S. Appl. No. 14/924,124, filed Oct. 27, 2015, entitled "Edge Flow Element for Electroplating Apparatus,".
(Continued)

*Primary Examiner* — Harry D Wilkins, III
(74) *Attorney, Agent, or Firm* — Weaver Austin Villeneuve & Sampson LLP

(57) ABSTRACT

The embodiments herein relate to methods and apparatus for electroplating one or more materials onto a substrate. Typically, the embodiments herein utilize a channeled plate positioned near the substrate, creating a cross flow manifold between the channeled plate and substrate, and on the sides by a flow confinement ring. A seal may be provided between the bottom surface of a substrate holder and the top surface of an element below the substrate holder (e.g., the flow confinement ring). During plating, fluid enters the cross flow manifold through channels in the channeled plate, and through a cross flow inlet, then exits at the cross flow exit, positioned opposite the cross flow inlet. The apparatus may switch between a sealed state and an unsealed state during
(Continued)

electroplating, for example by lowering and lifting the substrate and substrate holder as appropriate to engage and disengage the seal.

20 Claims, 50 Drawing Sheets

(51) Int. Cl.

| | |
|---|---|
| ***C25D 7/12*** | (2006.01) |
| ***C25D 17/06*** | (2006.01) |
| ***C25D 21/10*** | (2006.01) |
| ***C25D 5/04*** | (2006.01) |
| ***C25D 21/12*** | (2006.01) |
| ***C25D 5/18*** | (2006.01) |
| *C25D 5/02* | (2006.01) |
| *C25D 5/10* | (2006.01) |

(52) U.S. Cl.
CPC ..... *C25D 17/001* (2013.01); *C25D 17/004* (2013.01); *C25D 17/008* (2013.01); *C25D 17/06* (2013.01); *C25D 21/10* (2013.01); *C25D 21/12* (2013.01); *C25D 5/028* (2013.01); *C25D 5/10* (2013.01)

(56) References Cited

U.S. PATENT DOCUMENTS 3,862,891 A 1/1975 Smith
4,033,833 A 7/1977 Bestel et al.
4,082,638 A 4/1978 Jumer
4,240,886 A 12/1980 Hodges et al.
4,272,335 A 6/1981 Combs
4,304,641 A 12/1981 Grandia et al.
4,427,520 A 1/1984 Bahnsen et al.
4,469,564 A 9/1984 Okinaka et al.
4,545,877 A 10/1985 Hillis
4,604,177 A 8/1986 Sivilotti
4,604,178 A 8/1986 Flegener et al.
4,605,482 A 9/1986 Shirgami et al.
4,633,893 A 1/1987 McConnell
4,696,729 A 9/1987 Santini
4,738,272 A 4/1988 McConnell
4,828,654 A 5/1989 Reed
4,856,544 A 8/1989 McConnell
4,906,346 A 3/1990 Hadersbeck et al.
4,931,149 A 6/1990 Stierman et al.
4,933,061 A 6/1990 Kulkarni et al.
5,039,381 A 8/1991 Mullarkey
5,078,852 A 1/1992 Yee et al.
5,096,550 A 3/1992 Mayer et al.
5,146,136 A 9/1992 Ogura et al.
5,156,730 A 10/1992 Bhatt et al.
5,162,079 A 11/1992 Brown
5,217,586 A 6/1993 Datta et al.
5,316,642 A 5/1994 Young, Jr. et al.
5,368,711 A 11/1994 Poris
5,391,285 A 2/1995 Lytle et al.
5,421,987 A 6/1995 Tzanavaras et al.
5,443,707 A 8/1995 Mori
5,472,592 A 12/1995 Lowery
5,476,578 A 12/1995 Forand
5,498,325 A 3/1996 Nishimura et al.
5,516,412 A 5/1996 Andricacos et al.
5,567,300 A 10/1996 Datta et al.
5,660,699 A 8/1997 Saito et al.
5,723,028 A 3/1998 Poris
5,744,019 A 4/1998 Ang
5,935,402 A 8/1999 Fanti
6,004,440 A 12/1999 Hanson et al.
6,022,465 A * 2/2000 Ting ..... C25D 7/12 205/118
6,027,631 A 2/2000 Broadbent
6,080,291 A 6/2000 Woodruff et al.
6,106,687 A 8/2000 Edelstein
6,126,798 A 10/2000 Reid et al.
6,132,587 A 10/2000 Jorne et al.
6,132,805 A 10/2000 Moslehi
6,156,167 A 12/2000 Patton et al.
6,162,728 A 12/2000 Tsao et al.
6,179,983 B1 1/2001 Reid et al.
6,193,860 B1 2/2001 Weling
6,228,231 B1 5/2001 Uzoh
6,251,255 B1 6/2001 Copping et al.
6,254,742 B1 7/2001 Hanson et al.
6,261,433 B1 7/2001 Landau
6,368,475 B1 4/2002 Hanson et al.
6,391,166 B1 5/2002 Wang
6,391,188 B1 5/2002 Goosey
6,395,152 B1 5/2002 Wang
6,398,926 B1 6/2002 Mahneke
6,402,923 B1 6/2002 Mayer et al.
6,431,908 B1 8/2002 Beck et al.
6,454,918 B1 9/2002 Sakaki
6,497,801 B1 12/2002 Woodruff et al.
6,514,570 B1 2/2003 Matsuyama et al.
6,521,102 B1 2/2003 Dordi
6,527,920 B1 3/2003 Jackson et al.
6,551,483 B1 4/2003 Mayer et al.
6,551,487 B1 4/2003 Reid et al.
6,569,299 B1 5/2003 Reid et al.
6,627,051 B2 9/2003 Berner et al.
6,632,335 B2 10/2003 Kunisawa et al.
6,755,946 B1 * 6/2004 Patton ..... C25D 17/06 204/224 R
6,755,954 B2 6/2004 Mayer et al.
6,773,571 B1 8/2004 Mayer et al.
6,793,796 B2 9/2004 Reid et al.
6,800,187 B1 10/2004 Reid et al.
6,821,407 B1 11/2004 Reid et al.
6,843,855 B2 1/2005 Verhaverbeke
6,869,515 B2 3/2005 Cohen
6,890,416 B1 5/2005 Mayer et al.
6,919,010 B1 7/2005 Mayer et al.
6,921,468 B2 7/2005 Graham et al.
6,964,792 B1 11/2005 Mayer et al.
6,974,792 B2 11/2005 Mayer et al.
7,070,686 B2 7/2006 Contolini et al.
7,169,705 B2 1/2007 Ide et al.
D544,452 S 6/2007 Nakamura et al.
D548,705 S 8/2007 Hayashi
D552,565 S 10/2007 Nakamura et al.
D553,104 S 10/2007 Oohashi et al.
7,387,131 B2 6/2008 Kuroda et al.
D587,222 S 2/2009 Sasaki et al.
7,622,024 B1 11/2009 Mayer et al.
7,641,776 B2 1/2010 Nagar et al.
D609,652 S 2/2010 Nagasaka et al.
D609,655 S 2/2010 Sugimoto
7,670,465 B2 3/2010 Yang et al.
D614,593 S 4/2010 Lee et al.
7,837,841 B2 11/2010 Chen et al.
7,854,828 B2 12/2010 Reid et al.
7,935,240 B2 5/2011 Singh et al.
7,967,969 B2 6/2011 Mayer et al.
D648,289 S 11/2011 Mayer et al.
8,262,871 B1 9/2012 Mayer et al.
8,308,931 B2 11/2012 Reid et al.
8,623,193 B1 1/2014 Mayer et al.
8,795,480 B2 8/2014 Mayer et al.
9,385,035 B2 7/2016 Spurlin et al.
9,394,620 B2 7/2016 Mayer et al.
9,449,808 B2 9/2016 Buckalew et al.
9,464,361 B2 10/2016 Mayer et al.
9,523,155 B2 12/2016 Mayer et al.
9,624,592 B2 4/2017 Abraham et al.
9,677,190 B2 6/2017 Kim et al.
9,834,852 B2 12/2017 Mayer et al.
9,899,230 B2 2/2018 Buckalew et al.
10,094,034 B2 10/2018 Graham et al.
10,094,035 B1 10/2018 Graham et al.
10,190,230 B2 1/2019 Abraham et al.
10,233,556 B2 3/2019 Graham et al.

(56) References Cited

U.S. PATENT DOCUMENTS

| | | | |
|---|---|---|---|
| 2002/0017456 | A1 | 2/2002 | Graham et al. |
| 2002/0062839 | A1 | 5/2002 | Verhaverbeke et al. |
| 2002/0066464 | A1 | 6/2002 | Bergman |
| 2002/0084189 | A1 | 7/2002 | Wang et al. |
| 2002/0088708 | A1 | 7/2002 | Sakaki |
| 2002/0119671 | A1 | 8/2002 | Lee |
| 2002/0125141 | A1 | 9/2002 | Wilson et al. |
| 2002/0164840 | A1 | 11/2002 | Lu et al. |
| 2002/0166773 | A1 | 11/2002 | Cohen |
| 2003/0017647 | A1 | 1/2003 | Kwon et al. |
| 2003/0019755 | A1 | 1/2003 | Hey et al. |
| 2003/0029527 | A1 | 2/2003 | Yajima et al. |
| 2003/0038035 | A1 | 2/2003 | Wilson et al. |
| 2003/0075451 | A1 | 4/2003 | Kanda |
| 2003/0102210 | A1 | 6/2003 | Woodruff et al. |
| 2003/0201166 | A1 | 10/2003 | Zheng et al. |
| 2004/0000487 | A1 | 1/2004 | Bonkass et al. |
| 2004/0053147 | A1 | 3/2004 | Ito |
| 2004/0084301 | A1 | 5/2004 | Dordi et al. |
| 2004/0118694 | A1 | 6/2004 | Yang et al. |
| 2004/0149584 | A1 | 8/2004 | Nagai et al. |
| 2004/0163963 | A1 | 8/2004 | Uzoh et al. |
| 2004/0168926 | A1 | 9/2004 | Basol et al. |
| 2004/0231989 | A1 | 11/2004 | Kobata et al. |
| 2004/0256238 | A1 | 12/2004 | Suzuki et al. |
| 2005/0003737 | A1 | 1/2005 | Montierth et al. |
| 2005/0045488 | A1 | 3/2005 | Paneccasio et al. |
| 2005/0053874 | A1 | 3/2005 | Yoshihara et al. |
| 2005/0145482 | A1 | 7/2005 | Suzuki et al. |
| 2005/0145499 | A1 | 7/2005 | Kovarsky et al. |
| 2005/0161336 | A1 | 7/2005 | Woodruff et al. |
| 2005/0181252 | A1 | 8/2005 | Risen et al. |
| 2005/0205429 | A1 | 9/2005 | Gebhart et al. |
| 2006/0038182 | A1 | 2/2006 | Rogers et al. |
| 2006/0054181 | A1 | 3/2006 | Rayandayan et al. |
| 2006/0243598 | A1 | 11/2006 | Singh et al. |
| 2007/0015080 | A1 | 1/2007 | Toukhy et al. |
| 2007/0029193 | A1 | 2/2007 | Brcka |
| 2007/0068819 | A1 | 3/2007 | Singh et al. |
| 2010/0032303 | A1 | 2/2010 | Reid et al. |
| 2010/0032304 | A1 | 2/2010 | Mayer et al. |
| 2010/0032310 | A1 | 2/2010 | Reid et al. |
| 2010/0035192 | A1 | 2/2010 | Ando et al. |
| 2010/0044236 | A1 | 2/2010 | Mayer et al. |
| 2010/0116672 | A1 | 5/2010 | Mayer et al. |
| 2010/0243462 | A1 | 9/2010 | Cohen |
| 2011/0031112 | A1 | 2/2011 | Birang et al. |
| 2012/0000786 | A1 | 1/2012 | Mayer et al. |
| 2012/0104350 | A1 | 5/2012 | Himeno et al. |
| 2012/0258408 | A1 | 10/2012 | Mayer et al. |
| 2012/0261254 | A1 | 10/2012 | Reid et al. |
| 2013/0313123 | A1 | 11/2013 | Abraham et al. |
| 2014/0183049 | A1 | 7/2014 | Mayer et al. |
| 2014/0216940 | A1 | 8/2014 | Wang et al. |
| 2014/0299476 | A1 | 10/2014 | Yasuda et al. |
| 2014/0299477 | A1 | 10/2014 | Mayer et al. |
| 2014/0299478 | A1 | 10/2014 | Mayer et al. |
| 2014/0357089 | A1 | 12/2014 | Buckalew et al. |
| 2015/0129418 | A1 | 5/2015 | Keigler et al. |
| 2016/0190007 | A1 | 6/2016 | Wang et al. |
| 2016/0215408 | A1 | 7/2016 | Kagajwala et al. |
| 2016/0265132 | A1 | 9/2016 | Graham et al. |
| 2016/0273119 | A1 | 9/2016 | He et al. |
| 2016/0343582 | A1 | 11/2016 | Buckalew et al. |
| 2016/0376722 | A1 | 12/2016 | Mayer et al. |
| 2017/0029973 | A1 | 2/2017 | Mayer et al. |
| 2017/0058417 | A1 | 3/2017 | Graham et al. |
| 2017/0073805 | A1 | 3/2017 | Gittleman et al. |
| 2017/0175286 | A1 | 6/2017 | Abraham et al. |
| 2017/0342583 | A1 | 11/2017 | Thorkelsson et al. |
| 2017/0342590 | A1 | 11/2017 | Thorkelsson et al. |
| 2018/0105949 | A1 | 4/2018 | Mayer et al. |
| 2018/0106757 | A1 | 4/2018 | Kosugi et al. |
| 2018/0258546 | A1 | 9/2018 | Graham et al. |
| 2019/0055665 | A1 | 2/2019 | Banik, II et al. |
| 2019/0085479 | A1 | 3/2019 | Banik, II et al. |

FOREIGN PATENT DOCUMENTS

| | | | |
|---|---|---|---|
| CN | 1551931 | A | 12/2004 |
| CN | 101056718 | A | 10/2007 |
| CN | 101220500 | A | 7/2008 |
| CN | 101736376 | A | 6/2010 |
| CN | 102330140 | A | 1/2012 |
| CN | 201130081716.6 | | 4/2012 |
| CN | 102459717 | A | 5/2012 |
| CN | 102719865 | A | 10/2012 |
| CN | 102732924 | A | 10/2012 |
| CN | 103866374 | A | 6/2014 |
| EP | 0 037 325 | | 3/1981 |
| EP | 0 233 184 | | 8/1987 |
| EP | 1 391 540 | | 2/2004 |
| EP | 1 538 662 | | 6/2005 |
| GB | 2 176 908 | | 1/1987 |
| GB | 2 206 733 | | 1/1989 |
| JP | 59-162298 | | 9/1984 |
| JP | 09-53197 | | 2/1997 |
| JP | 10-036997 | A | 10/1998 |
| JP | 2000-87299 | A | 3/2000 |
| JP | 2001-064795 | A | 3/2001 |
| JP | 2001-316887 | | 11/2001 |
| JP | 2002-289568 | | 10/2002 |
| JP | 2003-268591 | | 9/2003 |
| JP | 2004-068158 | A | 3/2004 |
| JP | 2004-250785 | A | 9/2004 |
| JP | 2005-344133 | A | 12/2005 |
| KR | 10-2006-0048645 | A | 5/2006 |
| KR | 10-0707121 | | 4/2007 |
| KR | 0657600 | | 8/2012 |
| TW | 200302519 | | 8/2003 |
| TW | 591122 | B | 6/2004 |
| TW | 201204877 | A1 | 2/2012 |
| TW | D148167 | | 7/2012 |
| TW | 201313968 | A1 | 4/2013 |
| WO | WO 87/00094 | | 1/1987 |
| WO | WO 1999/041434 | | 8/1999 |
| WO | WO 00/61837 | | 10/2000 |
| WO | WO 01/68952 | A1 | 9/2001 |
| WO | WO 02/01609 | | 1/2002 |
| WO | WO 2003/018879 | | 6/2003 |
| WO | WO 2004/114372 | | 12/2004 |
| WO | WO 2007/128659 | | 11/2007 |
| WO | WO 2010/144330 | | 12/2010 |

OTHER PUBLICATIONS

U.S. Appl. No. 15/161,081, filed May 20, 2016, entitled Dynamic Modulation of Cross Flow Manifold During Electroplating, Graham et al.

U.S. Appl. No. 13/110,759, filed May 18, 2011, entitled "High Resistance Ionic Current Source", Mayer et al.

U.S. Office Action dated Oct. 26, 2007 issued in U.S. Appl. No. 11/040,359.

U.S. Final Office Action dated Jul. 25, 2008 issued in U.S. Appl. No. 11/040,359.

U.S. Office Action dated Jan. 8, 2009 issued in U.S. Appl. No. 11/040,359.

U.S. Notice of Allowance dated Jul. 20, 2009 issued in U.S. Appl. No. 11/040,359.

U.S. Office Action dated Oct. 6, 2010 issued in U.S. Appl. No. 12/578,310.

U.S. Notice of Allowance dated Mar. 4, 2011 issued in U.S. Appl. No. 12/578,310.

U.S. Office Action dated Oct. 5, 2012 issued in U.S. Appl. No. 13/110,759.

U.S. Office Action dated Sep. 19, 2011 issued in U.S. Appl. No. 12/291,356.

U.S. Final Office Action dated Feb. 27, 2012 issued in U.S. Appl. No. 12/291,356.

(56) References Cited

OTHER PUBLICATIONS

U.S. Notice of Allowance dated Jul. 27, 2012 issued in U.S. Appl. No. 12/291,356.
U.S. Office Action dated Jun. 24, 2011 issued in U.S. Appl. No. 12/481,503.
U.S. Final Office Action dated Mar. 1, 2012 issued in U.S. Appl. No. 12/481,503.
U.S. Office Action dated Jul. 9, 2012 issued in U.S. Appl. No. 12/481,503.
U.S. Final Office Action dated Dec. 19, 2012 issued in U.S. Appl. No. 12/481,503.
U.S. Office Action dated Jun. 24, 2011 issued in U.S. Appl. No. 12/606,030.
U.S. Final Office Action dated Mar. 1, 2012 issued in U.S. Appl. No. 12/606,030.
U.S. Office Action dated Jul. 13, 2012 issued in U.S. Appl. No. 12/606,030.
U.S. Final Office Action dated Dec. 17, 2012 issued in U.S. Appl. No. 12/606,030.
U.S. Notice of Allowance dated Aug. 10, 2011 issued in Design U.S. Appl. No. 29/377,521.
U.S. Office Action dated Jun. 26, 2013 issued in U.S. Appl. No. 13/172,642.
U.S. Final Office Action dated Jan. 15, 2014 issued in U.S. Appl. No. 13/172,642.
U.S. Notice of Allowance dated Mar. 27, 2014 issued in U.S. Appl. No. 13/172,642.
U.S. Office Action dated Jan. 14, 2016 issued in U.S. Appl. No. 14/309,723.
U.S. Office Action dated Nov. 2, 2015 issued in U.S. Appl. No. 13/893,242.
U.S. Office Action dated May 18, 2016 issued in U.S. Appl. No. 13/893,242.
U.S. Office Action dated Aug. 18, 2015 issued in U.S. Appl. No. 14/308,258.
U.S. Notice of Allowance dated Jan. 12, 2016 issued in U.S. Appl. No. 14/308,258.
U.S. Office Action dated Feb. 1, 2016 issued in U.S. Appl. No. 14/103,395.
U.S. Office Action dated Oct. 15, 2014 issued in U.S. Appl. No. 13/904,283.
U.S. Notice of Allowance dated May 5, 2015 issued in U.S. Appl. No. 13/904,283.
U.S. Notice of Allowance dated Feb. 1, 2016 issued in U.S. Appl. No. 13/904,283.
PCT International Search Report and Written Opinion dated Jan. 12, 2011 issued in Application No. PCT/US2010/037520.
Chinese Office Action dated Jul. 19, 2011 issued in Application No. CN 201130081716.6.
Taiwan Office Action dated Nov. 28, 2011 issued in Application No. TW 100301923.
Korean Office Action dated Apr. 20, 2012 issued in Application No. KR 2011-0012881.
Chinese First Office Action dated Jan. 20, 2015 issued in Application No. CN 201110192296.8.
Chinese Second Office Action [no translation] dated Sep. 23, 2015 issued in Application No. CN 201110192296.8.
Chinese Third Office Action dated Jan. 15, 2016 issued in Application No. CN 201110192296.8.
Chinese Fourth Office Action dated May 5, 2016 issued in Application No. CN 201110192296.8.
Taiwan Office Action dated Apr. 8, 2015 issued in Application No. TW 100123415.
Taiwan Office Action and Search Report dated Mar. 4, 2016 issued in Application No. TW 104127539.
Austrian Office Action dated Aug. 14, 2014 issued in A50817/2013.
Austrian Search Report dated Dec. 5, 2014 issued in A50817/2013.
Chinese First Office Action dated Nov. 26, 2015 issued in CN 201310683415.9.
*Electrochemical Methods: Fundamentals and Applications*, Bard & Faulkner eds. Chapter 8, Dec. 2000, pp. 280-292.
Fang et al. (2004) "Uniform Copper Electroplating on Resistive Substrates," Abs. 167, 205th Meeting, The Electrochemical Society, Inc., 1 page.
Lowenheim, (1978) "Electroplating," *Sponsored by the American Electroplaters' Society*, McGraw-Hill Book Company, New York, p. 139.
Malmstadt et al., (1994) "Microcomputers and Electronic Instrumentation: Making the Right Connections," American Chemical Society, p. 255.
"Release of Sabre™ electrofill tool with HRVA by Novellus Systems, Inc." dated prior to the filed of the instant application (3 pages).
Schwartz, Daniel T. et al., (1987) "Mass-Transfer Studies in a Plating Cell with a Reciprocating Paddle," *Journal of the Electrochemical Society*, 134(7):1639-1645.
Wilson, Gregory J. et al., (2005) "Unsteady Numerical Simulation of the Mass Transfer within a Reciprocating Paddle Electroplating Cell," *Journal of the Electrochemical Society*, 152(6):C356-C365.
U.S. Notice of Allowance dated Jun. 9, 2016 issued in U.S. Appl. No. 14/309,723.
U.S. Notice of Allowability dated Sep. 13, 2016 issued in U.S. Appl. No. 14/309,723.
U.S. Office Action dated Apr. 13, 2018 issued in U.S. Appl. No. 15/261,244.
U.S. Notice of Allowance dated Dec. 8, 2016 issued in U.S. Appl. No. 13/893,242.
U.S. Office Action dated Feb. 15, 2018 issued in U.S. Appl. No. 15/448,472.
U.S. Notice of Allowance dated Jul. 15, 2016 issued in U.S. Appl. No. 14/103,395.
U.S. Notice of Allowance (Corrected Notice of Allowability) dated Aug. 24, 2016 issued in U.S. Appl. No. 14/103,395.
U.S. Notice of Allowance (Corrected Notice of Allowability) dated Nov. 16, 2016 issued in U.S. Appl. No. 14/103,395.
U.S. Office Action dated Apr. 6, 2017 issued in U.S. Appl. No. 15/291,543.
U.S. Notice of Allowance dated Jul. 28, 2017 issued in U.S. Appl. No. 15/291,543.
U.S. Notice of Allowance dated Aug. 2, 2016 issued in U.S. Appl. No. 13/904,283.
U.S. Office Action dated May 26, 2017 issued in U.S. Appl. No. 15/231,623.
U.S. Notice of Allowance dated Sep. 20, 2017 issued in U.S. Appl. No. 15/231,623.
U.S. Office Action dated Feb. 9, 2018 issued in U.S. Appl. No. 14/924,124.
U.S. Notice of Allowance dated Jun. 12, 2018 issued in U.S. Appl. No. 14/924,124.
Chinese First Office Action dated Feb. 5, 2018 issued in Application No. CN 201610916461.2.
Korean Office Action dated Mar. 14, 2017 issued in Application No. KR 10-2011-0066023.
Korean Office Action dated Aug. 11, 2017 issued in Application No. KR 10-2017-0060181.
Korean First Office Action dated Mar. 5, 2018 issued in Application No. KR 10-2017-0168351.
Taiwan Office Action and Search Report dated Aug. 5, 2016 issued in Application No. TW 102117113.
Chinese Second Office Action dated Aug. 3, 2016 issued in Application No. CN 201310683415.9.
Chinese First Office Action dated May 24, 2018 issued in Application No. CN 201610966878.X.
Taiwan Examination and Search Report dated Apr. 14, 2017 issued in Application No. TW 102145866.
Taiwan First Office Action dated Mar. 21, 2018 issued in Application No. TW 106132551.
Japanese First Office Action dated Dec. 21, 2017 issued in Application No. JP 2013-257021.
Taiwan Notice of Allowance and Search Report dated Oct. 31, 2017 issued in Application No. TW 103118470.

(56) References Cited

OTHER PUBLICATIONS

Taiwan First Office Action dated May 31, 2018 issued in Application No. TW 106141265.
Chinese First Office Action dated Mar. 2, 2018 issued in Application No. CN 201610756695.5.
International Search Report and Written Opinion dated Jun. 15, 2018 issued in Application No. PCT/US2018/021387.
Akire et al., (Nov. 1982) "High-Speed Selective Electroplating with Single Circular Jets," J. Electrochem. Soc.: Electrochemical Science and Technology, 129(11):2424-2432.
Said, et al., "Forced convection magnetoelectroplating for enhanced semiconductor metallization," Journal of Vacuum Science & Technology A: Vacuum, Surfaces, and Films, vol. 22, No. 3, Mar. 19, 2004, pp. 452-460.
Wang, et al., "A block copolymer as an effective additive for electrodepositing ultra-low Sn coatings," RSC Advances, vol. 5, No. 102, Sep. 29, 2015, pp. 83931-83935.
Hazlebeck, et al., "Modeling of Additive Effects on the Electroplating of a Through-Hole," AIChE Journal, vol. 36, No. 8, Aug. 1990, pp. 1145-1155.
U.S. Appl. No. 15/707,805, filed Sep. 18, 2017, Banik et al.
U.S. Appl. No. 15/846,029, filed Dec. 18, 2017, Buckalew et al.
U.S. Appl. No. 15/785,251, filed Oct. 16, 2017, Graham et al.
U.S. Notice of Allowance dated Jun. 6, 2018 issued in U.S. Appl. No. 15/785,251.
U.S. Final Office Action dated Oct. 16, 2018 issued in U.S. Appl. No. 15/261,244.
U.S. Notice of Allowance dated Sep. 14, 2018 issued in U.S. Appl. No. 15/448,472.
U.S. Office Action dated Dec. 31, 2018 issued in U.S. Appl. No. 15/455,011.
U.S. Office Action dated Oct. 30, 2018 issued in U.S. Appl. No. 15/413,252.
U.S. Notice of Allowance dated Oct. 30, 2018 issued in U.S. Appl. No. 15/161,081.
Korean Decision for Grant of Patent dated Sep. 21, 2018 issued in Application No. KR 10-2017-0168351.
Japanese Second Office Action dated Sep. 26, 2018 issued in Application No. JP 2013-257021.
Chinese Second Office Action dated Dec. 28, 2018 issued in Application No. CN 201610756695.5.
Chinese First Office Action dated Oct. 8, 2018 issued in Application No. CN 201710374684.5.
International Search Report and Written Opinion dated Jan. 10, 2019 issued in Application No. PCT/US2018/051447.
U.S. Appl. No. 16/101,291, filed Aug. 10, 2018, Banik et al.
International Search Report and Written Opinion dated Feb. 11, 2019 issued in Application No. PCT/US2018/055902.
U.S. Appl. No. 15/455,011, filed Mar. 9, 2017, Graham et al.

* cited by examiner

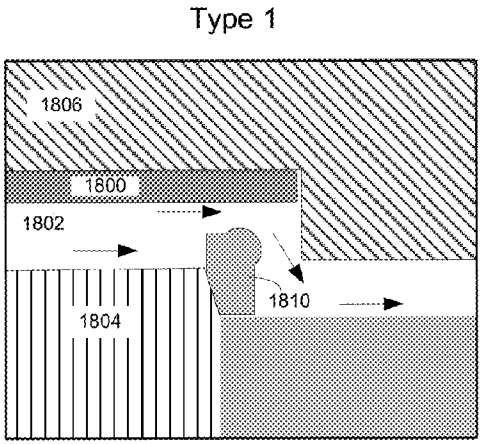
FIG. 18A
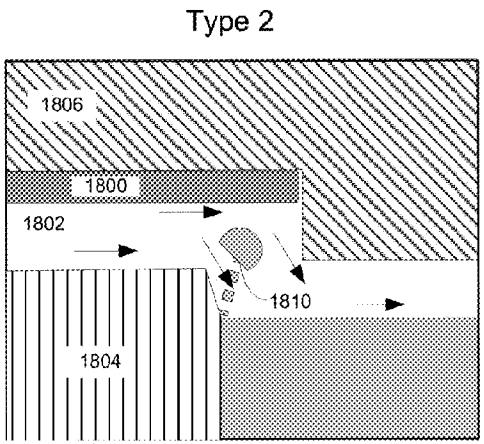
FIG. 18B
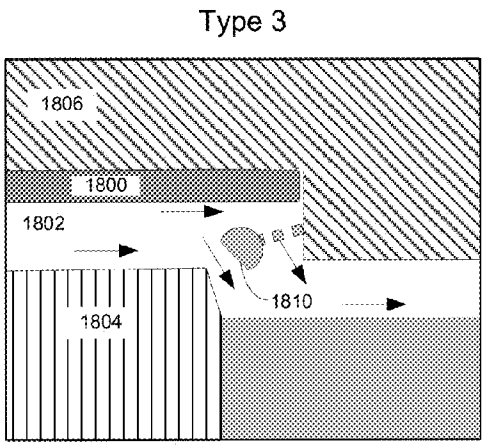
FIG. 18C
| Feature of Edge Flow Element | Type 1 | Type 2 | Type 3 |
|---|---|---|---|
| Attached to | CIRP | CIRP | Substrate Holder |
| Flow bypass between edge flow element and CIRP | No | Yes | Yes |
| Can be azimuthally asymmetric | Yes | Yes | No* |
FIG. 18D

| Shim Setup | Wafer-CIRP Gap (mm) | Upstream Gap (mm) | Downstream Gap (mm) |
|---|---|---|---|
| A | 2 | 2 | 2 |
| B | 2 | 1 | 1 |
| C | 2 | 2 | 1 |
| D | 2 | 2 | 0.5 |

WID non-uniformity = average(die 1 range/2, die 2 range/2, …)

| Parameter | Value | Units |
|---|---|---|
| Δz | 1 | mm |
| Jerk (z) | 15000 | $mm/s^3$ |
| Max Acceleration (z) | 3000 | $mm/s^2$ |
| Max Velocity (z) | 100 | mm/s |
| Jerk (θ) | 10000 | $°/s^3$ |
| Max Acceleration (θ) | 2000 | $°/s^2$ |
| Max Velocity (θ) | 24 | °/s |
| Settling Time | 0.25 | s |

DYNAMIC MODULATION OF CROSS FLOW MANIFOLD DURING ELECROPLATING

CROSS-REFERENCE TO RELATED APPLICATIONS

This application claims benefit of priority to U.S. Provisional Patent Application No. 62/340,736, filed May 24, 2016, and titled "ELECTROPLATING APPARATUS WITH SEALED CROSS FLOW OF ELECTROLYTE," which is herein incorporated by reference in its entirety and for all purposes.

FIELD OF THE INVENTION

This invention pertains to an electroplating apparatus and electroplating methods. Specifically, this invention pertains to improving electrolyte hydrodynamics during electroplating of metal layers on semiconductor substrates.

BACKGROUND

The disclosed embodiments relate to methods and apparatus for controlling electrolyte hydrodynamics during electroplating. More particularly, methods and apparatus described herein are particularly useful for plating metals onto semiconductor wafer substrates, such as through resist plating of small microbumping features (e.g., copper, nickel, tin and tin alloy solders) having widths less than, e.g., about 50 μm, and copper through silicon via (TSV) features.

Electrochemical deposition processes are well-established in modern integrated circuit fabrication. The transition from aluminum to copper metal line interconnections in the early years of the twenty-first century drove a need for increasingly sophisticated electrodeposition processes and plating tools. Much of the sophistication evolved in response to the need for ever smaller current carrying lines in device metallization layers. These copper lines are formed by electroplating the metal into very thin, high-aspect ratio trenches and vias in a methodology commonly referred to as "damascene" processing (pre-passivation metalization).

Electrochemical deposition is now poised to fill a commercial need for sophisticated packaging and multichip interconnection technologies known generally and colloquially as wafer level packaging (WLP) and through silicon via (TSV) electrical connection technology. These technologies present their own very significant challenges due in part to the generally larger feature sizes (compared to Front End of Line (FEOL) interconnects) and high aspect ratios.

The technologies involve electroplating on a significantly larger size scale than damascene applications. Depending on the type and application of the packaging features (e.g., through chip connecting TSV, interconnection redistribution wiring, or chip to board or chip bonding, such as flip-chip pillars), plated features are usually, in current technology, greater than about 2 micrometers and typically 5-300 micrometers (for example, pillars may be about 50 micrometers). For some on-chip structures such as power busses, the feature to be plated may be larger than 300 micrometers. The aspect ratios of the WLP features are typically about 1:1 (height to width) or lower, while TSV structures can have very high aspect ratios (e.g., in the neighborhood of about 20:1).

Given the relatively large amount of material to be deposited, not only feature size, but also plating speed differentiates WLP and TSV applications from damascene applications. For many WLP applications, plating must fill features at a rate of at least about 2 micrometers/minute, and typically at least about 4 micrometers/minute, and for some applications at least about 7 micrometers/minute. At these higher plating rate regimes, efficient mass transfer of metal ions in the electrolyte to the plating surface is important.

Higher plating rates present challenges with respect to uniformity of the electrodeposited layer, that is, plating must be conducted in a highly uniform manner.

SUMMARY

Methods, apparatus, and systems for improving electrolyte hydrodynamics during electroplating and for improving plating uniformity are herein provided. The embodiments are described using plating on a semiconductor substrate as an example, but the invention is not so limited. In some embodiments, the improved hydrodynamics and improved mass transfer of electrolyte is achieved by increasing the velocity of cross flow of electrolyte in the immediate vicinity of the surface of the substrate. In some embodiments the velocity of the electrolyte in a direction parallel to the plating surface of the substrate is at least about 50 cm/second across the center of the substrate. This can be achieved by concurrently creating the cross flow (e.g., by lateral electrolyte injection from a selected azimuthal position of the apparatus) and by sealing the cross flow near the substrate by blocking electrolyte outlets that could lead to reduced cross flow velocity. Apparatuses and methods for creating the cross flow across the center of the substrate are described in the commonly owned U.S. Pat. No. 8,795,480, naming Mayer et al. as inventors, issued on Aug. 5, 2014 and titled "Control of Electrolyte Hydrodynamics for Efficient Electrolyte Transfer during Electroplating" and in the US Patent Application Publication No. 2013/0313123 naming Abraham et al. as inventors, published on Nov. 28, 2013 and titled "Cross Flow Manifold for Electroplating Apparatus," as well as in the U.S. patent application Ser. No. 15/161,081, naming Graham et al. as inventors, filed on May 20, 2016, and titled "Dynamic Modulation of Cross Flow Manifold During Electroplating," which are herein incorporated by reference in their entireties. It is understood that the apparatuses described in these references may be modified to seal the cross flow as described herein.

Various embodiments herein utilize a channeled plate positioned near the substrate, creating a cross flow manifold defined on the bottom by the channeled plate, on the top by the substrate and the substrate holder, and on the sides by a cross flow confinement ring. During plating, fluid enters the cross flow manifold both upward through the channels in the channeled plate, and laterally through a cross flow side inlet positioned on one side of the cross flow confinement ring. The flow paths combine in the cross flow manifold and exit at the cross flow exit, which is positioned opposite the cross flow inlet. The cross flow manifold is sealed (at least partially) by positioning a compressible sealing member between the substrate holder and cross flow confinement ring, thereby preventing the electrolyte from exiting the cross flow manifold via paths other than the dedicated exit positioned across from the cross flow inlet. The sealing of the cross flow within the manifold results in the increased electrolyte velocity in the cross flow.

In one aspect of the embodiments, herein, an electroplating apparatus is provided, the apparatus including: (a) an electroplating chamber configured to contain an electrolyte and an anode while electroplating metal onto a substantially planar substrate; (b) a substrate holder configured to hold the substantially planar substrate such that a plating face of the substrate is separated from the anode during electroplating; (c) an ionically resistive element including a substrate-facing surface that is separated from the plating face of the substrate by a gap of about 10 mm or less, the gap forming a cross flow manifold between the ionically resistive element and the substrate, where the ionically resistive element is at least coextensive with the plating face of the substrate during electroplating, and where the ionically resistive element is adapted to provide ionic transport through the ionically resistive element during electroplating; (d) a side inlet to the cross flow manifold for introducing electrolyte to the cross flow manifold; (e) a side outlet to the cross flow manifold for receiving electrolyte flowing in the cross flow manifold, where the side inlet and side outlet are positioned proximate azimuthally opposing perimeter locations on the plating face of the substrate during electroplating, and where the side inlet and side outlet are adapted to generate cross flowing electrolyte in the cross flow manifold; and (f) a sealing member for wholly or partially sealing one or more outlets to the cross flow manifold other than the side outlet.

In some embodiments, the apparatus may further include a flow confinement element positioned peripherally in the cross flow manifold between the ionically resistive element and the substrate holder. The apparatus may further include a leakage gap between a surface of the substrate holder and a surface of the flow confinement element, where the sealing member is configured to seal the leakage gap when the substrate holder is sufficiently near the flow confinement element. The sealing member may seal a particular portion of the leakage gap. For instance, the sealing member may seal at least about 75% of the leakage gap. In another embodiment, the sealing member seals about 100% of the leakage gap.

The side outlet may be formed in the flow confinement element in certain implementations. In some such cases, the side outlet may include a vent region in the flow confinement element, the vent region spanning between about 20-120 degrees proximate the periphery of the substrate.

The sealing member may have particular properties, or be made from specific materials. In some cases, the sealing member includes a compressible material. In some such cases, the sealing member may include a fluoropolymer elastomer. The fluoropolymer may include between about 65-70% fluorine. The sealing member may be fixedly or releasably attached to the substrate holder. In some other cases, the sealing member may be fixedly or releasably attached to the flow confinement element. In still other cases, the sealing member may be fixedly or releasably attached to a scaffold that is different from the substrate holder and the flow confinement element.

When the sealing member is engaged, the apparatus may be considered to be in a sealed state. When the sealing member is not engaged, the apparatus may be considered to be in an unsealed state. The apparatus may further include a controller that includes executable instructions for intermittently switching between the sealed state and the unsealed state during electroplating. The controller may further include executable instructions for rotating the substrate while the apparatus is in the unsealed state. In some cases, the controller may include executable instructions for applying a reduced current to the substrate while the apparatus is in the unsealed state compared to when the apparatus is in the sealed state. In other cases, the controller may include executable instructions for applying an increased current to the substrate while the apparatus is in the unsealed state compared to when the apparatus is in the sealed state. In still other cases, the controller may include executable instructions for applying a current to the substrate while the apparatus is in the sealed state, and applying no current to the substrate while the apparatus is in the unsealed state.

In a further aspect of the disclosed embodiments, a method for electroplating on a substrate is provided, the method including: (a) receiving a substantially planar substrate in a substrate holder, where a plating face of the substrate is exposed, and where the substrate holder is configured to hold the substrate such that the plating face of the substrate is separated from an anode during electroplating, (b) immersing the substrate in electrolyte, where a gap of about 10 mm or less is formed between the plating face of the substrate and an upper surface of an ionically resistive element, the gap forming a cross flow manifold, where the ionically resistive element is at least coextensive with the plating face of the substrate, and where the ionically resistive element is adapted to provide ionic transport through the ionically resistive element during electroplating, (c) flowing electrolyte in contact with the substrate in the substrate holder (i) from a side inlet, into the cross flow manifold, and out a side outlet, and, optionally, (ii) from below the ionically resistive element, through the ionically resistive element, into the cross flow manifold, and out the side outlet, where the side inlet and side outlet are positioned proximate azimuthally opposed perimeter locations on the plating face of the substrate, where the side inlet and side outlet are designed or configured to generate cross flowing electrolyte in the cross flow manifold during electroplating, and where a sealing member wholly or partially seals one or more outlets to the cross flow manifold other than the side outlet during at least a portion of electroplating; and (d) electroplating material onto the plating face of the substrate while flowing the electrolyte as in (c).

In various embodiments, when the sealing member is engaged, the cross flow manifold is in a sealed state, and when the sealing member is not engaged, the cross flow manifold is in an unsealed state. In certain implementations, electroplating material in (d) may include: (i) electroplating material while rotating the substrate when the cross flow manifold is in the unsealed state, (ii) electroplating material while engaging the sealing member to seal the cross flow manifold, (iii) electroplating material while maintaining the substrate rotationally stationary when the cross flow manifold is in the sealed state, and (iv) electroplating material while disengaging the sealing member to unseal the cross flow manifold. The electroplating may occur continuously during (i)-(iv). In some such cases, operations (i)-(iv) of electroplating material in (d) are performed at least three times during electroplating on the substrate. The cross flow manifold may be in the sealed state for more than half of the total plating time in certain embodiments. In some cases, electroplating material in (d) may include: (i) applying a first current to the substrate while maintaining the substrate rotationally stationary when the cross flow manifold is in the sealed state, and (ii) either (A) applying no current to the substrate, or (B) applying a current that is different from the first current while rotating the substrate when the cross flow manifold is in the unsealed state.

According to another aspect, an apparatus for electroplating includes a plating cell and a controller. The controller includes program instructions for conducting any of the electroplating methods provided herein.

According to another aspect, a system is provided herein which includes the electroplating apparatus and a stepper.

According to another aspect, a non-transitory computer machine-readable medium is provided, which includes executable program instructions for control of the apparatus. The instructions include code for treatment methods provided herein These and other features will be described below with reference to the associated drawings.

BRIEF DESCRIPTION OF THE DRAWINGS

FIGS. 18A-18C illustrates three types of attachment configurations for installing an edge flow element in an electroplating apparatus according to various embodiments.

FIG. 18D presents a table describing certain features of the edge flow elements shown in FIGS. 18A-18C.

DETAILED DESCRIPTION

Figure 1A:
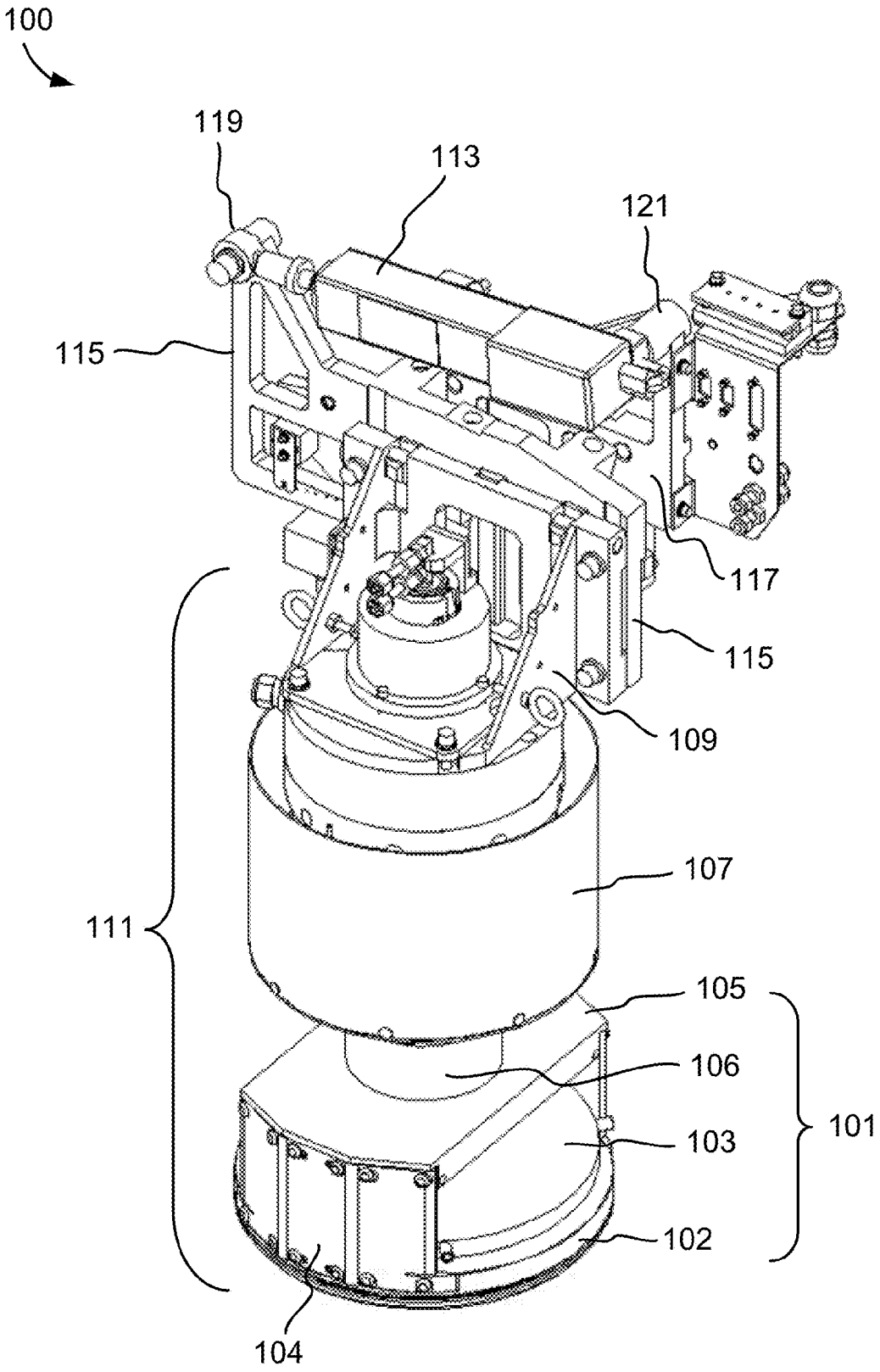
FIG. 1A shows a perspective view of a substrate holding and positioning apparatus for electrochemically treating semiconductor wafers.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. The following detailed description assumes the invention is implemented on a wafer. Oftentimes, semiconductor wafers have a diameter of 200, 300 or 450 mm. However, the invention is not so limited. The work piece may be of various shapes, sizes, and materials. In addition to semiconductor wafers, other work pieces that may take advantage of this invention include various articles such as printed circuit boards and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

The methods and apparatus provided herein can be used for electroplating on a variety of substrates, including WLP, TSV, and Damascene substrates. A variety of metals and metal alloys can be electroplated, including but not limited to copper, tin, silver, tin-silver alloy, nickel, gold, indium, and cobalt. In a typical electroplating process the wafer substrate containing an exposed conductive seed layer is cathodically biased and is brought in contact with an electroplating solution containing ions of a metal that is being plated. Ions are electrochemically reduced at the surface of the seed layer to form a metal layer. Various embodiments of the invention will be illustrated using through-resist electroplating as an example, but the invention is not so limited.

Disclosed embodiments include electroplating apparatus configured for, and methods including, control of electrolyte hydrodynamics during plating so that highly uniform plating layers are obtained. In specific implementations, the disclosed embodiments employ methods and apparatus that create combinations of impinging flow (flow directed at or perpendicular to the work piece surface) and shear flow (sometimes referred to as "cross flow" or flow with velocity parallel to the work piece surface).

One embodiment is an electroplating apparatus including the following features: (a) a plating chamber configured to contain an electrolyte and an anode while electroplating metal onto a substrate, the substrate being substantially planar; (b) a substrate holder configured to hold the substrate such that a plating face of the substrate is separated from the anode during electroplating; (c) a channeled ionically resistive element including a substrate-facing surface that is substantially parallel to and separated from a plating face of the substrate during electroplating, the channeled ionically resistive element including a plurality of non-communicating channels, where the non-communicating channels allow for transport of the electrolyte through the element during electroplating; (d) a cross flow manifold defined between the plating face of the substrate and the substrate-facing surface of the channeled ionically resistive element, the cross flow manifold having a height that can be dynamically controlled during electroplating; (e) a mechanism for creating and/or applying a shearing force (cross flow) to the electrolyte flowing in the cross flow manifold at the plating face of the substrate; and (f) an optional mechanism for promoting shear flow near the periphery of the substrate, proximate a substrate/substrate holder interface. Though the wafer is substantially planar, it also typically has one or more microscopic trenches and may have one or more portions of the surface masked from electrolyte exposure. In various embodiments, the apparatus also includes a mechanism for rotating the substrate and/or the channeled ionically resistive element while flowing electrolyte in the electroplating cell in the direction of the substrate plating face. In certain implementations, the apparatus may include a seal configured to prevent electrolyte from leaving the cross flow manifold at locations other than a designated outlet to the cross flow manifold positioned azimuthally opposite an inlet to the cross flow manifold.

In many cases described herein, the cross flow manifold has a height that can be dynamically controlled during electroplating. Because the cross flow manifold is defined between the substrate and the CIRP, the height of the cross flow manifold can be controlled by varying the relative position of the substrate and CIRP. In some cases, the position of the substrate is directly controlled while the CIRP is relatively stationary. In other cases, the position of the CIRP is directly controlled (either by itself, or along with other portions of the electroplating apparatus) while the substrate is relatively stationary. In still other cases, the positions of both the substrate and the CIRP may be directly controlled. By using a cross flow manifold that can change height during the course of an electroplating process, certain plating non-uniformities can be minimized, as discussed further herein.

In some such embodiments, a seal may be provided between a bottom surface of the substrate holder and an upper surface of an element positioned below the substrate holder (e.g., a flow confinement element, CIRP, etc.) when the substrate holder is in its lowest position. The seal may prevent electrolyte from leaking out of the apparatus between the bottom of the substrate holder and the top of the flow confinement element, for instance. In a number of embodiments, the apparatus may cycle between a sealed position (when the position of the substrate holder is at its lowest and the height of the cross flow manifold is at a minimum) and an unsealed position (when the substrate holder is elevated and the height of the cross flow manifold is relatively greater). The substrate may be rotated while the apparatus is in the unsealed position. In these or other cases, the substrate may also be rotated while the apparatus is in the sealed position. Periodic sealing of the cross flow can increase the volume and velocity of cross flowing electrolyte that passes over the surface of the substrate, thereby providing improved plating uniformity.

In certain implementations, the mechanism for applying cross flow is an inlet with, for example, appropriate flow directing and distributing means on or proximate to the periphery of the channeled ionically resistive element. The inlet directs cross flowing catholyte along the substrate-facing surface of the channeled ionically resistive element. The inlet is azimuthally asymmetric, partially following the circumference of the channeled ionically resistive element, and having one or more gaps, and defining a cross flow injection manifold between the channeled ionically resistive element and the substantially planar substrate during electroplating. Other elements are optionally provided for working in concert with the cross flow injection manifold. These may include a cross flow injection flow distribution showerhead and a cross flow confinement ring, which are further described below in conjunction with the figures.

In certain implementations, the optional mechanism for promoting shear flow near the periphery of the substrate is an edge flow element. The edge flow element may be an integral part of a channeled ionically resistive plate or substrate holder in some cases. In other cases, the edge flow element may be a separate piece that interfaces with the channeled ionically resistive plate or with the substrate holder. In some cases where the edge flow element is a separate piece, a variety of differently shaped edge flow elements may be separately provided to allow the flow distribution near the edge of a substrate to be tuned for a given application. In various cases the edge flow element may be azimuthally asymmetric. Further details regarding the optional edge flow element are presented below. The edge flow element may be particularly useful for combating certain plating non-uniformities when practiced in conjunction with a cross flow manifold having a dynamic height that can be actively controlled during an electroplating process.

In certain embodiments, the apparatus is configured to enable flow of electrolyte in the direction towards or perpendicular to a substrate plating face to produce an average flow velocity of at least about 3 cm/s (e.g., at least about 5 cm/s or at least about 10 cm/s) exiting the holes of the channeled ionically resistive element during electroplating. In certain embodiments, the apparatus is configured to operate under conditions that produce an average transverse electrolyte velocity of about 3 cm/sec or greater (e.g., about 5 cm/s or greater, about 10 cm/s or greater, about 15 cm/s or greater, or about 20 cm/s or greater) across the center point of the plating face of the substrate. These flow rates (e.g., the flow rate exiting the holes of the ionically resistive element and the flow rate across the plating face of the substrate) are in certain embodiments appropriate in an electroplating cell employing an overall electrolyte flow rate of about 20 L/min and an approximately 12 inch diameter substrate. The embodiments herein may be practiced with various substrate sizes. In some cases, the substrate has a diameter of about 200 mm, about 300 mm, or about 450 mm. Further, the embodiments herein may be practiced at a wide variety of overall flow rates. In certain implementations, the overall electrolyte flow rate is between about 1-60 L/min, between about 6-60 L/min, between about 5-25 L/min, or between about 15-25 L/min. The flow rates achieved during plating may be limited by certain hardware constraints, such as the size and capacity of the pump being used. One of skill in the art would understand that the flow rates cited herein may be higher when the disclosed techniques are practiced with larger pumps.

In some embodiments, the electroplating apparatus contains separated anode and cathode chambers in which there are different electrolyte compositions, electrolyte circulation loops, and/or hydrodynamics in each of two chambers. An ionically permeable membrane may be employed to inhibit direct convective transport (movement of mass by flow) of one or more components between the chambers and maintain a desired separation between the chambers. The membrane may block bulk electrolyte flow and exclude transport of certain species such as organic additives while permitting transport of ions such as cations. In some embodiments, the membrane contains DuPont's NAFION™ or a related ionically selective polymer. In other cases, the membrane does not include an ion exchange material, and instead includes a micro-porous material. Conventionally, the electrolyte in the cathode chamber is referred to as "catholyte" and the electrolyte in the anode chamber is referred to as "anolyte." Frequently, the anolyte and catholyte have different compositions, with the anolyte containing little or no plating additives (e.g., accelerator, suppressor, and/or leveler) and the catholyte containing significant concentrations of such additives. The concentration of metal ions and acids also often differs between the two chambers. An example of an electroplating apparatus containing a separated anode chamber is described in U.S. Pat. No. 6,527,920, filed Nov. 3, 2000 ; U.S. Pat. No. 6,821,407, filed Aug. 27, 2002 , and U.S. Pat. No. 8,262,871, filed Dec. 17, 2009 each of which is incorporated herein by reference in its entirety.

In some embodiments, the anode membrane need not include an ion exchange material. In some examples, the membrane is made from a micro-porous material such as polyethersulfone manufactured by Koch Membrane of Wilmington, Mass. This membrane type is most notably applicable for inert anode applications such as tin-silver plating and gold plating, but may also be used for soluble anode applications such as nickel plating.

In certain embodiments, and as described more fully elsewhere herein, catholyte is injected into a manifold region, referred to hereafter as the "CIRP manifold region", in which electrolyte is fed, accumulates, and then is distributed and passes substantially uniformly through the various non-communication channels of the CIRP directly towards the wafer surface.

In the following discussion, when referring to top and bottom features (or similar terms such as upper and lower features, etc.) or elements of the disclosed embodiments, the terms top and bottom are simply used for convenience and represent only a single frame of reference or implementation of the invention. Other configurations are possible, such as those in which the top and bottom components are reversed with respect to gravity and/or the top and bottom components become the left and right or right and left components.

While some aspects described herein may be employed in various types of plating apparatus, for simplicity and clarity, most of the examples will concern wafer-face-down, "fountain" plating apparatus. In such apparatus, the work piece to plated (typically a semiconductor wafer in the examples presented herein) generally has a substantially horizontal orientation (which may in some cases vary by a few degrees from true horizontal for some part of, or during the entire plating process) and may be powered to rotate during plating, yielding a generally vertically upward electrolyte convection pattern. Integration of the impinging flow mass from the center to the edge of the wafer, as well as the inherent higher angular velocity of a rotating wafer at its edge relative to its center, creates a radially increasing sheering (wafer parallel) flow velocity. One example of a member of the fountain plating class of cells/apparatus is the Sabre® Electroplating System produced by and available from Novellus Systems, Inc. of San Jose, Calif. Additionally, fountain electroplating systems are described in, e.g., U.S. Pat. No. 6,800,187, filed Aug. 10, 2001 and U.S. Pat. No. 8,308,931, filed Nov. 7, 2008 , which are incorporated herein by reference in their entireties.

The substrate to be plated is generally planar or substantially planar. As used herein, a substrate having features such as trenches, vias, photoresist patterns and the like is considered to be substantially planar. Often these features are on the microscopic scale, though this is not necessarily always the case. In many embodiments, one or more portions of the surface of the substrate may be masked from exposure to the electrolyte.

Figure 1B:
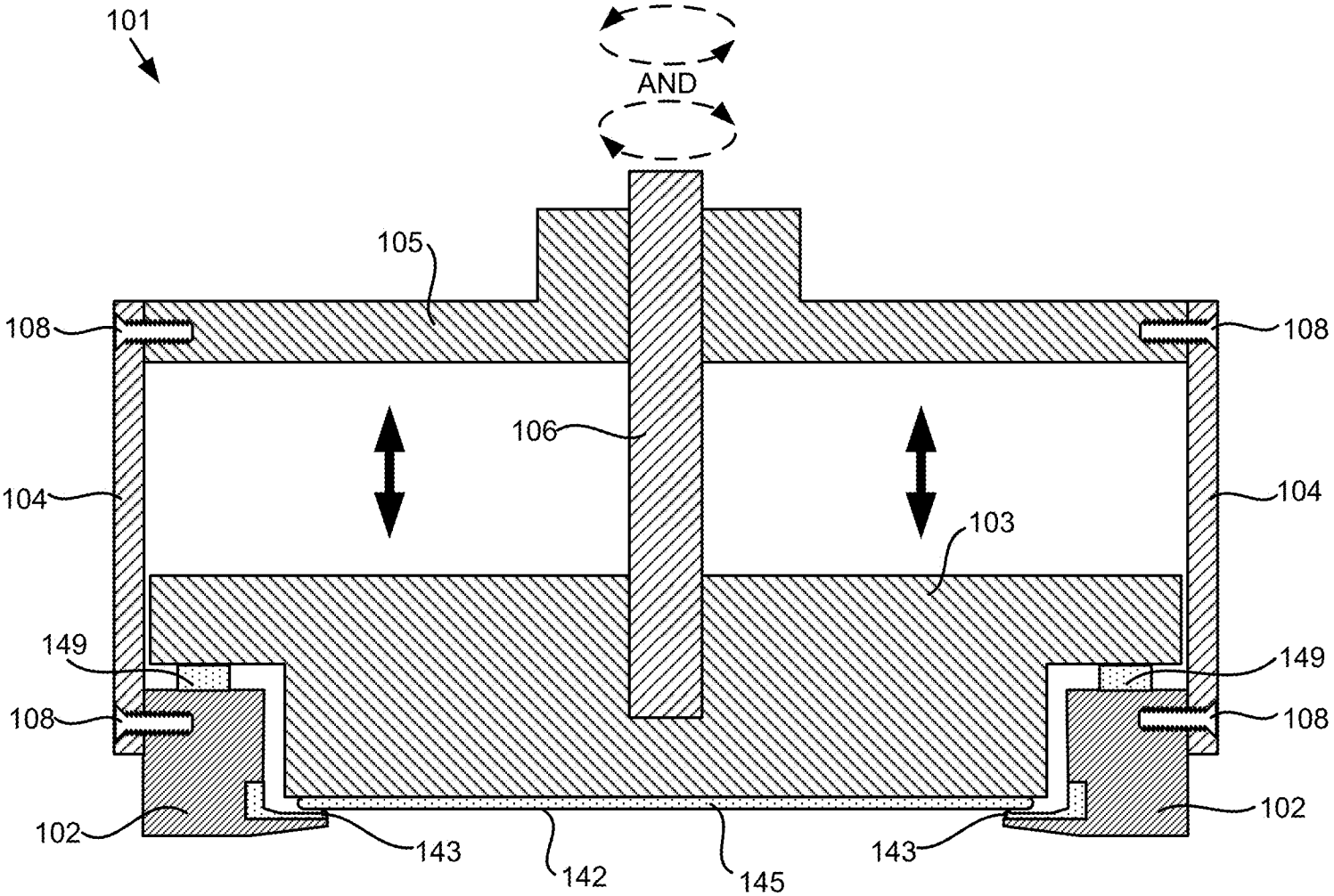
FIG. 1B depicts a cross-sectional view of a portion of a substrate holding assembly including a cone and cup.

The following description of FIGS. 1A and 1B provides a general non-limiting context to assist in understanding the apparatus and methods described herein. FIG. 1A provides a perspective view of a wafer holding and positioning apparatus 100 for electrochemically treating semiconductor wafers. Apparatus 100 includes wafer engaging components (sometimes referred to herein as "clamshell" components). The actual clamshell includes a cup 102 and a cone 103 that enables pressure to be applied between the wafer and the seal, thereby securing the wafer in the cup.

Cup 102 is supported by struts 104, which are connected to a top plate 105. This assembly (102-105), collectively assembly 101, is driven by a motor 107, via a spindle 106. Motor 107 is attached to a mounting bracket 109. Spindle 106 transmits torque to a wafer (not shown in this figure) to allow rotation during plating. An air cylinder (not shown) within spindle 106 also provides vertical force between the cup and cone 103 to create a seal between the wafer and a sealing member (lipseal) housed within the cup. For the purposes of this discussion, the assembly including components 102-109 is collectively referred to as a wafer holder 111. Note however, that the concept of a "wafer holder" extends generally to various combinations and sub-combinations of components that engage a wafer and allow its movement and positioning.

A tilting assembly including a first plate 115, that is slidably connected to a second plate 117, is connected to mounting bracket 109. A drive cylinder 113 is connected both to plate 115 and plate 117 at pivot joints 119 and 121, respectively. Thus, drive cylinder 113 provides force for sliding plate 115 (and thus wafer holder 111) across plate 117. The distal end of wafer holder 111 (e.g., mounting bracket 109) is moved along an arced path (not shown) which defines the contact region between plates 115 and 117, and thus the proximal end of wafer holder 111 (e.g., cup and cone assembly) is tilted upon a virtual pivot. This allows for angled entry of a wafer into a plating bath.

The entire apparatus 100 is lifted vertically either up or down to immerse the proximal end of wafer holder 111 into a plating solution via another actuator (not shown). This actuator (and the related lifting motion) provides one possible mechanism for controlling the height of the cross flow manifold between the substrate and the CIRP. Any similar mechanism that allows the wafer holder 111 (or any portion thereof that supports the actual wafer) to move towards/away from the CIRP may be used for this purpose. The apparatus 100 shown in FIG. 1A provides a two-component positioning mechanism provides both vertical movement along a trajectory perpendicular to an electrolyte and a tilting movement allowing deviation from a horizontal orientation (parallel to electrolyte surface) for the wafer (angled-wafer immersion capability). A more detailed description of the movement capabilities and associated hardware of apparatus 100 is described in U.S. Pat. No. 6,551,487 filed May 31, 2001 and issued Apr. 22, 2003 , which is herein incorporated by reference in its entirety.

Note that apparatus 100 is typically used with a particular plating cell having a plating chamber which houses an anode (e.g., a copper anode or a non-metal inert anode) and electrolyte. The plating cell may also include plumbing or plumbing connections for circulating electrolyte through the plating cell—and against the work piece being plated. It may also include membranes or other separators designed to maintain different electrolyte chemistries in an anode compartment and a cathode compartment. In one embodiment, one membrane is employed to define an anode chamber, which contains electrolyte that is substantially free of suppressors, accelerators, or other organic plating additives, or in another embodiment, where the inorganic plating composition of the anolyte and catholyte are substantially different. Means of transferring anolyte to the catholyte or to the main plating bath by physical means (e.g., direct pumping including values, or an overflow trough) may optionally also be supplied.

The following description provides more detail of the cup and cone assembly of the clamshell. FIG. 1B depicts a portion, 101, of assembly 100, including cone 103 and cup 102 in cross-section format. Note that this figure is not meant to be a true depiction of a cup and cone product assembly, but rather a stylized depiction for discussion purposes. Cup 102 is supported by top plate 105 via struts 104, which are attached via screws 108. Generally, cup 102 provides a support upon which wafer 145 rests. It includes an opening through which electrolyte from a plating cell can contact the wafer. Note that wafer 145 has a front side 142, which is where plating occurs. The periphery of wafer 145 rests on the cup 102. The cone 103 presses down on the back side of the wafer to hold it in place during plating.

To load a wafer into 101, cone 103 is lifted from its depicted position via spindle 106 until cone 103 touches top plate 105. From this position, a gap is created between the cup and the cone into which wafer 145 can be inserted, and thus loaded into the cup. Then cone 103 is lowered to engage the wafer against the periphery of cup 102 as depicted, and mate to a set of electrical contacts (not shown in 1B) radially beyond the lip seal 143 along the wafer's outer periphery.

Spindle 106 transmits both vertical force for causing cone 103 to engage a wafer 145 and torque for rotating assembly 101. These transmitted forces are indicated by the arrows in FIG. 1B. Note that wafer plating typically occurs while the wafer is rotating (as indicated by the dashed arrows at the top of FIG. 1B).

Cup 102 has a compressible lip seal 143, which forms a fluid-tight seal when cone 103 engages wafer 145. The vertical force from the cone and wafer compresses lip seal 143 to form the fluid tight seal. The lip seal prevents electrolyte from contacting the backside of wafer 145 (where it could introduce contaminating species such as copper or tin ions directly into silicon) and from contacting sensitive components of apparatus 101. There may also be seals located between the interface of the cup and the wafer which form fluid-tight seals to further protect the backside of wafer 145 (not shown).

Cone 103 also includes a seal 149. As shown, seal 149 is located near the edge of cone 103 and an upper region of the cup when engaged. This also protects the backside of wafer 145 from any electrolyte that might enter the clamshell from above the cup. Seal 149 may be affixed to the cone or the cup, and may be a single seal or a multi-component seal.

Upon initiation of plating, cone 103 is raised above cup 102 and wafer 145 is introduced to assembly 102. When the wafer is initially introduced into cup 102—typically by a robot arm—its front side, 142, rests lightly on lip seal 143. During plating the assembly 101 rotates in order to aid in achieving uniform plating. In subsequent figures, assembly 101 is depicted in a more simplistic format and in relation to components for controlling the hydrodynamics of electrolyte at the wafer plating surface 142 during plating. Thus, an overview of mass transfer and fluid shear at the work piece follows.

Figure 1C:
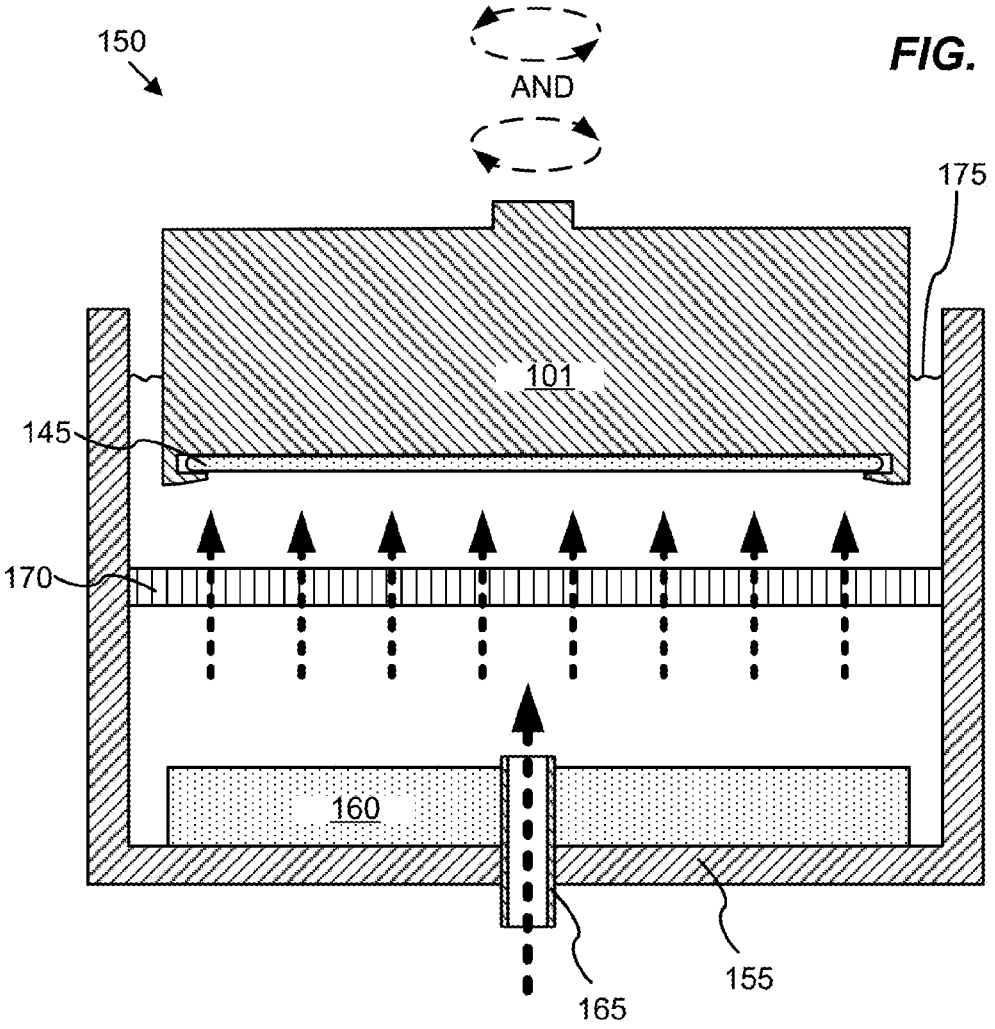
FIG. 1C depicts a simplified view of an electroplating cell that may be used in practicing the embodiments herein.

As depicted in FIG. 1C, a plating apparatus 150 includes a plating cell 155 which houses anode 160. In this example, electrolyte 175 is flowed into cell 155 centrally through an opening in anode 160, and the electrolyte passes through a channeled ionically resistive element 170 having vertically oriented (non-intersecting) through holes through which electrolyte flows and then impinges on wafer 145, which is held in, positioned and moved by, wafer holder 101. Channeled ionically resistive elements such as 170 provide uniform impinging flow upon the wafer plating surface. In accordance with certain embodiments described herein, apparatus utilizing such channeled ionically resistive elements are configured and/or operated in a manner that facilitates high rate and high uniformity plating across the face of the wafer, including plating under high deposition rate regimes such as for WLP and TSV applications. Any or all of the various embodiments described can be implemented in the context of Damascene as well as TSV and WLP applications.

FIGS. 1D-1G relate to certain techniques that may be used to encourage cross flow across the face of a substrate being plated. Various techniques described in relation to these figures present alternative strategies for encouraging cross flow. As such, certain elements described in these figures are optional, and are not present in all embodiments.

Figure 1D:
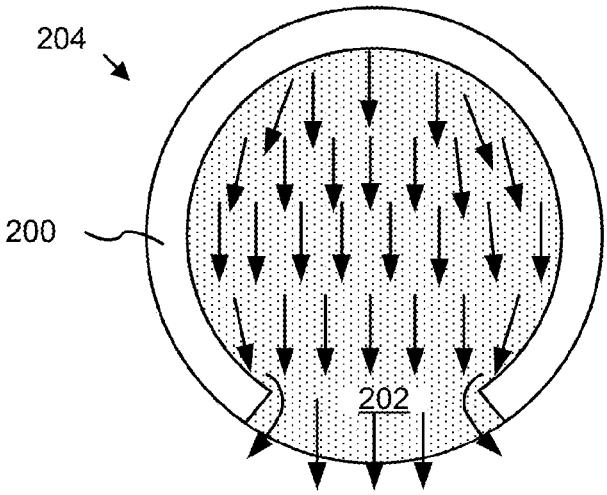
FIG. 1D-1G illustrate various electroplating apparatus embodiments that may be used to enhance cross flow across the face of a substrate, along with top views of the flow dynamics achieved when practicing these embodiments.

In some embodiments, electrolyte flow ports are configured to aid transverse flow, alone or in combination with a flow shaping plate and a flow diverter as described herein. Various embodiments are described below in relation to a combination with a flow shaping plate and a flow diverter, but the invention is not so limited. Note that in certain embodiments it is believed that the magnitude of the electrolyte flow vectors across the wafer surface are larger proximate the vent or gap and progressively smaller across the wafer surface, being smallest at the interior of the pseudo chamber furthest from the vent or gap. As depicted in FIG. 1D, by using appropriately configured electrolyte flow ports, the magnitude of these transverse flow vectors is more uniform across the wafer surface.

Figure 1E:
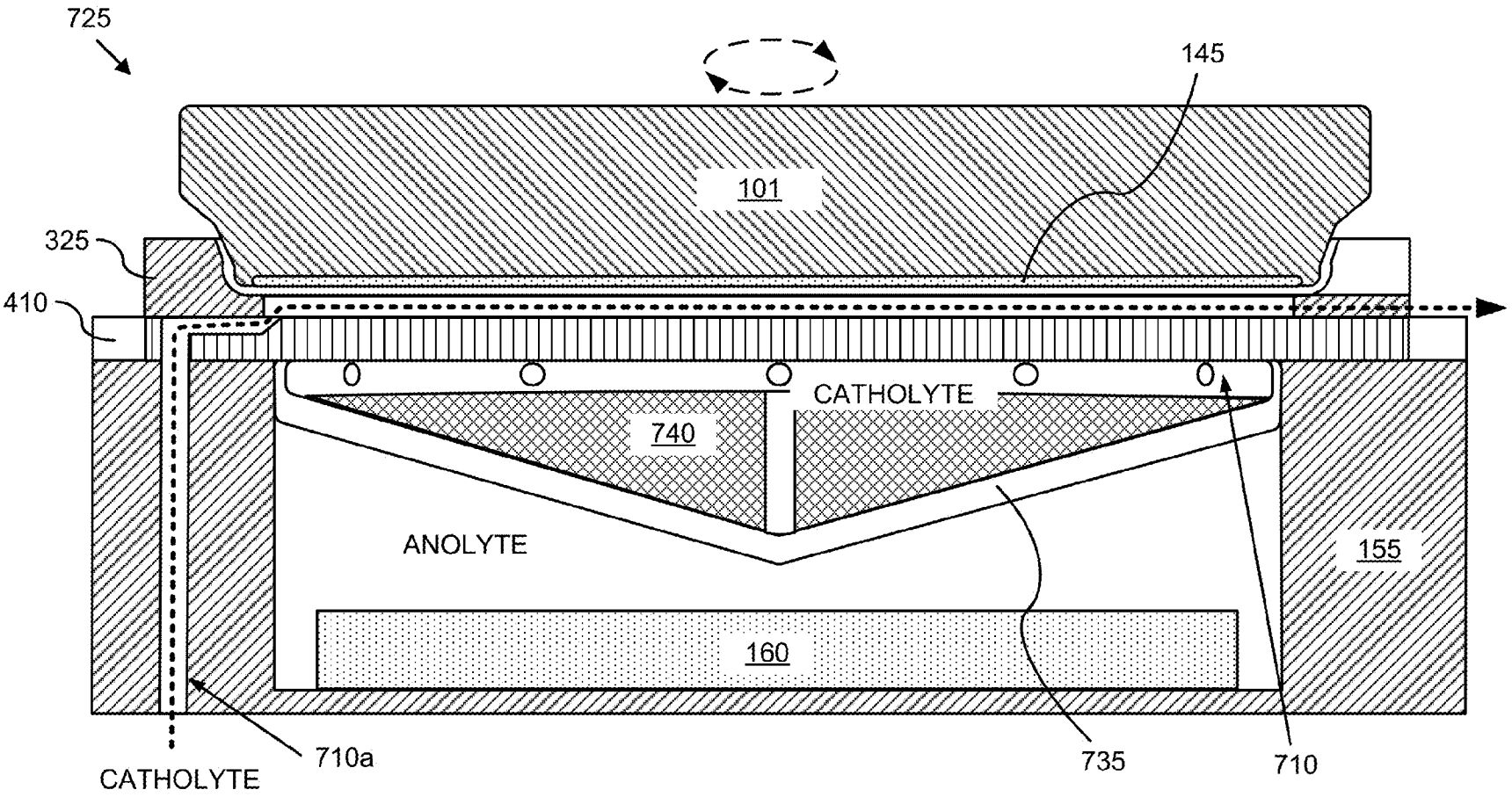

Some embodiments include electrolyte inlet flow ports configured for transverse flow enhancement in conjunction with flow shaping plate and flow diverter assemblies. FIG. 1E depicts a cross-section of components of a plating apparatus, 725, for plating copper onto a wafer, 145, which is held, positioned and rotated by wafer holder 101. Apparatus 725 includes a plating cell, 155, which is dual chamber cell, having an anode chamber with a copper anode, 160, and anolyte. The anode chamber and cathode chamber are separated by a cationic membrane 740 which is supported by a support member 735. Plating apparatus 725 includes a flow shaping plate, 410, as described herein. A flow diverter, 325, is on top of flow shaping plate 410, and aides in creating transverse shear flow as described herein. Catholyte is introduced into the cathode chamber (above membrane 740) via flow ports 710. From flow ports 710, catholyte passes through flow plate 410 as described herein and produces impinging flow onto the plating surface of wafer 145. In addition to catholyte flow ports 710, an additional flow port, 710*a*, introduces catholyte at its exit at a position distal to the vent or gap of flow diverter 325. In this example, flow port 710*a*'s exit is formed as a channel in flow shaping plate 410. The functional result is that catholyte flow is introduced directly into the pseudo chamber formed between the flow plate and the wafer plating surface in order to enhance transverse flow across the wafer surface and thereby normalize the flow vectors across the wafer (and flow plate 410).

Figure 1F:
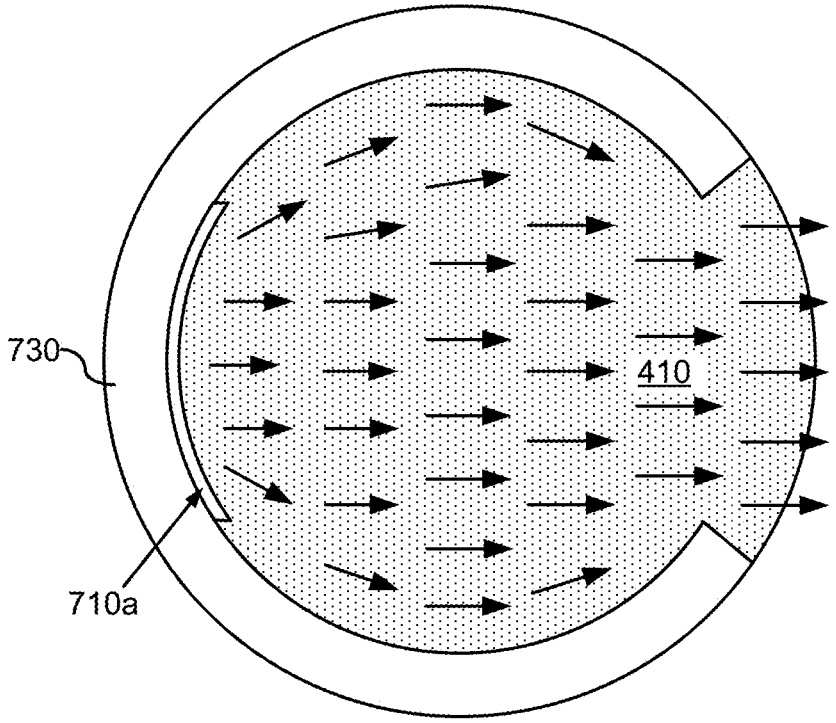
Figure 1G:
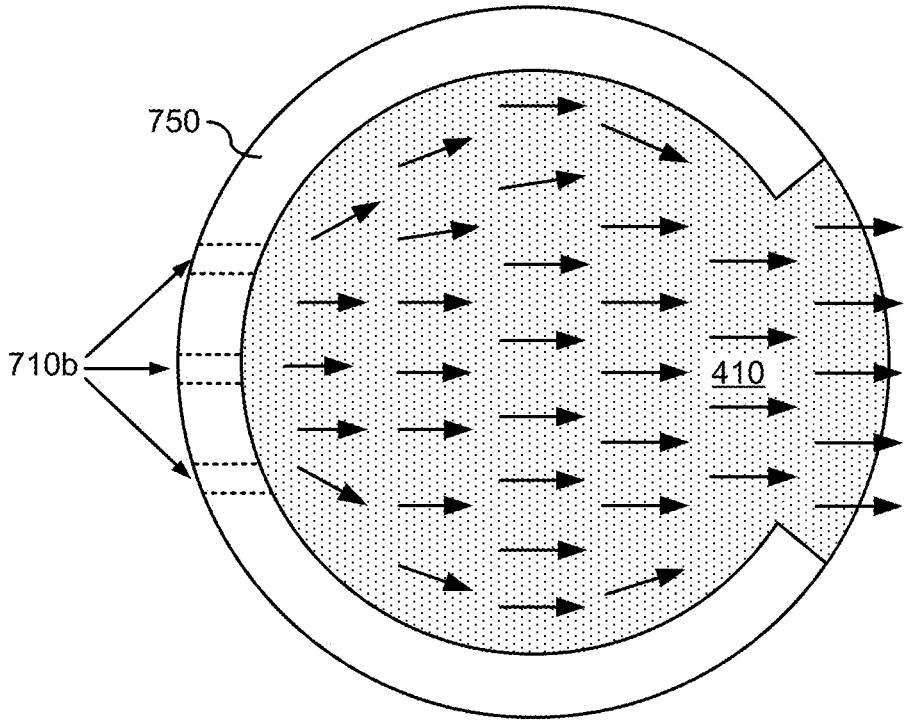

FIG. 1F depicts a flow diagram depicting the flow port 710*a* (from FIG. 1E). As seen in FIG. 1F, flow port 710*a*'s exit spans 90 degrees of the inner circumference of flow diverter 730. One of ordinary skill in the art would appreciate that the dimensions, configuration and location of port 710*a*may vary without escaping the scope of the invention. One of skill in the art would also appreciate that equivalent configurations would include having the catholyte exit from a port or channel in flow diverter 325 and/or in combination with a channel such as depicted in FIG. 1E (in flow plate 410). Other embodiments include one or more ports in the (lower) side wall of a flow diverter, e.g., that side wall nearest the flow shaping plate top surface, where the one or more ports are located in a portion of the flow diverter opposite the vent or gap. FIG. 1G depicts a flow diverter, 750, assembled with a flow shaping plate 410, where flow diverter 750 has catholyte flow ports, 710*b*, that supply electrolyte from the flow diverter opposite the gap of the flow diverter. Flow ports such as 710*a* and 710*b* may supply electrolyte at any angle relative to the wafer plating surface or the flow shaping plate top surface. The one or more flow ports can deliver impinging flow to the wafer surface and/or transverse (shear) flow.

In one embodiment, for example as described in relation to FIGS. 1E-1G, a flow shaping plate as described herein is used in conjunction with a flow diverter, where a flow port configured for enhanced transverse flow (as described herein) is also used with the flow plate/flow diverter assembly. In one embodiment the flow shaping plate has non-uniform hole distribution, in one embodiment, a spiral hole pattern.

Terminology and Flow Paths

Numerous figures are provided to further illustrate and explain the embodiments disclosed herein. The figures include, among other things, various drawings of the structural elements and flow paths associated with a disclosed electroplating apparatus. These elements are given certain names/reference numbers, which are used consistently in describing FIGS. 2 through 22A-22B.

The following embodiments assume, for the most part, that electroplating apparatus includes a separate anode chamber. The described features are contained in a cathode chamber, which includes a membrane frame 274 and membrane 202 that separate the anode chamber from the cathode chamber. Any number of possible anode and anode chamber configurations may be employed. In the following embodiments, the catholyte contained in the cathode chamber is largely located either in a cross flow manifold 226 or in the channeled ionically resistive plate manifold 208 or in channels 258 and 262 for delivering catholyte to these two separate manifolds.

Much of the focus in the following description is on controlling the catholyte in the cross flow manifold 226. The catholyte enters the cross flow manifold 226 through two separate entry points: (1) the channels in the channeled ionically resistive plate 206 and (2) cross flow initiating structure 250. The catholyte arriving in the cross flow manifold 226 via the channels in the CIRP 206 is directed toward the face of the work piece, typically in a substantially perpendicular direction. Such channel delivered catholyte may form small jets that impinge on the face of the work piece, which is typically rotating slowly (e.g., between about 1 to 30 rpm) with respect to the channeled plate. The catholyte arriving in the cross flow manifold 226 via the cross flow initiating structure 250 is, in contrast, directed substantially parallel to the face of the work piece.

As indicated in the discussion above, a "channeled ionically resistive plate" 206 (or "channeled ionically resistive element" or "CIRP") is positioned between the working electrode (the wafer or substrate) and the counter electrode (the anode) during plating, in order to shape the electric field and control electrolyte flow characteristics. Various figures herein show the relative position of the channeled ionically resistive plate 206 with respect to other structural features of the disclosed apparatus. One example of such an ionically resistive element 206 is described in U.S. Pat. No. 8,308,931, filed Nov. 7, 2008 , which was previously incorporated by reference herein in its entirety. The channeled ionically resistive plate described therein is suitable to improve radial plating uniformity on wafer surfaces such as those containing relatively low conductivity or those containing very thin resistive seed layers. Further aspects of certain embodiments of the channeled element are described below.

A "membrane frame" 274 (sometimes referred to as an anode membrane frame in other documents) is a structural element employed in some embodiments to support a membrane 202 that separates an anode chamber from a cathode chamber. It may have other features relevant to certain embodiments disclosed herein. Particularly, with reference to the embodiments of the figures, it may include flow channels 258 and 262 for delivering catholyte toward a cross flow manifold 226 and showerhead 242 configured to deliver cross flowing catholyte to the cross flow manifold 226. The membrane frame 274 may also contain a cell weir wall 282, which is useful in determining and regulating the uppermost level of the catholyte. Various figures herein depict the membrane frame 274 in the context of other structural features associated with the disclosed cross flow apparatus.

Figure 2:
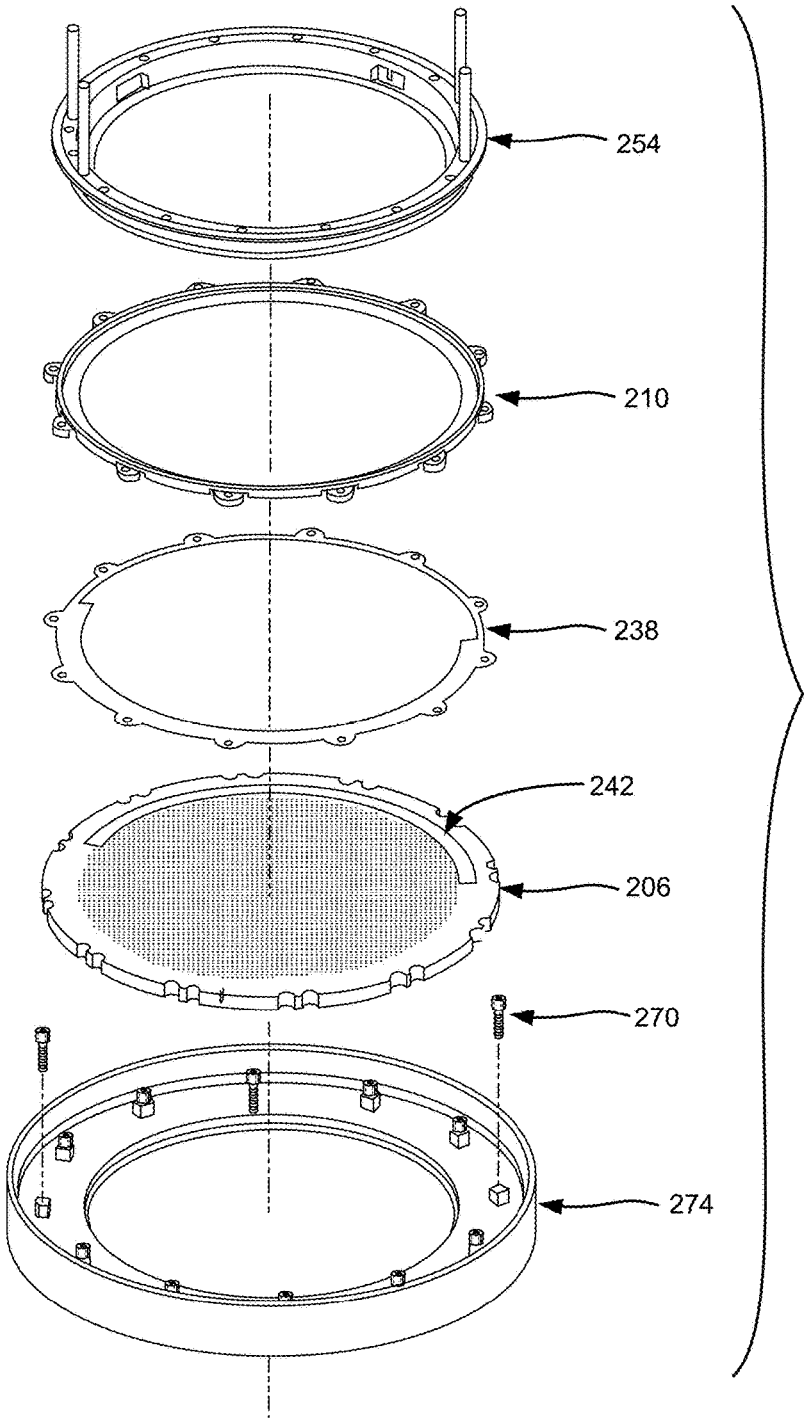
FIG. 2 illustrates an exploded view of various parts of an electroplating apparatus typically present in the cathode chamber in accordance with certain embodiments disclosed herein.

Turning to FIG. 2, the membrane frame 274 is a rigid structural member for holding a membrane 202 that is typically an ion exchange membrane responsible for separating an anode chamber from a cathode chamber. As explained, the anode chamber may contain electrolyte of a first composition while the cathode chamber contains electrolyte of a second composition. The membrane frame 274 may also include a plurality of fluidic adjustment rods 270 (sometimes referred to as flow constricting elements) which may be used to help control fluid delivery to the channeled ionically resistive element 206. The membrane frame 274 defines the bottom-most portion of the cathode chamber and the uppermost portion of the anode chamber. The described components are all located on the work piece side of an electrochemical plating cell above the anode chamber and the anode chamber membrane 202. They can all be viewed as being part of a cathode chamber. It should be understood, however, that certain implementations of a cross flow injection apparatus do not employ a separated anode chamber, and hence a membrane frame 274 is not essential.

Located generally between the work piece and the membrane frame 274 is the channeled ionically resistive plate 206, as well as a cross flow ring gasket 238 and wafer cross flow confinement ring 210, which may each be affixed to the channeled ionically resistive plate 206. More specifically, the cross flow ring gasket 238 may be positioned directly atop the CIRP 206, and the wafer cross flow confinement ring 210 may be positioned over the cross flow ring gasket 238 and affixed to a top surface of the channeled ionically resistive plate 206, effectively sandwiching the gasket 238. Various figures herein show the cross flow confinement ring 210 arranged with respect to the channeled ionically resistive plate 206.

Figure 8A:
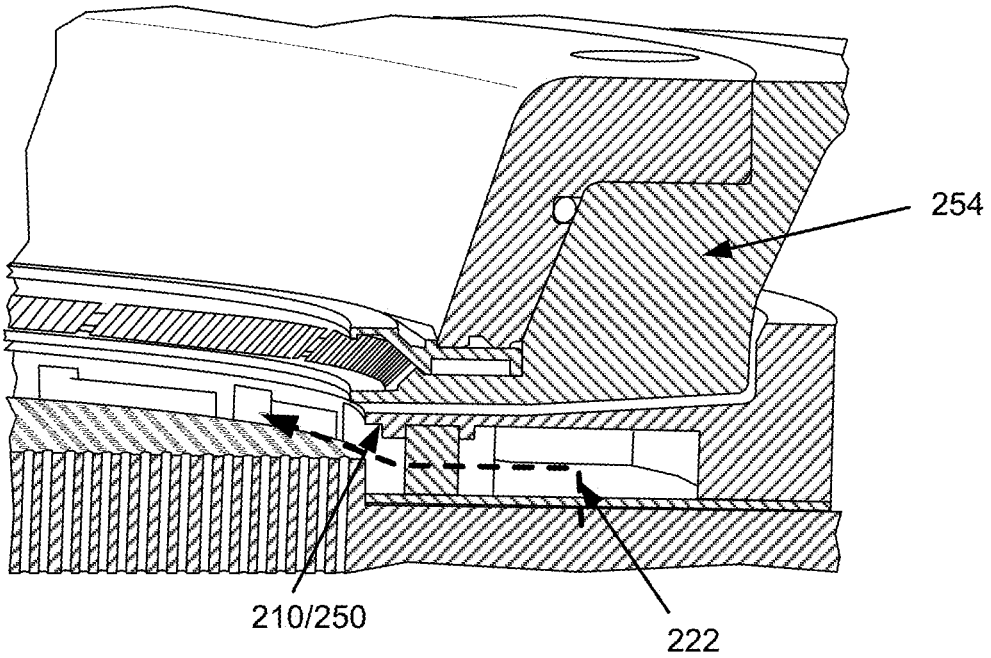
FIGS. 8A-8B depict an initial (8A) and revised (8B) design of a cross flow inlet region according to certain embodiments.
Figure 8B:
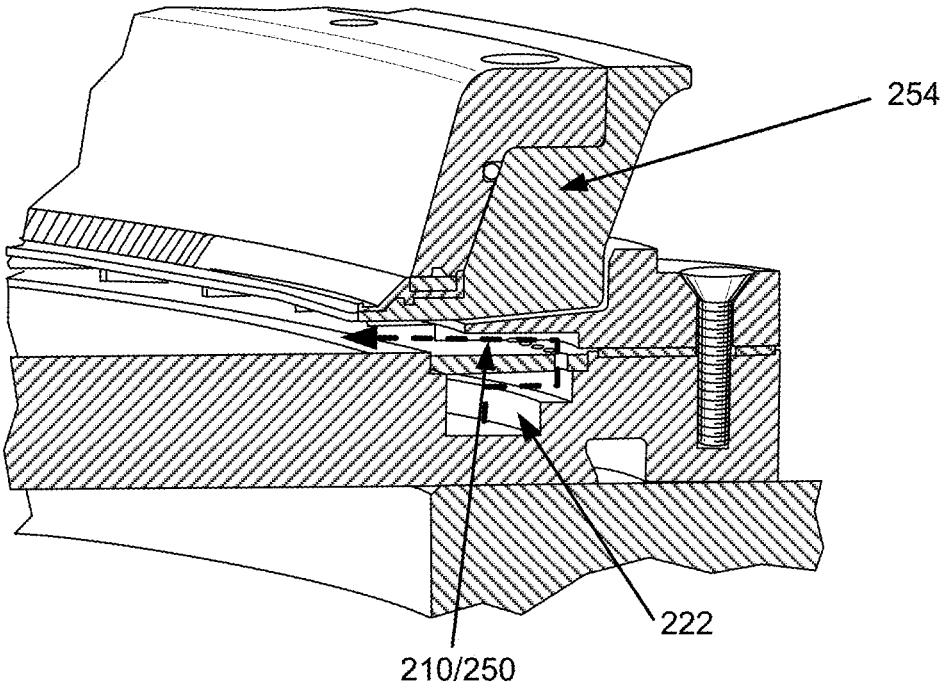

The upper most relevant structural feature of the present disclosure, as shown in FIG. 2, is a work piece or wafer holder. In certain embodiments, the work piece holder may be a cup 254, which is commonly used in cone and cup clamshell type designs such as the design embodied in Novellus Systems' Sabre® electroplating tool mentioned above. FIGS. 2 and 8A-8B, for example, show the relative orientation of the cup 254 with respect to other elements of the apparatus. In many embodiments herein, a distance between the cup 254 and the CIRP 206 may be dynamically controlled during electroplating, as discussed further below.

In various embodiments, an edge flow element (not shown in FIG. 2) may be provided. The edge flow element may be provided at a location that is generally above and/or within a channeled ionically resistive plate 206, and under the cup 254. The edge flow element is further described below.

Figure 3A:
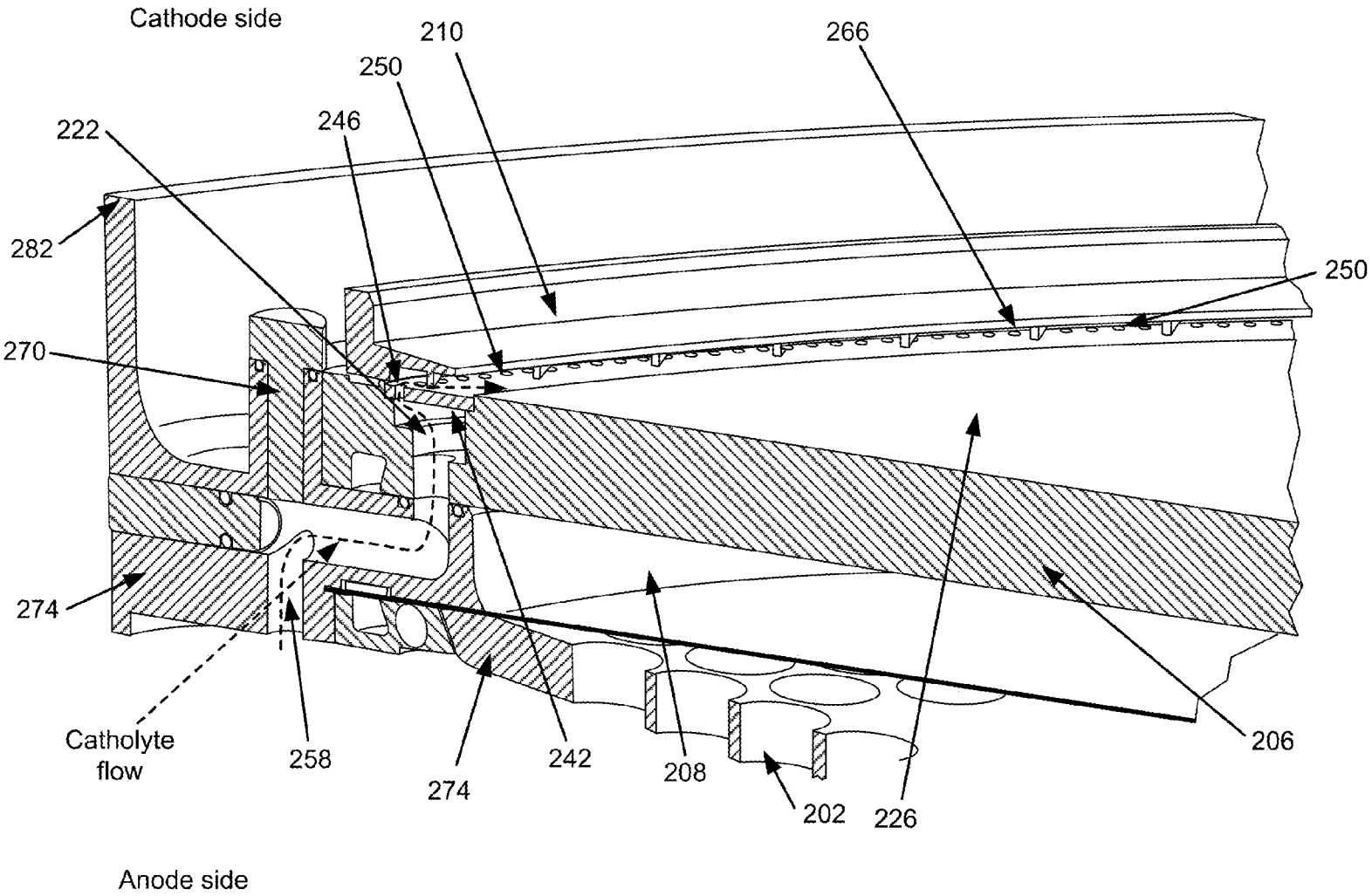
FIG. 3A shows a close-up view of a cross flow side inlet and surrounding hardware in accordance with certain embodiments herein.
Figure 3B:
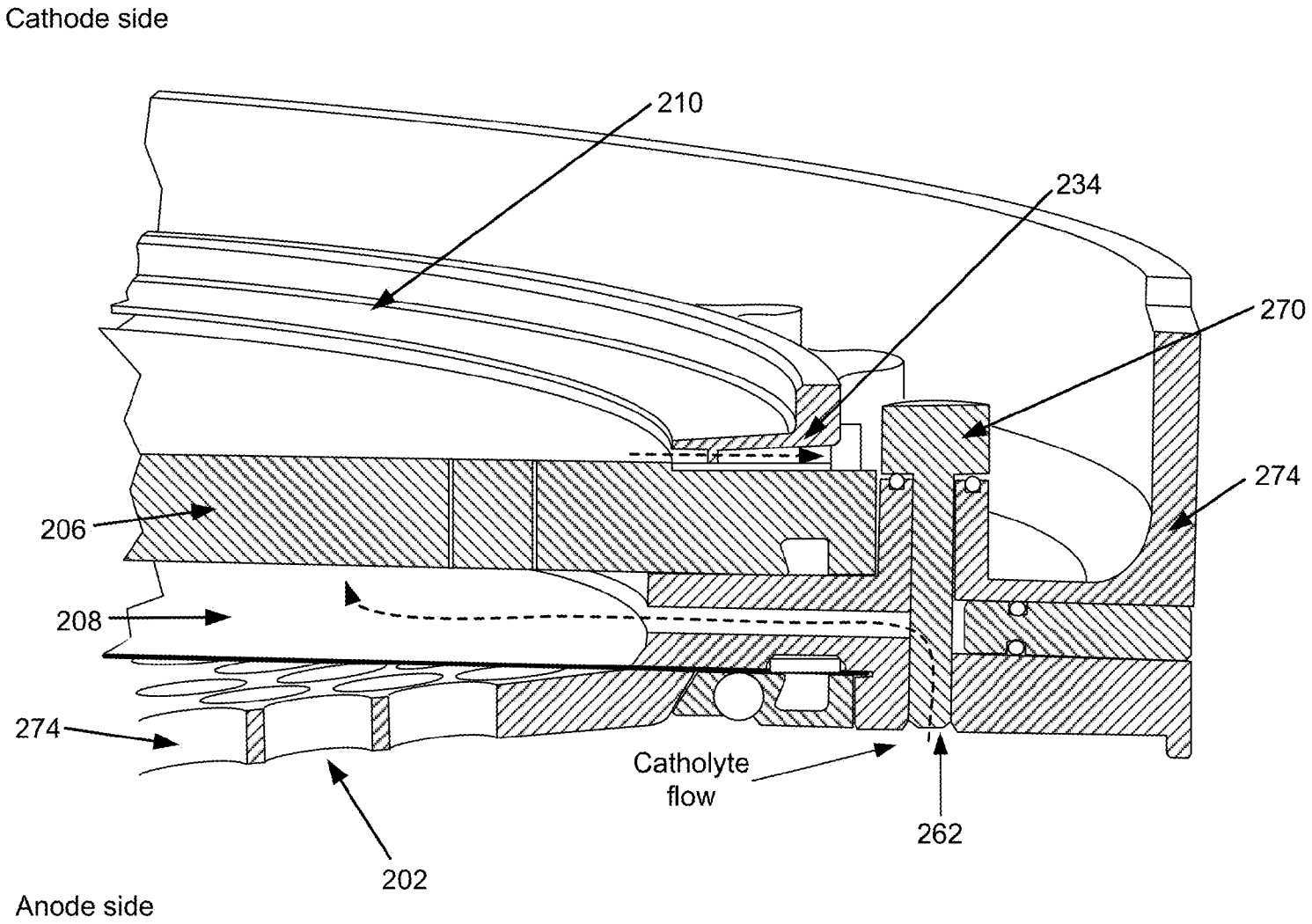
FIG. 3B shows a close-up view of a cross flow outlet, a CIRP manifold inlet, and surrounding hardware in accordance with various disclosed embodiments.
Figure 4:
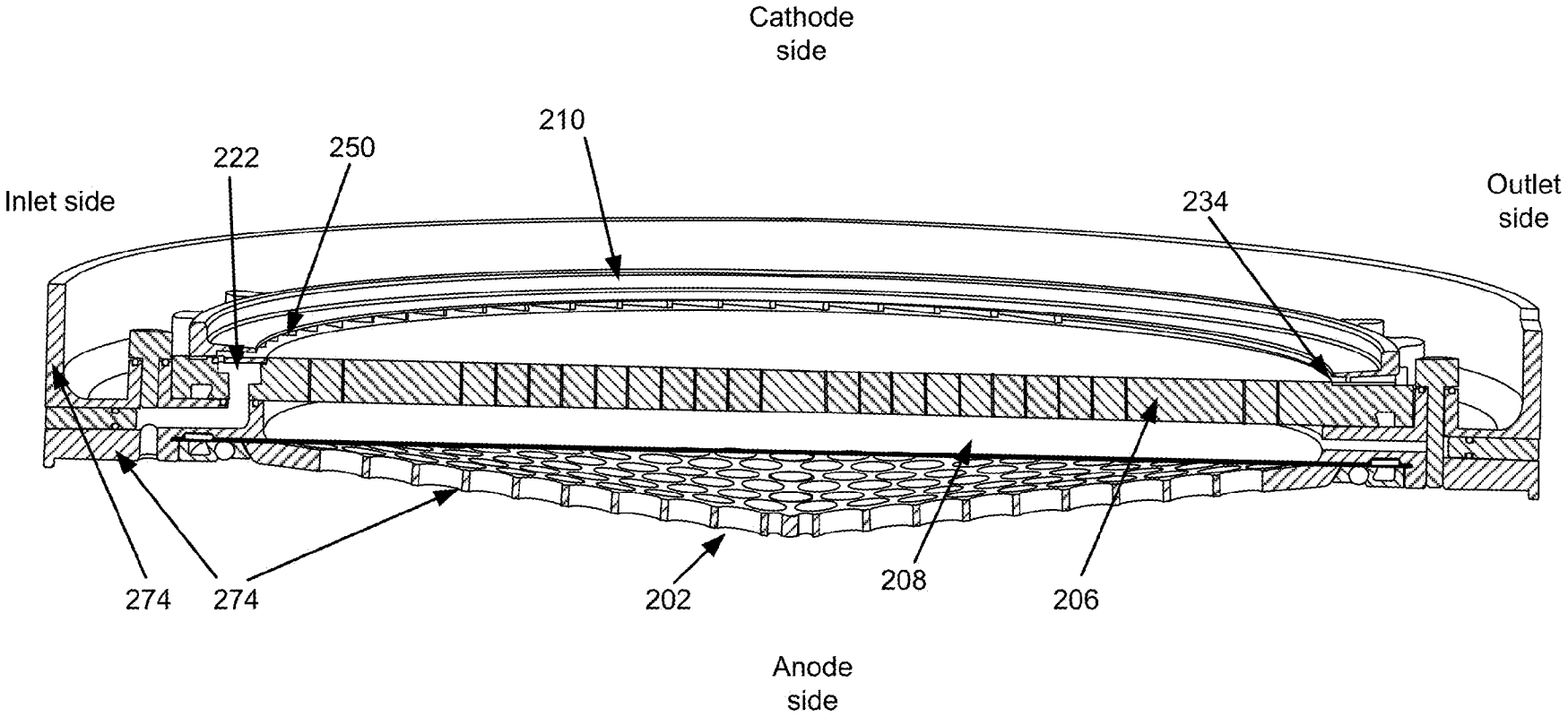
FIG. 4 depicts a cross-sectional view of various parts of the electroplating apparatus shown in FIGS. 3A-3B.

FIG. 3A shows a close-up cross sectional view of a cross flow inlet side according to an embodiment disclosed herein. FIG. 3B shows a close-up cross sectional view of the cross flow outlet side according to an embodiment herein. FIG. 4 shows a cross-sectional view of a plating apparatus showing both the inlet and outlet sides, in accordance with certain embodiments herein. During a plating process, catholyte fills and occupies the region between the top of the membrane 202 on the membrane frame 274 and the membrane frame weir wall 282. This catholyte region can be subdivided into three sub-regions: 1) a channeled ionically resistive plate manifold region 208 below the CIRP 206 and (for designs employing an anode chamber cationic membrane) above the separated-anode-chambers cationic-membrane 202 (this element is also sometimes referred to as a lower manifold region 208), 2) the cross flow manifold region 226, between the wafer and the upper surface of the CIRP 206, and 3) an upper cell region or "electrolyte containment region", outside of the clamshell/cup 254 and inside the cell weir wall 282 (which is a physical part of the membrane frame 274). When the wafer is not immersed and the clamshell/cup 254 is not in the down position, the second region and third region are combined into one region.

Region (2) above, between the top of the channeled ionically resistive plate 206 and the bottom of the workpiece when installed in the workpiece holder 254 contains catholyte and is referred to as the "cross flow manifold" 226. In some embodiments, catholyte enters the cathode chamber via a single inlet port. In other embodiments, catholyte enters the cathode chamber through one or more ports located elsewhere in the plating cell. In some cases, there is a single inlet for the bath of the cell, peripheral to the anode chamber and cut out of the anode chamber cell walls. This inlet connects to a central catholyte inlet manifold at the base of the cell and anode chamber. In certain disclosed embodiments, that main catholyte manifold chamber feeds a plurality of catholyte chamber inlet holes (e.g., 12 catholyte chamber inlet holes). In various cases, these catholyte chamber inlet holes are divided into two groups: one group which feeds catholyte to a cross flow injection manifold 222, and a second group which feeds catholyte to the CIRP manifold 208. FIG. 3B shows a cross section of a single inlet hole feeding the CIRP manifold 208 through channel 262. The dotted line indicates the path of fluid flow.

The separation of catholyte into two different flow paths or streams occurs at the base of the cell in the central catholyte inlet manifold (not shown). That manifold is fed by a single pipe connected to the base of the cell. From the main catholyte manifold, the flow of catholyte separates into two streams: 6 of the 12 feeder holes, located on one side of the cell, lead to source the CIRP manifold region 208 and eventually supply the impinging catholyte flow through the CIRP's various microchannels. The other 6 holes also feed from the central catholyte inlet manifold, but then lead to the cross flow injection manifold 222, which then feeds the cross flow shower head's 242 distribution holes 246 (which may number more than 100). After leaving the cross flow shower head holes 246, the catholyte's flow direction changes from (a) normal to the wafer to (b) parallel to the wafer. This change in flow occurs as the flow impinges upon and is confined by a surface in inlet cavity 250 of the cross flow confinement ring 210. Finally, upon entering the cross flow manifold region 226, the two catholyte flows, initially separated at the base of the cell in the central catholyte inlet manifold, are rejoined.

In the embodiments shown in the figures, a fraction of the catholyte entering the cathode chamber is provided directly to the channeled ionically resistive plate manifold 208 and a portion is provided directly to the cross flow injection manifold 222. At least some, and often but not always all of the catholyte delivered to the channeled ionically resistive plate manifold 208 and then to the CIRP lower surface passes through the various microchannels in the plate 206 and reaches the cross flow manifold 226. The catholyte entering the cross flow manifold 226 through the channels in the channeled ionically resistive plate 206 enters the cross flow manifold as substantially vertically directed jets (in some embodiments the channels are made at an angle, so they are not perfectly normal to the surface of the wafer, e.g., the angle of the jet may be up to about 45 degrees with respect to the wafer surface normal). The portion of the catholyte that enters the cross flow injection manifold 222 is delivered directly to the cross flow manifold 226 where it enters as a horizontally oriented cross flow below the wafer. On its way to the cross flow manifold 226, the cross flowing catholyte passes through the cross flow injection manifold 222 and the cross flow shower head plate 242 (which, e.g., contains about 139 distributed holes 246 having a diameter of about 0.048"), and is then redirected from a vertically upwards flow to a flow parallel to the wafer surface by the actions/geometry of the cross flow-confinement-ring's 210 entrance cavity 250.

The absolute angles of the cross flow and the jets need not be exactly horizontal or exactly vertical or even oriented at exactly 90° with one another. In general, however, the cross flow of catholyte in the cross flow manifold 226 is generally along the direction of the work piece surface and the direction of the jets of catholyte emanating from the top surface of the microchanneled ionically resistive plate 206 generally flow towards/perpendicular to the surface of the work piece.

As mentioned, the catholyte entering the cathode chamber is divided between (i) catholyte that flows from the channeled ionically resistive plate manifold 208, through the channels in the CIRP 206 and then into the cross flow manifold 226 and (ii) catholyte that flows into the cross flow injection manifold 222, through the holes 246 in the showerhead 242, and then into the cross flow manifold 226. The flow directly entering from the cross flow injection manifold region 222 may enter via the cross flow confinement ring entrance ports, sometimes referred to as cross flow side inlets 250, and emanate parallel to the wafer and from one side of the cell. In contrast, the jets of fluid entering the cross flow manifold region 226 via the microchannels of the CIRP 206 enter from below the wafer and below the cross flow manifold 226, and the jetting fluid is diverted (redirected) within the cross flow manifold 226 to flow parallel to the wafer and towards the cross flow confinement ring exit port 234, sometimes also referred to as the cross flow outlet or outlet.

In some embodiments, the fluid entering the cathode chamber is directed into multiple channels 258 and 262 distributed around the periphery of the cathode chamber portion of the electroplating cell chamber (often a peripheral wall). In a specific embodiment, there are 12 such channels contained in the wall of the cathode chamber.

The channels in the cathode chamber walls may connect to corresponding "cross flow feed channels" in the membrane frame. Some of these feed channels 262 deliver catholyte directly to the channeled ionically resistive plate manifold 208. As mentioned, the catholyte provided to this manifold subsequently passes through the small vertically oriented channels of the channeled ionically resistive plate 206 and enters the cross flow manifold 226 as jets of catholyte.

As mentioned, in an embodiment depicted in the figures, catholyte feeds the "CIRP manifold chamber" 208 through 6 of the 12 catholyte feeder lines/tubes. Those 6 main tubes or lines 262 feeding the CIRP manifold 208 reside below the cross flow confinement ring's exit cavity 234 (where the fluid passes out of the cross flow manifold region 226 below the wafer), and opposite all the cross flow manifold components (cross flow injection manifold 222, showerhead 242, and confinement ring entrance cavity 250).

As depicted in various figures, some cross flow feed channels 258 in the membrane frame lead directly to the cross flow injection manifold 222 (e.g., 6 of 12). These cross flow feed channels 258 start at the base of the anode chamber of the cell and then pass through matching channels of the membrane frame 274 and then connect with corresponding cross flow feed channels 258 on the lower portion of the channeled ionically resistive plate 206. See FIG. 3A, for example.

In a specific embodiment, there are six separate feed channels 258 for delivering catholyte directly to the cross flow injection manifold 222 and then to the cross flow manifold 226. In order to effect cross flow in the cross flow manifold 226, these channels 258 exit into the cross flow manifold 226 in an azimuthally non-uniform manner. Specifically, they enter the cross flow manifold 226 at a particular side or azimuthal region of the cross flow manifold 226. In a specific embodiment depicted in FIG. 3A, the fluid paths 258 for directly delivering catholyte to the cross flow injection manifold 222 pass through four separate elements before reaching the cross flow injection manifold 222: (1) dedicated channels in the cell's anode chamber wall, (2) dedicated channels in the membrane frame 274, (3) dedicated channels the channeled ionically resistive element 206 (i.e., not the 1-D channels used for delivering catholyte from the CIRP manifold 208 to the cross flow manifold 226), and finally, (4) fluid paths in the wafer cross flow confinement ring 210.

As mentioned, the portions of the flow paths passing through the membrane frame 274 and feeding the cross flow injection manifold 222 are referred to as cross flow feed channels 258 in the membrane frame. The portions of the flow paths passing through the microchanneled ionically resistive plate 206 and feeding the CIRP manifold are referred to as cross flow feed channels 262 feeding the channeled ionically resistive plate manifold 208, or CIRP manifold feed channels 262. In other words, the term "cross flow feed channel" includes both the catholyte feed channels 258 feeding the cross flow injection manifold 222 and the catholyte feed channels 262 feeding the CIRP manifold 208. One difference between these flows 258 and 262 was noted above: the direction of the flow through the CIRP 206 is initially directed at the wafer and is then turned parallel to the wafer due to the presence of the wafer and the cross flow confinement ring 210, whereas the cross flow portion coming from the cross flow injection manifold 222 and out through the cross flow confinement ring entrance ports 250 starts substantially parallel to the wafer. While not wishing to be held to any particular model or theory, this combination and mixing of impinging and parallel flow is believed to facilitate substantially improved flow penetration within a recessed/embedded feature and thereby improve the mass transfer. By creating a spatially uniform convective flow field under the wafer and rotating the wafer, each feature, and each die, exhibits a nearly identical flow pattern over the course of the rotation and the plating process.

The flow path within the channeled ionically resistive plate 206 that does not pass through the plate's microchannels (instead entering the cross flow manifold 226 as flow parallel to the face of the wafer) begins in a vertically upward direction as it passes through the cross flow feed channel 258 in the plate 206, and then enters a cross flow injection manifold 222 formed within the body of the channeled ionically resistive plate 206. The cross flow injection manifold 222 is an azimuthal cavity which may be a dug out channel within the plate 206 that can distribute the fluid from the various individual feed channels 258 (e.g., from each of the individual 6 cross flow feed channels) to the various multiple flow distribution holes 246 of the cross flow shower head plate 242. This cross flow injection manifold 222 is located along an angular section of the peripheral or edge region of the channeled ionically resistive plate 206. See for example FIGS. 3A and 4-6. In certain embodiments, the cross flow injection manifold 222 forms a C-shaped structure over an angle of about 90 to 180° of the plate's perimeter region. In certain embodiments, the angular extent of the cross flow injection manifold 222 is about 120 to about 170°, and in a more specific embodiment is between about 140 and 150°. In these or other embodiments, the angular extent of the cross flow injection manifold 222 is at least about 90°. In many implementations, the showerhead 242 spans approximately the same angular extent as the cross flow injection manifold 222. Further, the overall inlet structure 250 (which in many cases includes one or more of the cross flow injection manifold 222, the showerhead 242, the showerhead holes 246, and an opening in the cross flow confinement ring) may span these same angular extents.

Figure 5:
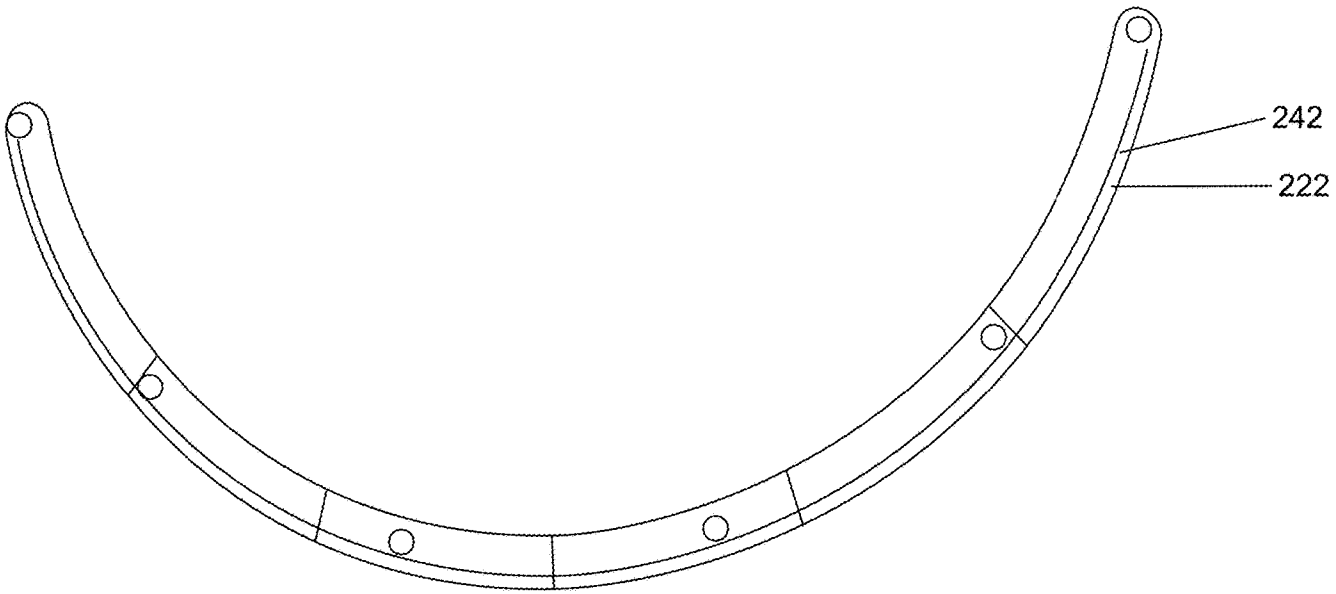
FIG. 5 shows a cross flow injection manifold and showerhead split into 6 individual segments according to certain embodiments.

In some embodiments, the cross flow in the injection manifold 222 forms a continuous fluidically coupled cavity within the channeled ionically resistive plate 206. In this case all of the cross flow feed channels 258 feeding the cross flow injection manifold (e.g., all 6) exit into one continuous and connected cross flow injection manifold chamber. In other embodiments, the cross flow injection manifold 222 and/or the cross flow showerhead 242 are divided into two or more angularly distinct and completely or partially separated segments, as shown in FIG. 5 (which shows 6 separated segments). In some embodiments, the number of angularly separated segments is between about 1-12, or between about 4-6. In a specific embodiment, each of these angularly distinct segments is fluidically coupled to a separate cross flow feed channel 258 disposed in the channeled ionically resistive plate 206. Thus, for example, there may be six angularly distinct and separated subregions within the cross flow injection manifold 222. In certain embodiments, each of these distinct subregions of the cross flow injection manifold 222 has the same volume and/or the same angular extent.

Figure 6:
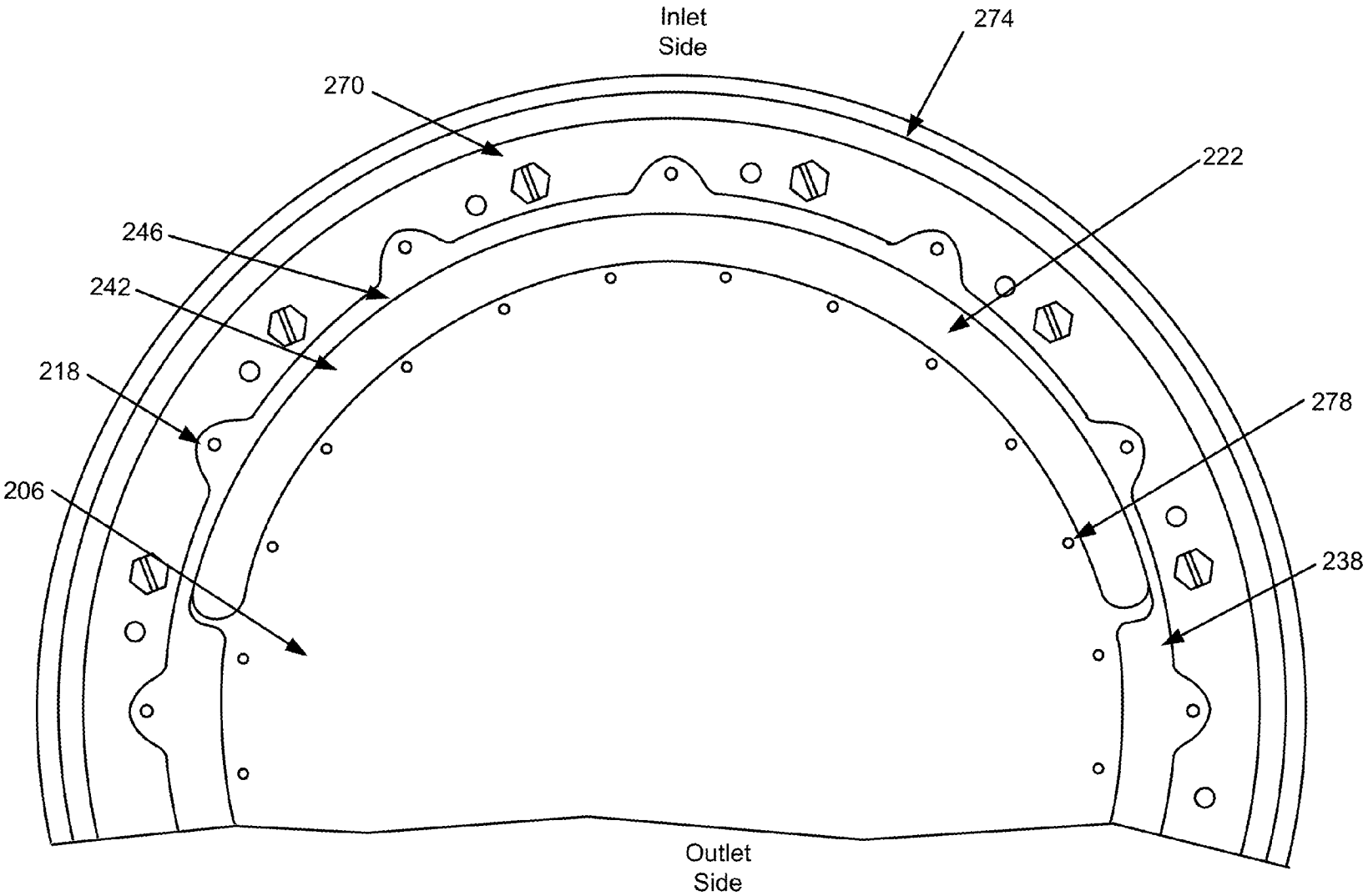
FIG. 6 shows a top view of a CIRP and associated hardware according to an embodiment herein, focusing especially on the inlet side of the cross flow.

In many cases, catholyte exits the cross flow injection manifold 222 and passes through a cross flow showerhead plate 242 having many angularly separated catholyte outlet ports (holes) 246. See for example FIGS. 2, 3A-3B and 6. In certain embodiments, the cross flow showerhead plate 242 is integrated into the channeled ionically resistive plate 206, as shown in FIG. 6 for example. In some embodiments the showerhead plate 242 is glued, bolted, or otherwise affixed to the top of the cross flow injection manifold 222 of the channeled ionically resistive plate 206. In certain embodiments, the top surface of the cross flow showerhead 242 is flush with or slightly elevated above a plane or top surface of the channeled ionically resistive plate 206. In this manner, catholyte flowing through the cross flow injection manifold 222 may initially travel vertically upward through the showerhead holes 246 and then laterally under the cross flow confinement ring 210 and into the cross flow manifold 226 such that the catholyte enters the cross flow manifold 226 in a direction that is substantially parallel with the top face of the channeled ionically resistive plate. In other embodiments, the showerhead 242 may be oriented such that catholyte exiting the showerhead holes 246 is already traveling in a wafer-parallel direction.

In a specific embodiment, the cross flow showerhead 242 has 139 angularly separated catholyte outlet holes 246. More generally, any number of holes that reasonably establish uniform cross flow within the cross flow manifold 226 may be employed. In certain embodiments, there are between about 50 and about 300 such catholyte outlet holes 246 in the cross flow showerhead 242. In certain embodiments, there are between about 100 and 200 such holes. In certain embodiments, there are between about 120 and 160 such holes. Generally, the size of the individual ports or holes 246 can range from about 0.020" to 0.10", more specifically from about 0.03" to 0.06" in diameter.

In certain embodiments, these holes 246 are disposed along the entire angular extent of the cross flow showerhead 242 in an angularly uniform manner (e.g., the spacing between the holes 246 is determined by a fixed angle between the cell center and two adjacent holes). See for example FIGS. 3A and 7. In other embodiments, the holes 246 are distributed along the angular extent in an angularly non-uniform manner. In further embodiments, the angularly non-uniform hole distribution is nevertheless a linearly ("x" direction") uniform distribution. Put another way, in this latter case, the hole distribution is such that the holes are spaced equally far apart if projected onto an axis perpendicular to the direction of cross flow (this axis is the "x" direction). Each hole 246 is positioned at the same radial distance from the cell center, and is spaced the same distance in the "x" direction from adjacent holes. The net effect of having these angularly non-uniform holes 246 is that the overall cross flow pattern is much more uniform.

In certain embodiments, the direction of the catholyte exiting the cross flow showerhead 242 is further controlled by a wafer cross flow confinement ring 210. In certain embodiments, this ring 210 extends over the full circumference of the channeled ionically resistive plate 206. In certain embodiments, a cross section of the cross flow confinement ring 210 has an L-shape, as shown in FIGS. 3A and 4. In certain embodiments, the wafer cross flow confinement ring 210 contains a series of flow directing elements such as directional fins 266 in fluidic communication with the outlet holes 246 of the cross flow showerhead 242. More specifically, the directional fins 266 define largely segregated fluid passages under an upper surface of the wafer cross flow confinement ring 210 and between adjacent directional fins 266. In some cases, the purpose of the fins 266 is to redirect and confine flow exiting from the cross flow showerhead holes 246 from an otherwise radially inward direction to a "left to right" flow trajectory (left being the inlet side 250 of the cross flow, right being the outlet side 234). This helps to establish a substantially linear cross flow pattern. The catholyte exiting the holes 246 of the cross flow showerhead 242 is directed by the directional fins 266 along a flow streamline caused by the orientation of the directional fins 266. In certain embodiments, all the directional fins 266 of the wafer cross flow confinement ring 210 are parallel to one another. This parallel arrangement helps to establish a uniform cross flow direction within the cross flow manifold 226. In various embodiments, the directional fins 266 of the wafer cross flow confinement ring 210 are disposed both along the inlet 250 and outlet 234 side of the cross flow manifold 226. This is illustrated in the top view of FIG. 7, for example.

As indicated, catholyte flowing in the cross flow manifold 226 generally passes from an inlet region 250 of the wafer cross flow confinement ring 210 to an outlet side 234 of the ring 210, as shown in FIGS. 3B and 4. A certain amount of catholyte may also leak out around the entire periphery of the substrate. This leakage may be minimal in comparison to the amount of catholyte leaving the cross flow manifold at the outlet side 234. At the outlet side 234, in certain embodiments, there are multiple directional fins 266 that may be parallel to and may align with the directional fins 266 on the inlet side. The cross flow passes through channels created by the directional fins 266 on the outlet side 234 and then ultimately and directly out of the cross flow manifold 226. The flow then passes into another region of the cathode chamber generally radially outwards and beyond the wafer holder 254 and cross flow confinement ring 210, with fluid collected and temporarily retained by the upper weir wall 282 of the membrane frame before flowing over the weir 282 for collection and recirculation. It should therefore be understood that the figures (e.g., FIGS. 3A, 3B and 4) show only a partial path of the entire circuit of catholyte entering and exiting the cross flow manifold. Note that, in the embodiment depicted in FIGS. 3B and 4, for example, fluid exiting from the cross flow manifold 226 does not pass through small holes or back through channels analogous to the feed channels 258 on the inlet side, but rather passes outward in a generally parallel-to-the wafer direction as it is accumulated in the aforementioned accumulation region.

FIG. 6 shows a top view of the cross flow manifold 226 depicting an embedded cross flow injection manifold 222 within the channeled ionically resistive plate 206, along with the showerhead 242 and 139 outlet holes 246. All six fluidic adjustment rods 270 for the cross flow injection manifold flow are also shown. The cross flow confinement ring 210 is not installed in this depiction, but the outline of the cross flow confinement ring sealing gasket 238, which seals between the cross flow confinement ring 210 and the upper surface of the CIRP 206, is shown. Other elements which are shown in FIG. 6 include the cross flow confinement ring fasteners 218, membrane frame 274, and screw holes 278 on the anode side of the CIRP 206 (which may be used for a cathodic shielding insert, for example).

In some embodiments, the geometry of the cross flow confinement ring outlet 234 may be tuned in order to further optimize the cross flow pattern. For example, a case in which the cross flow pattern diverges to the edge of the confinement ring 210 may be corrected by reducing the open area in the outer regions of the cross flow confinement ring outlet 234. In certain embodiments, the outlet manifold 234 may include separated sections or ports, much like the cross flow injection manifold 222. In some embodiments, the number of outlet sections is between about 1-12, or between about 4-6. The ports are azimuthally separated, occupying different (usually adjacent) positions along the outlet manifold 234. The relative flow rates through each of the ports may be independently controlled in some cases. This control may be achieved, for example, by using control rods 270 similar to the control rods described in relation to the inlet flow. In another embodiment, the flow through the different sections of the outlet can be controlled by the geometry of the outlet manifold. For example, an outlet manifold that has less open area near each side edge and more open area near the center would result in a solution flow pattern where more flow exits near the center of the outlet and less flow exits near the edges of the outlet. Other methods of controlling the relative flow rates through the ports in the outlet manifold 234 may be used as well (e.g., pumps, etc.).

As mentioned, bulk catholyte entering the catholyte chamber is directed separately into the cross flow injection manifold 222 and the channeled ionically resistive plate manifold 208 through multiple channels 258 and 262, e.g., 12 separate channels. In certain embodiments, the flows through these individual channels 258 and 262 are independently controlled from one another by an appropriate mechanism. In some embodiments, this mechanism involves separate pumps for delivering fluid into the individual channels. In other embodiments, a single pump is used to feed a main catholyte manifold, and various flow restriction elements that are adjustable may be provided in one or more of the channels feeding the flow path provided so as to modulate the relative flows between the various channels 258 and 262 and between the cross flow injection manifold 222 and CIRP manifold 208 regions and/or along the angular periphery of the cell. In various embodiments depicted in the figures, one or more fluidic adjustment rods 270 (sometimes also referred to as flow control elements) are deployed in the channels where independent control is provided. In the depicted embodiments, the fluidic adjustment rod 270 provides an annular space in which catholyte is constricted during its flow toward the cross flow injection manifold 222 or the channeled ionically resistive plate manifold 208. In a fully retracted state, the fluidic adjustment rod 270 provides essentially no resistance to flow. In a fully engaged state, the fluidic adjustment rod 270 provides maximal resistance to flow, and in some implementations stops all flow through the channel. In intermediate states or positions, the rod 270 allows intermediate levels of constriction of the flow as fluid flows through a restricted annular space between the channel's inner diameter and the fluid adjustment rod's outer diameter.

In some embodiments, the adjustment of the fluidic adjustment rods 270 allows the operator or controller of the electroplating cell to favor flow to either the cross flow injection manifold 222 or to the channeled ionically resistive plate manifold 208. In certain embodiments, independent adjustment of the fluidics adjustment rods 270 in the channels 258 that deliver catholyte directly to the cross flow injection manifold 222 allows the operator or controller to control the azimuthal component of fluid flow into the cross flow manifold 226.

FIGS. 8A-8B show cross sectional views of a cross flow injection manifold 222 and corresponding cross flow inlet 250 relative to a plating cup 254. The position of the cross flow inlet 250 is defined, at least in part, by the position of the cross flow confinement ring 210. Specifically, the inlet 250 may be considered to begin where the cross flow confinement ring 210 terminates. Note that in the case of an initial design, seen in FIG. 8A, the confinement ring 210 termination point (and inlet 250 commencement point) was under the edge of the wafer, whereas in a revised design, seen in FIG. 8B, the termination/commencement point is under the plating cup and further radially outward from the wafer edge, as compared to the initial design. Also, the cross flow injection manifold 222 in the earlier design had a step in the cross flow ring cavity (where the generally leftward arrow begins rising upwards) which potentially formed some unwanted turbulence near that point of fluid entry into the cross flow manifold region 226. In some cases, an edge flow element (not shown) may be present proximate the periphery of the substrate and/or the periphery of the channeled ionically resistive plate. The edge flow element may be present proximate the inlet 250 and/or proximate the outlet (not shown in FIGS. 8A and 8B). The edge flow element may be used to direct electrolyte into a corner that forms between the plating face of the substrate and the edge of the cup 254, thereby counteracting an otherwise relatively low cross flow in this region.

In some embodiments, the apparatus includes hardware for accomplishing the process operations and a system controller having instructions for controlling process operations in accordance with the disclosed implementations. The system controller will typically include one or more memory devices and one or more processors configured to execute the instructions so that the apparatus will perform a method in accordance with the disclosed implementations. Machine-readable media containing instructions for controlling process operations in accordance with the disclosed implementations may be coupled to the system controller. Specifically in some embodiments the controller will specify the dwell time, the vertical movement distance of the substrate holder, the maximum vertical acceleration and deceleration of the substrate holder, the rotational speed of the substrate holder, the rotation step angle, the maximum acceleration and deceleration of the substrate holder, in any combination. In some embodiments the user provides the desired dwell time and maximum rotation acceleration to the controller, and the controller is programmed to execute the entire method sequence based on these values and values of other parameters stored in the memory.

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of plating fluid, power supply settings, wafer rotation settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g., a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

Dynamic Modulation of Cross Flow Manifold Height

While certain electroplating apparatus have been designed to include a cross flow manifold between a substrate and CIRP, such apparatus have not previously been implemented to practice dynamic modulation of the cross flow manifold during an electroplating process. When the height of the cross flow manifold is modulated, the cross flow manifold essentially acts as a pump to effect fluid flow into and out of this region.

In various embodiments, the height of the cross flow manifold may be modulated during electroplating. Such modulation may have a significant impact on the hydrodynamic conditions within the cross flow manifold. For instance, increasing the height of the cross flow manifold increases the volume of the cross flow manifold and can result in a (generally) radially inward catholyte flow across the substrate as electrolyte is suctioned into the cross flow manifold. The fluid that enters the cross flow manifold when this occurs may leak in from around the entire periphery of the substrate (i.e., fluid is not merely pulled from the cross flow inlet). By contrast, decreasing the height of the cross flow manifold decreases the volume of this region, and can result in a (generally) radially outward catholyte flow across the substrate. The fluid that exits the cross flow manifold when this occurs may exit via the cross flow outlet and/or it may leak out around the entire periphery of the substrate. By modulating the height of the cross flow manifold such that the height cyclically increases and decreases, the catholyte can be directed to flow radially inwards and outwards in a way that results in greater convection within features, and improved uniformity of features, especially proximate the edge of the substrate.

The radial cross flow velocity is proportional to the z-axis velocity (the velocity at which the height of the cross flow manifold changes), meaning that higher z-axis velocity creates a higher radial velocity effect. Further, the radial cross flow velocity is proportional to the radial location on the substrate, meaning the modulation effects are strongest near the substrate periphery. This is particularly advantageous because the modulation is effective in combating edge effects due to, e.g., edge-thick photoresist. Such edge effects can be further mitigated by practicing the cross flow manifold height modulations in an electroplating apparatus equipped with an edge flow element, as described herein. The edge flow element can be used to direct electrolyte into areas where greater convection is desired, with a substantial degree of convection being promoted/provided as a result of the height modulation. These two features work together to provide especially high quality, uniform plating results.

Further, the radial cross flow velocity is inversely proportional to the height of the cross flow manifold. This means that the modulation technique is particularly suitable when the cross flow manifold has a small height. Similarly, this means that the modulation technique would be significantly less useful in cases where no cross flow manifold/CIRP is provided, or in cases where such a manifold is present but much taller.

Care should be taken to ensure that the substrate is sufficiently immersed in electrolyte such that when the height of the cross flow manifold is increasing (or at a maximum), bubbles are not suctioned under the plating face of the substrate. In certain implementations, the substrate may be immersed to a minimum depth between about 10-20 mm. The minimum immersion depth will often correspond to the maximum height of the cross flow manifold. The modulation is often over a distance between about 0.1-10 mm, for example between about 0.5-5 mm, or between about 1-3 mm. This modulation distance represents the difference between the maximum and minimum height of the cross flow manifold during electroplating. The modulation distance may be between about 20-80% of the maximum height of the cross flow manifold during electroplating, in some cases between about 40-60%. For instance, if the maximum height of the cross flow manifold during electroplating is 5 mm and the minimum height of the cross flow manifold during electroplating is 3 mm, the modulation distance is 2 mm (5 mm−3 mm=2 mm), which is 40% of the maximum height of the cross flow manifold during electroplating (100*2 mm/5 mm=40%).

In order to change the height of the cross flow manifold, several options are available. The cross flow manifold is defined between the substrate and the CIRP. Therefore, the height of the cross flow manifold can be varied by changing the position of the substrate, the CIRP, or both. In a number of embodiments, the position of the substrate is actively controlled while the CIRP remains in a stationary plane (optionally rotating within the plane). The position of the substrate may be controlled via the substrate holder, or some portion thereof. In some other embodiments, the position of the CIRP may be actively controlled while the substrate remains in a stationary plane (optionally rotating within the plane). The position of the CIRP may be controlled via one or more actuators or other mechanisms that allow the position of the CIRP to be controlled with respect to the substrate. In one example, the CIRP moves towards/away from the substrate without moving other portions of the electroplating apparatus such as the anode, catholyte/anolyte separation membrane, etc. In another example, the CIRP moves towards/away from the substrate by moving a substantial portion of the electroplating apparatus including, e.g., the anode, electroplating chamber, catholyte/anolyte separation membrane, etc.

In certain embodiments, the height of the cross flow manifold may be modulated only during an initial portion of the electroplating process, for example before the features are 50% filled, on average. The modulation may be most effective during this initial portion of electroplating, when the features to be filled are deepest. In various other embodiments, the height of the cross flow manifold may be modulated over a longer time period, in some cases during the entire electroplating process. In some cases, the modulation may begin after an initial substrate positioning/immersion process, which may involve tilting the substrate as described elsewhere herein. The modulations may have a frequency of between about 1-10 Hz, for example between about 3-8 Hz.

The modulation may be symmetric or asymmetric. With symmetric modulation, the rate at which the height of the cross flow manifold increases is the same as the rate at which the height of the cross flow manifold decreases. Further, the movement increasing the height of the cross flow manifold mirrors the movement decreasing the height of the cross flow manifold (e.g., the variation in the rates over the course of movement in each direction is the same). With asymmetric modulation, these rates and rate variations may differ. For example, in a number of embodiments, the height of the cross flow manifold may decrease faster than it increases. Assuming that the height of the cross flow manifold is controlled by raising/lowering the substrate, this means that the substrate may move downwards (decreasing the cross flow manifold height) faster than the substrate moves upwards (increasing the cross flow manifold height). Such a technique may help prevent bubbles from getting suctioned under the substrate, and may also help establish a desired flow pattern over the face of the substrate. In some other cases, the height of the cross flow manifold may increase faster than it decreases. Such asymmetries may be present throughout an initial portion of the modulation, a final portion of the modulation, or the entire modulation.

Figure 31A:
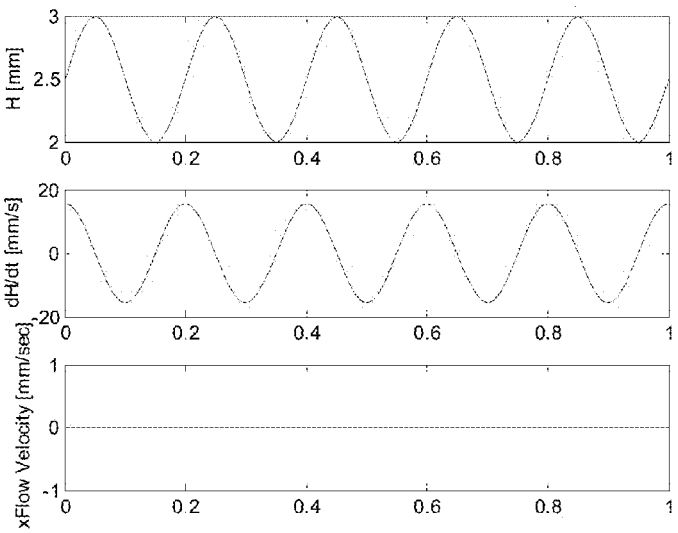
FIGS. 31A-31D relate to modeling results related to embodiments where the height of the cross flow manifold is modulated during electroplating.
Figure 31B:
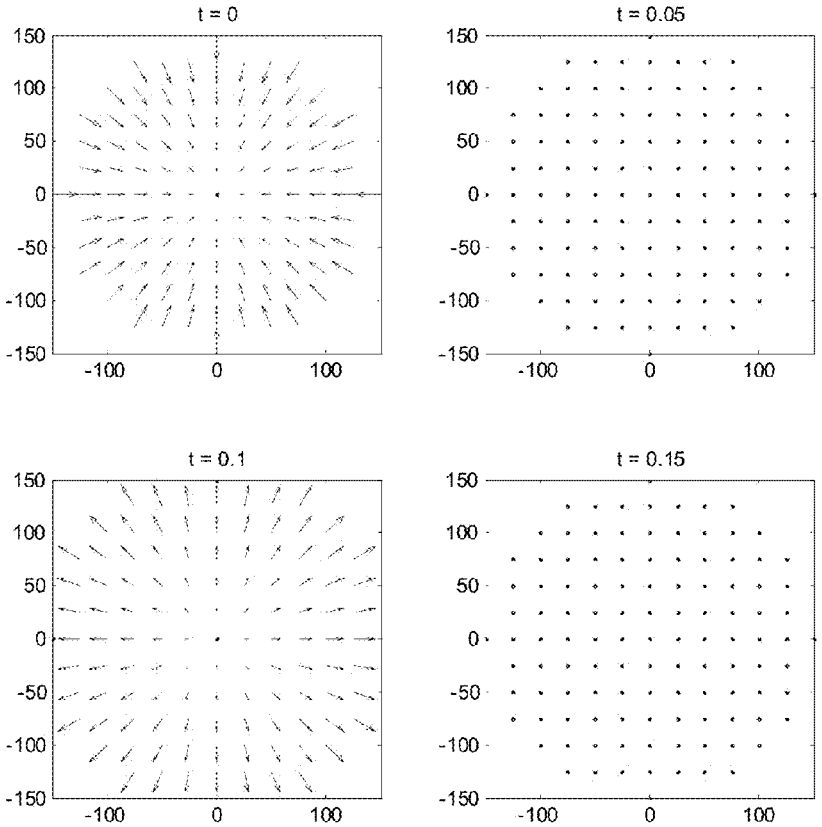

FIGS. 31A and 31B relate to a modeling simulation in which the height of the cross flow manifold is modulated between 2 mm and 3 mm. In other words, the distance between the plating face of the substrate and the substrate-facing surface of the CIRP is varied by 1 mm, with a minimum height of about 2 mm and a maximum height of about 3 mm. Edge effects are not included in the modeling results. The height of the cross flow manifold is cycled at a rate of 5 Hz, and is shown in the upper panel of FIG. 31A. The rate of change of the height of the cross flow manifold (dH/dT) is modeled in the middle panel of FIG. 31A. The average cross flow velocity across the substrate is shown in the bottom panel of FIG. 31A. In this simulation, no cross flow is separately provided in the cross flow manifold, and the average crossflow velocity is always zero. FIG. 31B illustrates a top down view of the modeled flow paths in the cross flow manifold at different points in time when the height of the cross flow manifold is modulated as described in FIG. 31A. At time t=0, the height of the cross flow manifold is increasing, and the result is a radially inward electrolyte flow as electrolyte is suctioned into the cross flow manifold. Next, at time t=0.05, the cross flow manifold reaches a maximum height of 3 mm, and dH/dt=0. At this point, the electrolyte is traveling neither inwards nor outwards on the substrate. At time t=0.1, the height of the cross flow manifold is decreasing, and the result is a radially outward electrolyte flow as electrolyte is pushed out of the cross flow manifold. At time t=0.15, the cross flow manifold reaches a minimum height of 2 mm, and dH/dt=0. Again, the electrolyte is traveling neither inwards nor outwards at this time. While the modeling results in FIGS. 31A and 31B are simplified (e.g., by excluding edge effects and assuming no separate cross flow is provided), these results illustrate the basic effects of increasing and decreasing the height of the cross flow manifold.

Figure 31C:
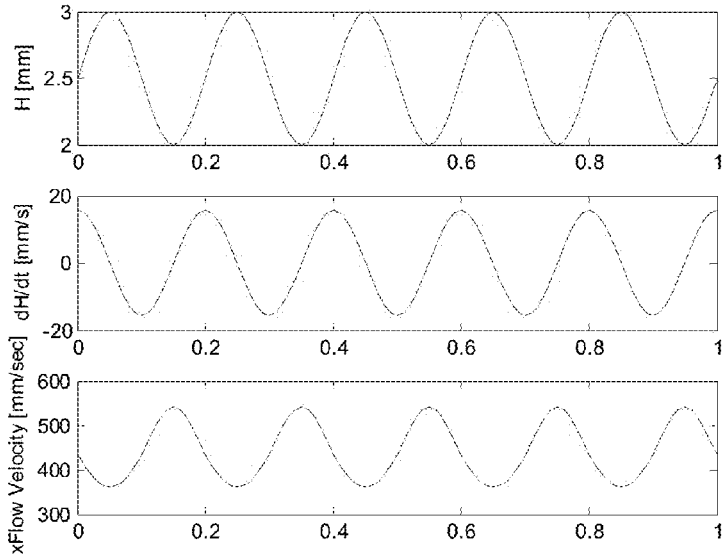
Figure 31D:
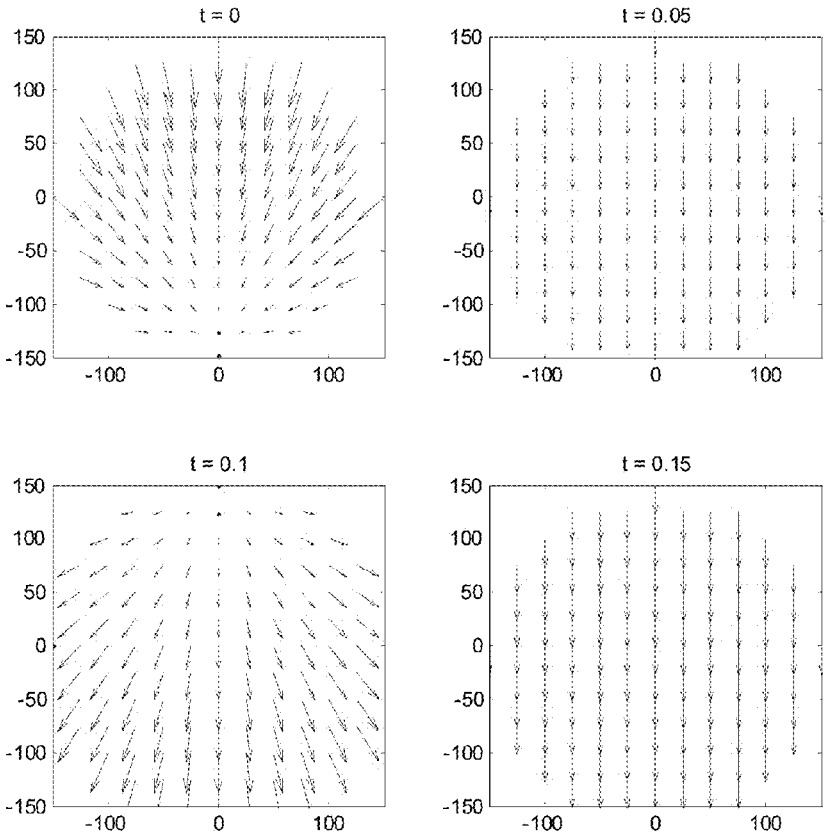

FIGS. 31C and 31D provide additional modeling results similar to those shown in FIGS. 31A and 31B. The simulation related to FIGS. 31C and 31D differs from the simulation related to FIGS. 31A and 31B in that a 22.5 LPM cross flow is separately provided in the cross flow manifold. As such, the average cross flow velocity shown in the lower panel of FIG. 31C varies as the height of the cross flow manifold is changed. In this example, the cross flow manifold height is varied between 2 mm and 3 mm at a frequency of about 5 Hz. At time t=0, the height of the cross flow manifold is increasing, and electrolyte is suctioned inwards. Because of the separately provided cross flow, the resulting electrolyte flow paths are not directed exactly radially inwards. The cross flow velocity is greater near the inlet side of the electroplating apparatus, from which the separately provided cross flowing electrolyte originates. In FIG. 31B, the inlet side is near the top (y axis=150) of the substrate, while the outlet side is near the bottom (y axis=−150) of the substrate. The cross flow velocity is much smaller near the outlet side of the electroplating apparatus, where the electrolyte entering the cross flow manifold (e.g., due to the increased height/volume of the cross flow manifold) is, to some degree, offset by electrolyte exiting the cross flow manifold (e.g., due to the separately provided cross flow). At time t=0.05, the height of the cross flow manifold reaches a maximum of 3 mm, and dH/dt=0. At this time, a uniform cross flow is present across the substrate, due to the separately provided cross flow. At time t=0.1, the height of the cross flow manifold is decreasing, and electrolyte is pushed out from this region. At this time, the velocity of the cross flow is greater near the outlet than near the inlet. At time t=0.15, the height of the cross flow manifold reaches a minimum of 2 mm, and dH/dt=0. A uniform cross flow is again established at this time. Together, FIGS. 31A-31D illustrate that increasing and decreasing the height of the cross flow manifold can significantly impact the hydrodynamics within the cross flow manifold.

Figure 31E:
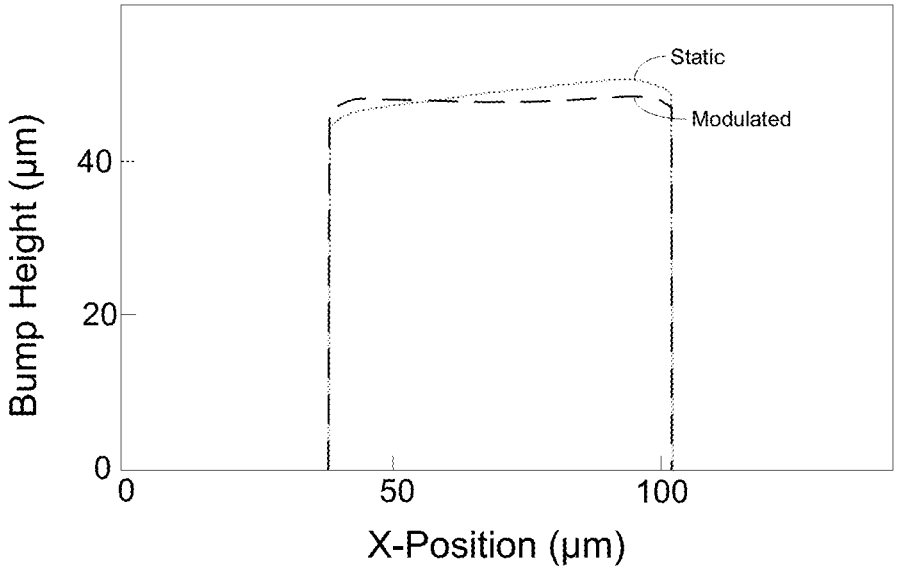
FIG. 31E presents experimental results comparing the bump shapes achieved when using either static or modulated cross flow manifold height during electroplating.

FIG. 31E presents experimental data illustrating the cross-sectional shape of a plated bump in two different cases. In one case, the cross flow manifold was a conventional static cross flow manifold having a height of about 2 mm. The static cross flow manifold height results are shown in a solid gray line, and illustrate that the bump height is significantly shorter on one side and taller on the other side. In the other case, the cross flow manifold was modulating between a height of 2 mm and a height of 3 mm, at a frequency of about 5 Hz. The modulated cross flow manifold height results are shown in a dashed black line, and illustrate that the bump height is relatively uniform across the bump. As seen in FIG. 31E, modulating the height of the cross flow manifold results in a much more uniform bump height when considering a single plated bump. By contrast, where the height of the cross flow manifold is static during electroplating, the height of the bump varies more considerably across the bump. For example, in various cases where the height of the cross flow manifold is static, the bump may be taller on the side near the edge of the substrate, and shorter on the side near the center of the substrate. Other within-bump height non-uniformities may arise in other cases, depending on the chemistry and other plating parameters that are used. Such non-uniformities may arise due to a center-to-edge bias in the directionality of the cross flowing electrolyte passing through the cross flow manifold, and/or due to generally increasing flow velocity toward the edge of the substrate compared to the center of the substrate.

Figure 32A:
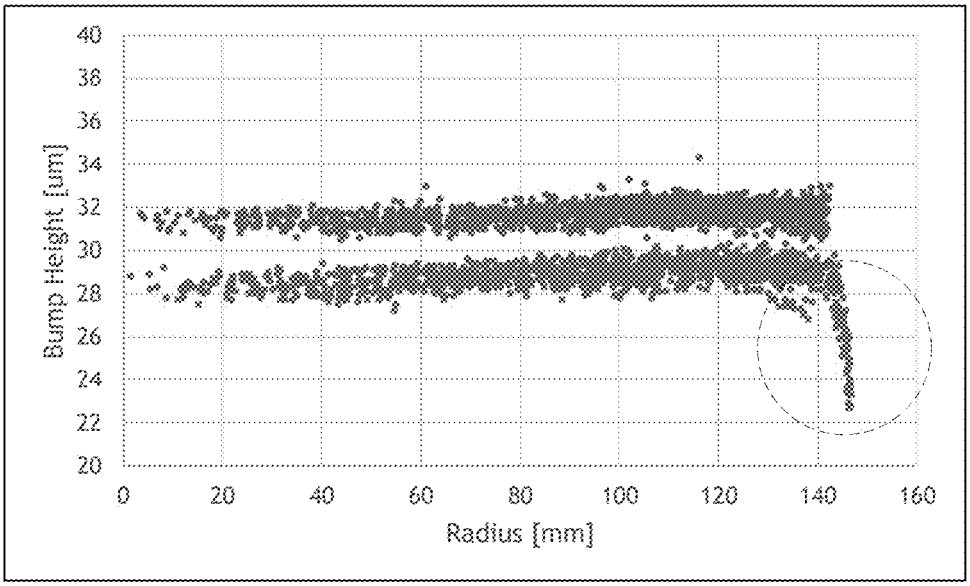
FIGS. 32A-32C relate to experimental results comparing cases in which the height of the cross flow manifold is either uniform or modulated during electroplating.
Figure 32B:
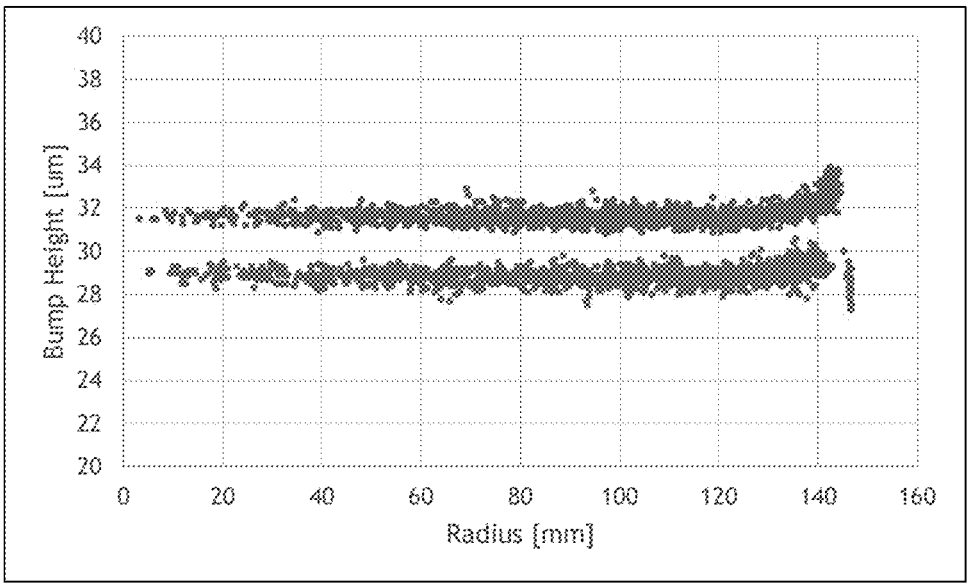
Figure 32C:
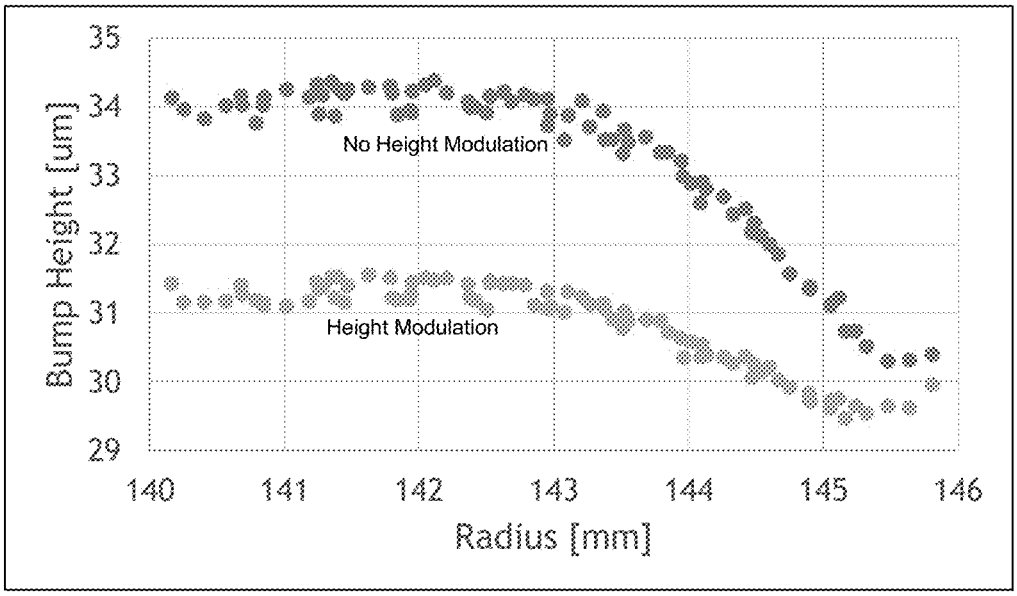

FIGS. 32A-32C relate to experimental results evaluating the effect of modulating the height of the cross flow manifold during electroplating. FIG. 32A relates to a baseline experiment where the height of the cross flow manifold was uniform during electroplating. FIG. 32B relates to a similar experiment where the height of the cross flow manifold was modulated during electroplating. The substrates electroplated in relation to FIGS. 32A and 32B included a layer of photoresist that was edge-thick. In particular, the photoresist over most of the substrate was about 55 μm thick, while the photoresist proximate the edge of the substrate was about 73 μm thick, representing a difference of about 18 μm. In the conventional case where there was no modulation of the cross flow manifold height, the minimum bump height near the edge of the substrate was quite low. This problem area is shown in a dotted circle in FIG. 32A. By contrast, there was significantly less decrease in the minimum bump height when the height of the cross flow manifold was modulated during electroplating, as shown in FIG. 32B. This means that the bump height is significantly more uniform, especially around the edge of the substrate, in cases where the height of the cross flow manifold is modulated during electroplating.

FIG. 32C provides experimental results comparing two electroplating processes. In one process, the height of the cross flow manifold was uniform during electroplating (no height modulation), and in a second process, the height of the cross flow manifold was modulated as described herein. The average bump height is shown for a peripheral region on the substrate. The bump height was noticeably more uniform in cases where the height of the cross flow manifold was modulated during electroplating.

Sealing the Cross Flow Manifold

In a number of embodiments, there is a small leakage gap (e.g., about 0.5 mm or greater) between the bottom surface of a substrate holder and the top surface of an element below the substrate holder. This leakage gap is typically maintained during electroplating to allow the substrate to be rotated freely. One drawback of this configuration is that during electroplating, some portion of the electrolyte escapes through the leakage gap. Unfortunately, the volume and velocity of cross flowing electrolyte across the plating face of the substrate is lower than it would be without such leakage, leading to a certain degree of non-uniformity in the electroplating results. In order to prevent such leakage and thereby increase the volume and velocity of cross flowing electrolyte, a seal may be provided between the bottom of the substrate holder and the top surface of an element below the substrate holder (often, but not always, a flow confinement element). This technique can substantially increase the uniformity of the electroplated features.

Figure 34A:
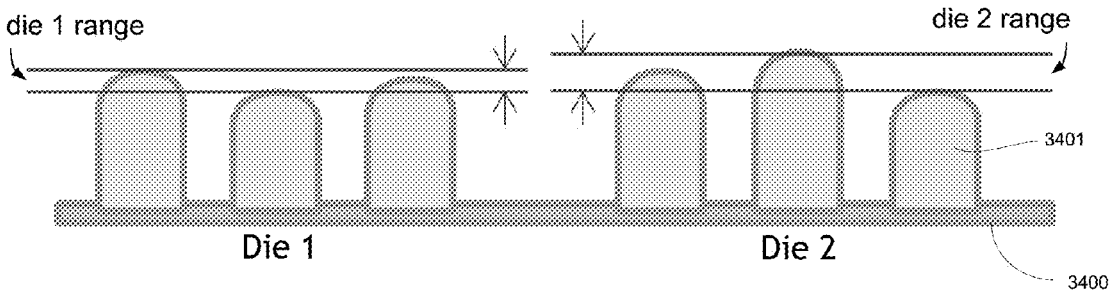
FIG. 34A depicts a substrate with bumps thereon to illustrate the concept of within die (WID) non-uniformity of bump heights.

Velocity of the plating solution flowing over the wafer substrate (e.g., flowing across the substrate in a direction parallel to the plating face of the substrate) as it is being electroplated, affects the within die non-uniformity (WID non-uniformity) of WLP pillars plated at high electroplating rates, for instance. WID non-uniformity is illustrated in FIG. 34A, which shows a schematic cross-sectional view of two die on a substrate 3400, where in each illustrated die there are three electroplated bumps 3401 of varying heights. The WID non-uniformity is determined by finding the height range of bumps 3401 in each die (the difference between heights of the tallest and shortest bumps 3401 in a die) on the substrate 3400, and taking an average of half of the value of these ranges for all die on the substrate.

Figure 34B:
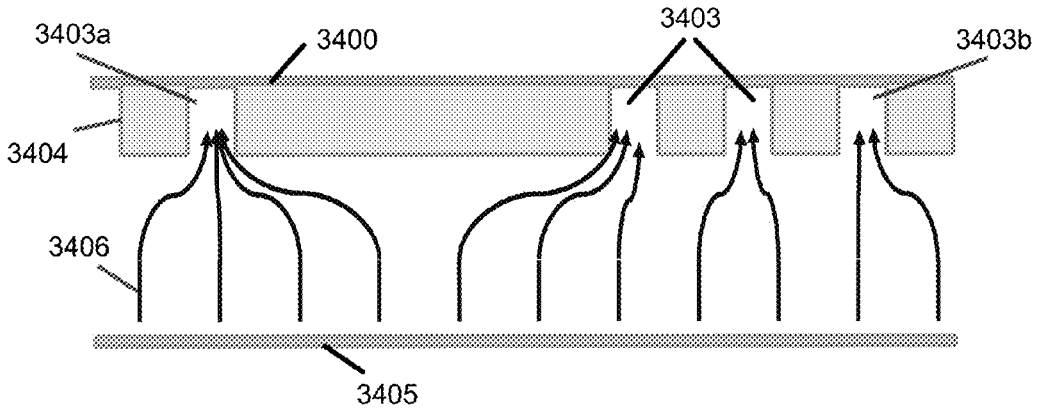
FIG. 34B shows a substrate with an uneven distribution of features formed in photoresist, resulting in uneven current distribution to the features.

Bump heights in a die can vary due to uneven current distribution driven by a non-uniform pattern of photoresist in through-resist electroplating. FIG. 34B illustrates a schematic cross-sectional view of a cathodically biased substrate 3400 having a plurality of recessed features 3403 formed in a photoresist layer 3404, where a conductive seed layer is exposed at the bottom of the recessed features 3403. The schematic drawing shows ionic current (current driven by ions in a plating solution) with arrows 3406 directed from an anode 3405 (depicted here below the substrate 3400) to the cathodically biased substrate 3400. The anode 3405 provides a constant current distribution, while the cathode (substrate 3400) experiences an uneven current distribution. It is shown that due to uneven distribution of photoresist within the photoresist layer 3404, different recessed features 3403 see different amounts of ionic current. For example, current crowding occurs in the vicinity of larger photoresist deposits in comparison with areas having smaller photoresist deposits (e.g., areas with increased photoresist patterning/recessed features 3403). For instance, recessed feature 3403*a*, which is provided in an area with relatively larger photoresist deposits, experiences current crowding compared to feature 3403*b*, which is provided in an area with relatively smaller photoresist deposits/greater density of recessed features 3403.

This uneven distribution of current can be mitigated by providing higher flow rate of plating solution in the vicinity of the wafer substrate. In cases where no seal is provided between the substrate holder and the flow confinement element, a large fraction of the plating solution flowing through the cross flow manifold does not exit through the dedicated exit (at an azimuthally opposing position from the inlet to the cross flow manifold). Instead, some portion of the plating solution exits through a ring-shaped leakage gap between the flow confinement element and the lower portion of the substrate holder (also referred to as the cup). The loss of plating solution through this leakage gap results in lower velocity of plating solution flow.

Figure 34C:
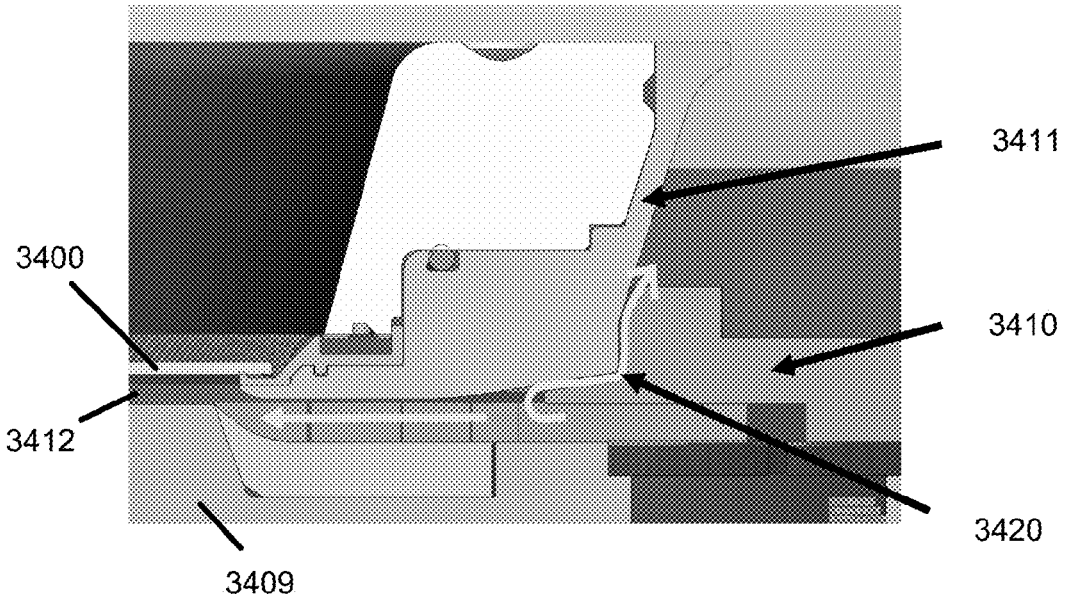
FIG. 34C illustrates a leakage gap between a substrate holder and a flow confinement element.

This problem is illustrated by FIG. 34C, which shows a cross-sectional view of a portion of an electroplating apparatus that lacks a seal between the flow confinement ring and the substrate holder. In other words, FIG. 34C shows an embodiment where the cross flow is not sealed. FIG. 34C shows a side of the substrate 3400 that is being held by a substrate holder 3411, as well as a portion of a flow confinement ring 3410 (sometimes referred to as an insert, positioned radially outside of the substrate 3400) residing over a peripheral region of the ionically resistive element 3409. Two arrows show the directions of flow of the plating solution. The arrow (pointed leftwards) directed towards the center of the apparatus shows the flow of plating solution injected into the cross flow manifold 3412 laterally through the inlet (the outlet to this flow located at an azimuthally opposing position of the apparatus is not shown). The second arrow 3420 (pointing upwards/outwards) depicts the escape route for the electrolyte flow through the leakage gap between the top portion of the flow confinement ring 3410 and the bottom portion of the substrate holder 3411 (cup). It is understood that in the depicted embodiment this leakage gap is substantially ring-shaped and it is located near the periphery of the substrate 3400 above the top portion of the flow confinement ring 3410, substantially following the circumference of the substrate 3400. Up to 30% of the total flow solution can be lost through this leakage gap during electroplating, thereby reducing the amount and the velocity of the plating solution flowing across the substrate 3400.

In various embodiments provided herein, the loss of plating solution flow is reduced by sealing off (at least partially) any solution outlets in the vicinity of the wafer other than a dedicated plating solution outlet (sometimes referred to as a side outlet or cross flow outlet) disposed at an azimuthally opposing position from the plating solution inlet (sometimes referred to as a side inlet or cross flow inlet). In a specific embodiment the leakage gap between the substrate holder and the ionically resistive element (or any flow shaping elements residing over the ionically resistive element) is sealed during at least a portion of electroplating. Specifically, in some embodiments the leakage gap between a flow confinement ring and the lower portion of the substrate holder is sealed with a sealing member (also referred to as a seal), which may be attached to (or integral with) the top portion of the flow confinement ring, the bottom portion of the substrate holder, or both.

Figure 34D:
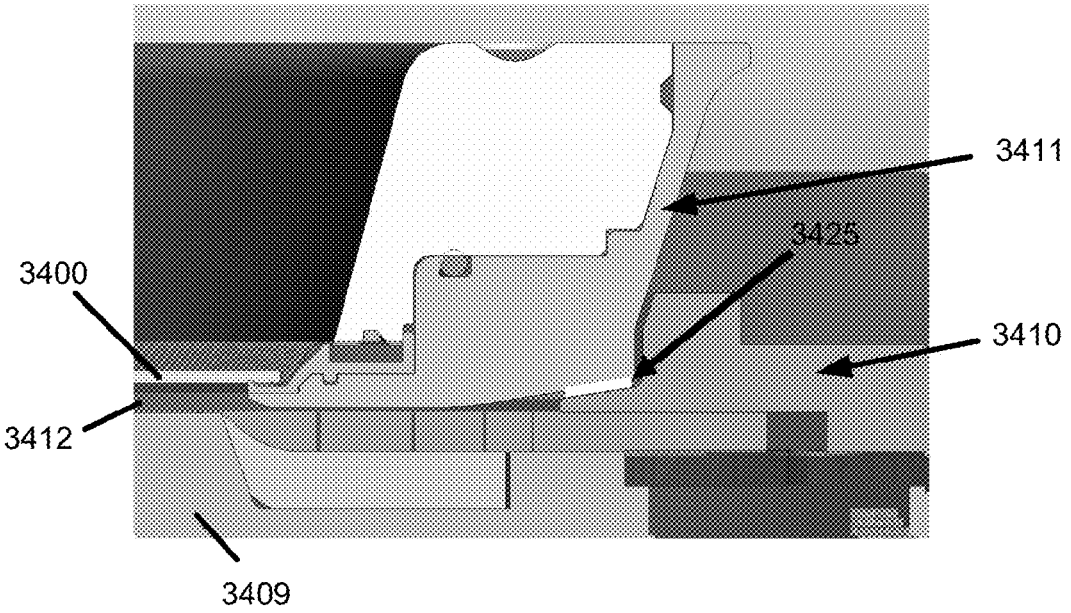
FIGS. 34D-F illustrate embodiments where a sealing member is provided in the leakage gap.

FIG. 34D illustrates an apparatus with sealed cross flow according to an embodiment provided herein. A cross-sectional view of a portion of the apparatus (as in FIG. 34C) is shown. The leakage gap between the flow confinement ring 3410 and the substrate holder 3411 is blocked by a sealing member 3425 (sometimes referred to as a sealing member), thereby preventing the plating solution from flowing through this leakage gap. In certain embodiments the sealing member 3425 is a compressible seal, which is attached either to the substrate holder 3411 or to the flow confinement ring 3410.

The sealing member may be made of a compressible material that is capable of tightly sealing any gaps when pressed between two elements (e.g., the substrate holder and the substrate-facing surface of the flow confinement element). The sealing member material should be compatible with the chemistry of the plating solution. For example, in some embodiments the material is chemically resistant to acidic electrolytes. In some embodiments acid-resistant rubber-like materials, and particularly, fluoropolymer elastomers are preferred. In some implementations the sealing member includes a copolymer of hexafluoropropylene (HFP) and vinylidene fluoride (VDF or VF2), or a terpolymers of tetrafluoroethylene (TFE), vinylidene fluoride (VDF) and hexafluoropropylene (HFP). In some embodiments the fluorine content in the fluoropolymer elastomer is between about 65 and 70%. One example of an acid-resistant fluoropolymer elastomeric material that is suitable for use in a sealing member, is Viton® available from DuPont Performance Elastomers, LLC.

The sealing member, in some embodiments, is attached (fixedly or releasably) to the substrate holder, and is configured to be moveable with the substrate holder as a unitary body. In other embodiments the sealing member is attached (fixedly or releasably) to the substrate-facing surface of the flow confinement element. In other embodiments, the sealing member may be held in place by a scaffold that is different from the substrate holder and the flow confinement element.

Figure 34E:
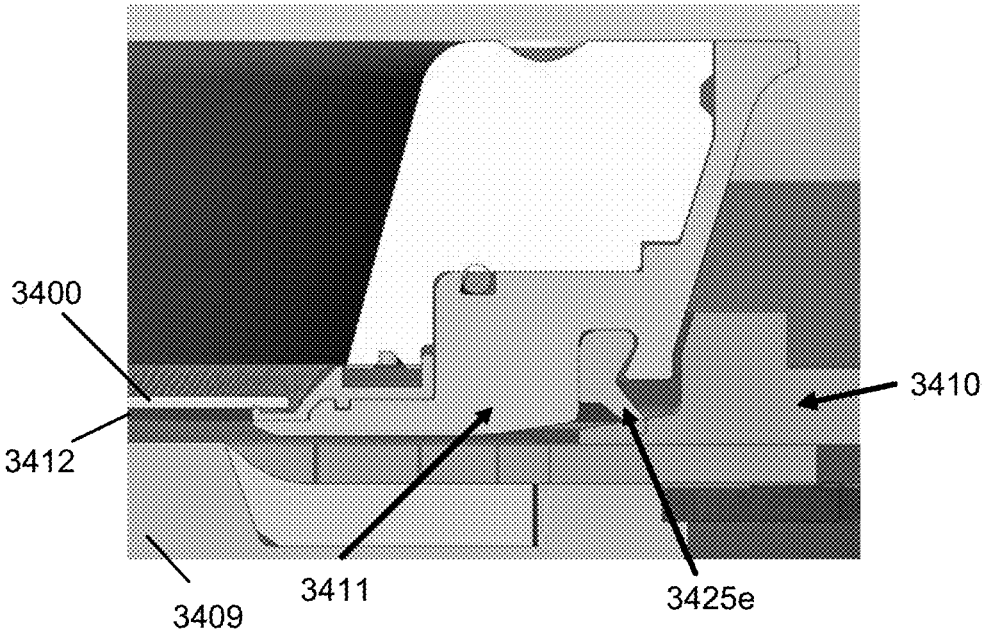
Figure 34F:
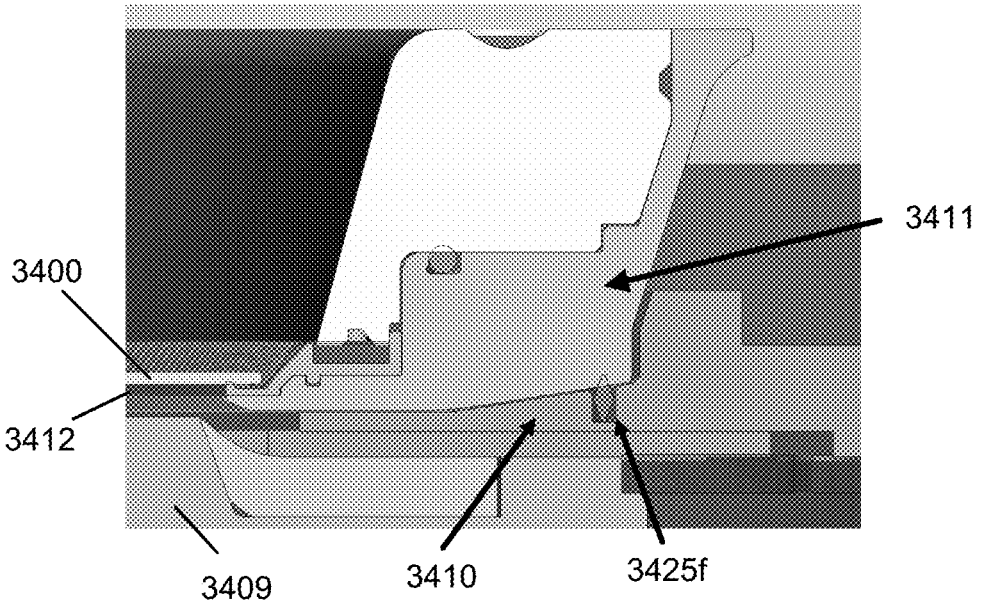

Two different implementations for sealing off the leakage gap between the substrate holder 3411 and the flow confinement ring 3410 are shown in FIGS. 34E and 34F, which show cross-sectional views of relevant portions of the apparatus. In FIG. 34E, the bottom portion of the substrate holder 3411 has been modified with a wiper-type sealing member 3425*e* attached thereto. The sealing member 3425*e* is similar to a seal that may be used in the cone portion (not shown) of the substrate holder 3411. The bottom portion of the substrate holder 3411 (the cup) has been modified to accommodate the sealing member 3425*e*. In another implementation the seal is attached to the top portion of the flow confinement ring 3410. This embodiment is illustrated in FIG. 34F, which shows a diamond-shaped (in cross-section) sealing member 3425*f* attached to the top portion of the flow-confinement ring 3410. It is understood that in the depicted embodiments the sealing members generally have a ring-shaped structure as they seal the ring-shaped gap around the periphery of the wafer substrate. In various embodiments, at least 75% of the perimeter of the gap may be sealed. In the depicted embodiments, 100% of the perimeter of the gap is sealed.

In alternative embodiments, the material of the bottom portion of the substrate holder and/or the material of the flow-confinement element is configured and selected such as to make an effective seal between these two elements. In various embodiments the seal may be liquid tight. For example, a compressible rubber-like material can be used to manufacture relevant portions of these elements. In these embodiments, the "sealing member" is the substrate holder and/or the flow confinement structures themselves. It is noted that in electroplating apparatus that lack the described seal, the substrate holder and the flow-confinement ring are made of hard non-compressible materials, and would not be able to form a very effective seal when pressed against each other.

Because sealing of the leakage gap between substrate holder and the stationary flow confinement structure may preclude rotation of the wafer during electroplating, new electroplating methods are provided. In various embodiments, the substrate is not being rotated while the leakage gap between the substrate holder and the flow confinement structure is sealed because such sealed rotation may result in generation of particles that could undesirably deposit on the substrate. To avoid this issue, various electroplating methods described herein involve intermittently unsealing the apparatus and rotating the wafer in an unsealed state. The unsealing can be performed by lifting the substrate holder assembly in a z-direction to enable rotation of the wafer substrate. Electroplating may or may not stop during the unsealing. In certain embodiments, a current applied to the substrate may be reduced when the apparatus is plating in an unsealed position compared to when the apparatus is plating in the sealed position. In another embodiment, a current applied to the substrate may be increased when the apparatus is plating in an unsealed position compared to when the apparatus is plating in the sealed position. The wafer's plating face remains immersed in the plating solution both in a sealed and in an unsealed position. Rotation of the wafer is important for optimal uniformity because electroplating on a stationary wafer, while providing a unidirectional cross flow of plating solution, would result in increased non-uniformity.

Figure 35:
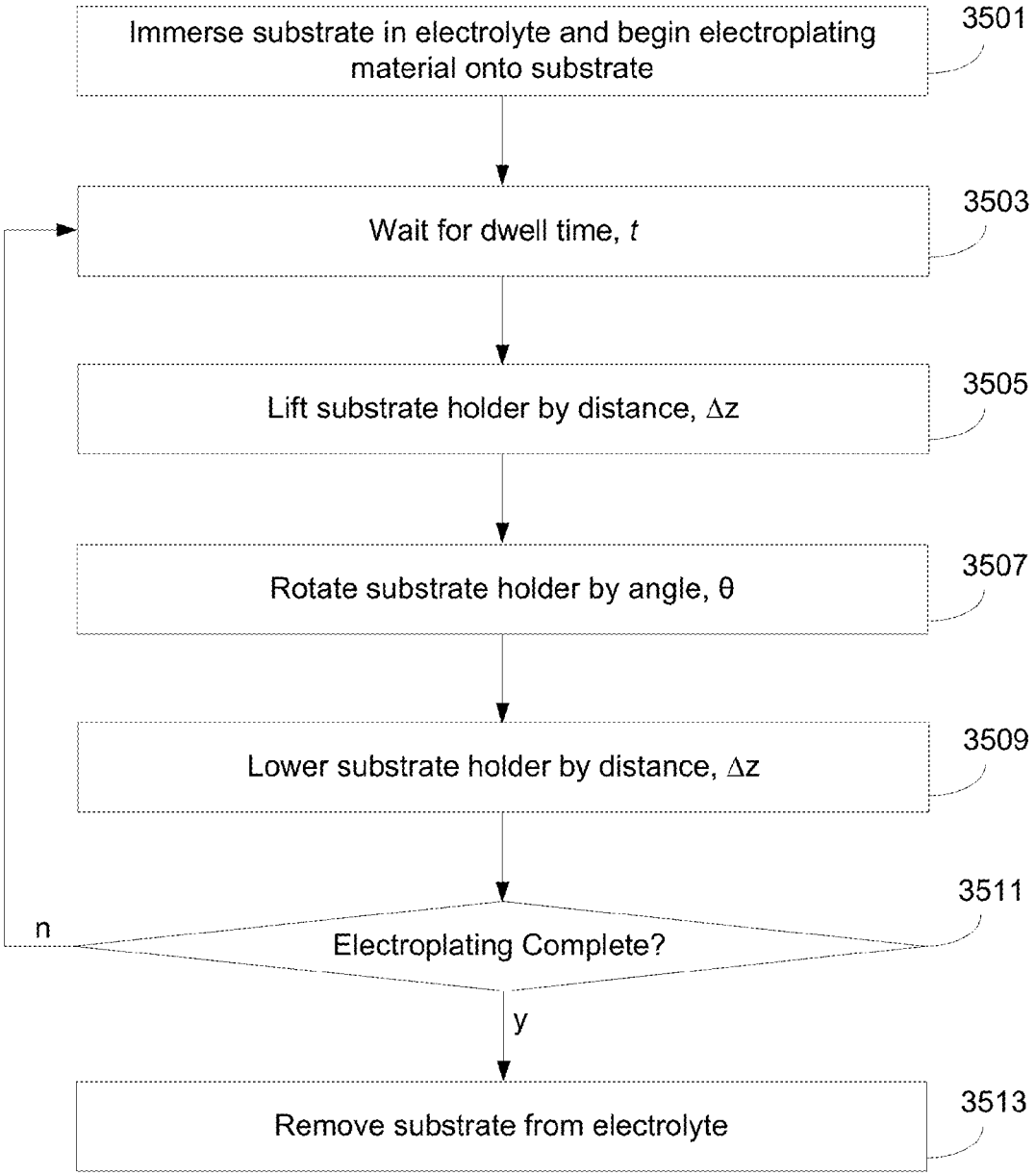
FIG. 35 provides a flow chart describing a method of electroplating material onto a substrate that involves intermittently sealing and unsealing the cross flow manifold, as well as intermittently rotating the substrate.

The methods are illustrated in a process flow diagram presented in FIG. 35. The process begins at operation 3501, where a substrate is provided into an electroplating apparatus configured for creating a sealed cross flow environment, as described herein. In some embodiments, the substrate is a semiconductor substrate that has an exposed layer of photoresist and a plurality of recessed features in the photoresist layer, where a conductive seed layer is exposed at the bottoms of the recessed features. The substrate is secured in the substrate holder, and the plating face of the substrate is immersed into the plating solution, which contains ions of the metal that is being plated. The substrate is immersed to a depth at which the leakage gap between the substrate holder and underlying structure (e.g., flow confinement ring) is sealed. In other words, operation 3501 involves sealing the cross flow such that cross flowing electrolyte is only able to exit the cross flow manifold at the dedicated outlet that is positioned azimuthally opposite the inlet. Electrical contacts are made to the seed layer at the periphery of the substrate, and the substrate is cathodically biased during electroplating. The plating solution flows in to the cross flow manifold between the ionically resistive element and the substrate through the inlet at a selected azimuthal position, parallel to the plating face of the substrate, and exits through the dedicated outlet at an azimuthally opposite position. Further, a portion of the electrolyte flow may enter the cross flow manifold through the channels of the ionically resistive element.

The method continues with operation 3503, where electroplating metal on the substrate continues while waiting for a dwell time, t. In various embodiments, the substrate does not rotate during operation 3503. Next, at operation 3505, the cross flow is unsealed by moving the substrate holder with the substrate upwards in a z-direction by a distance $\Delta z$ to break the seal between the substrate holder and underlying structure (e.g., flow confinement ring), thereby enabling rotation of the substrate in the substrate holder relative to the cell.

Next, at operation 3507, the substrate is rotated by $\theta$ degrees (the rotation step angle). The rotation in operation 3507 alters the direction of the cross flow relative to the surface of the substrate, thereby decreasing plating non-uniformities that arise due to the uni-directionality of the cross flow. Next, at operation 3509, the cross flow is re-sealed by lowering the substrate holder with the substrate in the z-direction by distance $\Delta z$.

It is determined in operation 3511 whether the electroplating process is complete. If electroplating is not yet complete, the method continues back at operation 3503, where electroplating continues while waiting for an additional dwell time, t. When the electroplating process is complete, the method continues with operation 3513, where the substrate is removed from the electrolyte by lifting the substrate holder out of the electrolyte.

Electroplating begins at operation 3501, and continues through operations 3503, 3505, 3507, 3509, and 3511 It is noted that when the apparatus is in an unsealed position, a portion of the plating solution flow is lost through the unsealed leakage gap between the substrate holder and the element below the substrate holder (e.g., the flow confinement element). However, this loss is balanced by the amount of time the apparatus spends in a sealed state, where no such unwanted leakage is occurring. Longer dwell times are associated with smaller amounts of plating flow being lost through the unsealed leakage gap and higher average cross flow velocities. However, intermittent rotation of the substrate is often used to achieve optimal uniformity in a system with a uni-directional cross flow of electrolyte.

Operations 3503-3511 may be repeated as many times as necessary to complete electroplating. In a number of embodiments, the electroplating process can be terminated at any time in any step, at which point the substrate will be lifted from the plating solution and continue to post-plating processing, or may remain in solution and perform subsequent plating steps in a conventional way (sealed or unsealed). In other words, while the determination in operation 3511 is illustrated in FIG. 35 as occurring after operation 3509, it is understood that this determination may be made during any step.

In some embodiments, the dwell times may be 10 seconds or longer (e.g., times of about 10-20 seconds, such as 15 seconds can be used), as these relatively long dwell times are associated with optimal retention of electrolyte flow (e.g., more than 75% of flow is not lost). In some embodiments, the substrate holder moves to an unsealed position by moving upwards by a distance between about 0.25 and 2 mm. In a specific embodiment, the substrate holder is moved upwards 1 mm, which results in a gap between the sealing member and the flow confinement structure (or between the sealing member and the substrate holder, depending on the position of the sealing member) of about 0.5 mm. The gap of 0.5 mm or more is sufficient for executing rotation of the substrate. The distance by which the substrate moves may be larger than the gap that is created due to the compressible nature of the sealing member. The rotation step angle in certain cases may be no more than 180 degrees (e.g., angles between 30-180, such as about 115 degrees can be used). In other embodiments smaller angles (e.g., between about 5-45 degrees) are used. The rotation step angle refers to the angle ($\theta$) by which a substrate is rotated while it is in the unsealed position during a single iteration of substrate rotation (e.g., during operation 3507 of FIG. 35). In some embodiments the rotation is performed at an average angular velocity of between about 1-90 degrees per second (allowing for both acceleration and deceleration). Electroplating in the sealed position (without rotation) and in the unsealed position (with rotation) is repeated typically for between about 30-330 cycles, where each cycle includes one step of plating in the unsealed position and one step of plating in the sealed position.

It is noted that while methods with intermittent unsealing and rotation are used in many cases, continuous electroplating in a sealed position (without unsealing and rotation) is also within the scope of the embodiments provided herein.

Intermittent sealing provides an adequate balance between increasing the cross flow velocity and providing cross flow of differing directions (relative to a selected azimuthal position on the substrate). In some embodiments, the time spent by the substrate in the sealed state is greater than the time spent in an unsealed state. In some embodiments, short periods of unsealing (relative to the sealed time) allow for a combination of the benefits of sealing (decreased loss of flow and increased cross flow velocity) with the benefits of rotation of the substrate (improved uniformity due to flow coming at multiple angles relative to a feature).

In some embodiments the substrate holder is configured to rotate the substrate at least during a portion of the electroplating. In some embodiments the apparatus is configured to alternate between "sealed" and "unsealed" positions during electroplating, wherein the wafer substrate remains stationary during electroplating in a "sealed" position, and rotates during electroplating in an "unsealed" position. In some embodiments the apparatus is configured for moving the substrate holder vertically to thereby move from "sealed" position to "unsealed" position and back.

In certain embodiments, a method of electroplating on a substrate may include (a) receiving a substantially planar substrate in a substrate holder, where a plating face of the substrate is exposed, and where the substrate holder is configured to hold the substrate such that the plating face of the substrate is separated from the anode during electroplating, (b) immersing the substrate in electrolyte, where a gap of about 10 mm or less is formed between the plating face of the substrate and an upper surface of an ionically resistive element, the gap forming a cross flow manifold, where the ionically resistive element is at least coextensive with the plating face of the substrate, and where the ionically resistive element is adapted to provide ionic transport through the ionically resistive element during electroplating, (c) flowing electrolyte in contact with the substrate in the substrate holder (i) from a side inlet, into the cross flow manifold, and out a side outlet, and, optionally, (ii) from below the ionically resistive element, through the ionically resistive element, into the cross flow manifold, and out the side outlet, where the side inlet and side outlet are positioned proximate azimuthally opposed perimeter locations on the plating face of the substrate, and where the side inlet and side outlet are designed or configured to generate cross flowing electrolyte in the cross flow manifold during electroplating, wherein the cross flow manifold is sealed at least during a portion of electroplating; (d) electroplating material onto the plating face of the substrate while flowing the electrolyte as in (c). When the cross flow manifold is sealed, a sealing member may wholly or partially seal one or more outlets to the cross flow manifold that are different from the side outlet.

In some embodiments the method further comprises unsealing the cross flow manifold to allow for rotation of the substrate in an unsealed state; rotating the substrate in an unsealed state; transitioning to the sealed state and continuing electroplating in the sealed state. In some embodiments, the method comprises repeating electroplating in the sealed state, and rotating the substrate in the unsealed state several times during the course of electroplating.

"Sealed state" refers to a state wherein the sealing member is engaged. The sealing member is engaged when the substrate holder is sufficiently close to the element below the substrate holder (typically but not always the flow confinement element) to block electrolyte flow in the leakage gap. In cases where the sealing member seals 100% of the leakage gap and the apparatus is in a sealed state, the electrolyte can exit the cross flow manifold only through a dedicated exit located at an azimuthally opposite position from a cross flow inlet. In cases where the sealing member seals less than 100% of the leakage gap and the apparatus is in a sealed state, the electrolyte can exit the cross flow manifold through the dedicated exit opposite the cross flow inlet, as well as any areas of the leakage gap that the sealing member does not seal. "Unsealed state" refers to a state when the sealing member is not engaged. In such a state, the substrate holder is too far away from the element below the substrate holder such that the sealing member does not contact both of these elements and no effective seal is formed in the leakage gap. In the unsealed state, other outlets (e.g., the entire ring-shaped leakage gap between the substrate holder and the flow confinement element) are present. Either the electroplating apparatus generally, or the cross flow manifold specifically, may be referred to as being in the sealed or unsealed states. Similarly, the cross flow may be referred to as being in the sealed or unsealed states. It is understood that these refer to the same thing (i.e., when the cross flow manifold is in the sealed state, the cross flow is in the sealed state and the apparatus is in the sealed state). In some embodiments moving from the sealed state to an unsealed state involves moving the substrate holder away from the flow confinement element, thereby breaking the seal. When an apparatus with a wafer face-down orientation is used, the substrate holder is moved upwards in the z-direction to break the seal. In some embodiments, electroplating is performed in a "sealed state" for more than half of the total plating time.

The electroplating methods provided herein can be implemented in any of the apparatuses described in U.S. Pat. No. 8,795,480 and in the US Patent Application Publication No. 2013/0313123, as well as the apparatuses described above in relation to various figures, after these apparatuses are configured for sealing the cross flow in the vicinity of the wafer, as described herein. Specifically, a sealing member can be employed in any of the apparatuses described in these references. For example, a SABRE3D apparatus can be modified with a sealing member.

In one embodiment the apparatus includes (a) an electroplating chamber configured to contain an electrolyte and an anode while electroplating metal onto a substantially planar substrate, (b) a substrate holder configured to hold a substantially planar substrate such that a plating face of the substrate is separated from the anode during electroplating, (c) an ionically resistive element including a substrate-facing surface that is separated from the plating face of the substrate by a gap (typically about 10 mm or less), the gap forming a cross flow manifold between the ionically resistive element and the substrate, where the ionically resistive element is at least coextensive with the plating face of the substrate during electroplating, and where the ionically resistive element is adapted to provide ionic transport through the element during electroplating, (d) a side inlet to the gap for introducing electrolyte to the cross flow manifold, (e) a side outlet to the cross flow manifold for receiving electrolyte flowing in the cross flow manifold, where the side inlet and side outlet are positioned proximate azimuthally opposing perimeter locations on the plating face of the substrate during electroplating, and where the side inlet and side outlet are adapted to generate cross flowing electrolyte in the cross flow manifold, wherein the cross flow in the cross flow manifold is sealed. In certain cases, when the cross flow is sealed the plating solution is not allowed to escape the cross flow manifold through any other outlets that are different from the dedicated outlet (e). In some implementations the apparatus includes: (f) a sealing member for wholly or partially sealing one or more outlets to the cross flow manifold that are different from the side outlet (e).

Figure 7:
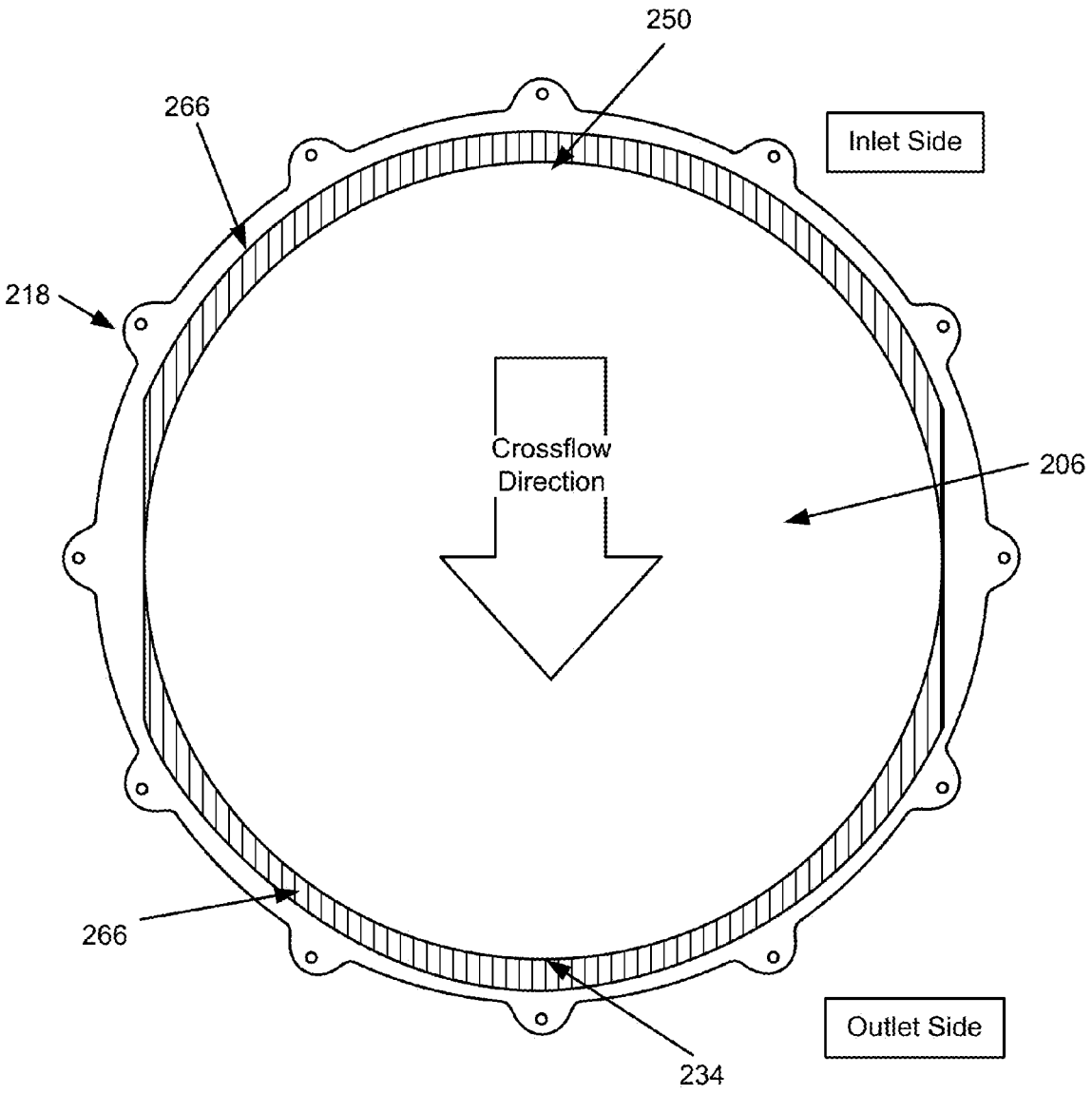
FIG. 7 illustrates a simplified top view of a CIRP and associated hardware showing both the inlet and outlet sides of the cross flow manifold according to various disclosed embodiments.

In some embodiments, the apparatus further includes a flow confinement element positioned peripherally in the gap between the ionically resistive element and the substrate holder, and following the circumference of the ionically resistive element. In these embodiments the flow confinement element may form the walls of the cross flow manifold. In some embodiments the substrate facing surface of the flow confinement element is circular and the element is referred to as a flow confinement ring. When the flow confinement ring is used, the sealing member is configured to seal the outlet between the substrate holder and the substrate-facing surface of the flow confinement ring. Preferably, the sealing member seals at least 75% of the circumference of the ring. In the embodiments illustrated by the drawings, and by the experimental data, the sealing member seals 100% of the circumference of the ring. It is noted that when the flow confinement ring is used, the inlet and outlet for the electrolyte cross flow manifold are located closer to the ionically resistive element than the substrate-facing surface of the flow confinement ring. In some embodiments, the surface of the flow-confinement ring that is facing the ionically resistive element is shaped such as to provide the outlet for the cross flow of the electrolyte (outlet (e)). An example of a suitable flow-confinement ring is illustrated in FIG. 7. An example of cross flow direction is illustrated in FIG. 1F.

In other embodiments the flow confinement element has a substrate-facing surface that only partially follows the circumference of the ionically resistive element. Such flow confinement element may have a wall partially following the circumference of the ionically resistive element and a vent region comprising one or more gaps, wherein the angle subtended by the vent region is between about 20 to 120 degrees. The gaps of the vent region may serve as the outlet for the cross flow (outlet (e)). Such element is also referred to as a flow diverter, and is described herein. In these embodiments, the sealing member is positioned such as to seal the outlet between the substrate holder and the substrate-facing surface of the flow confinement element.

Experimental Examples and Computational Modeling Related to Sealed Cross Flow

Figure 36A:
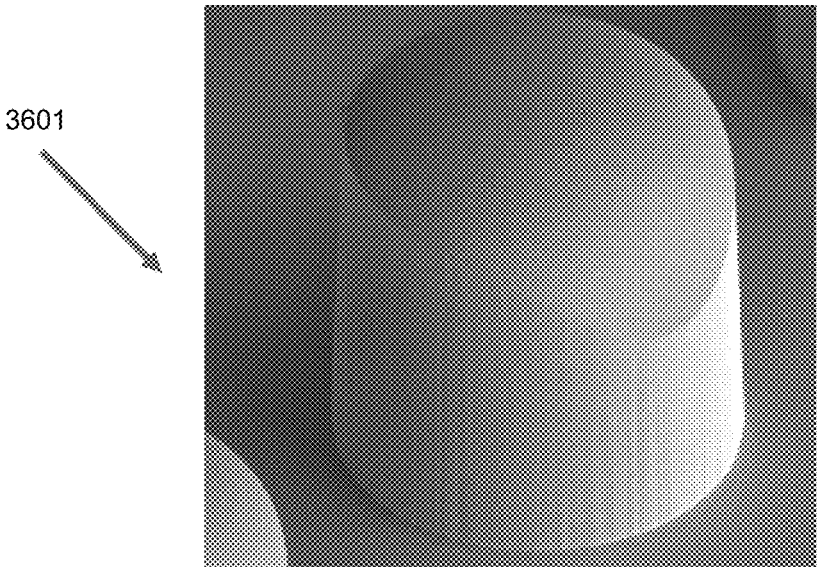
FIGS. 36A and 36B show experimental results comparing cases where a substrate was electroplated in a sealed cross flow manifold without rotation (FIG. 36A) and where a substrate was electroplated using an intermittently sealed cross flow manifold, with rotation.

Example A. FIG. 36A shows an SEM image of electroplated feature, which was deposited in an electroplating apparatus with a sealed cross flow of plating solution, but with no rotation of the substrate. The direction of the cross flow is shown with an arrow 3601. The cross flow is parallel to the substrate and is in one direction relative to the plating cell and substrate. The depicted pillar was obtained by electrodepositing copper on a substrate having a surface comprising recessed features made in a layer of photoresist, where a copper seed layer was exposed at the bottom of the recesses. After electroplating, the photoresist was removed and the SEM image of the resulting pillar was obtained. The pillar is 200 μm in width and approximately 200 μm in height. It can be seen that in the absence of rotation, non-uniformity in the top portion of the pillar related to the cross flow direction, is observed.

Figure 36B:
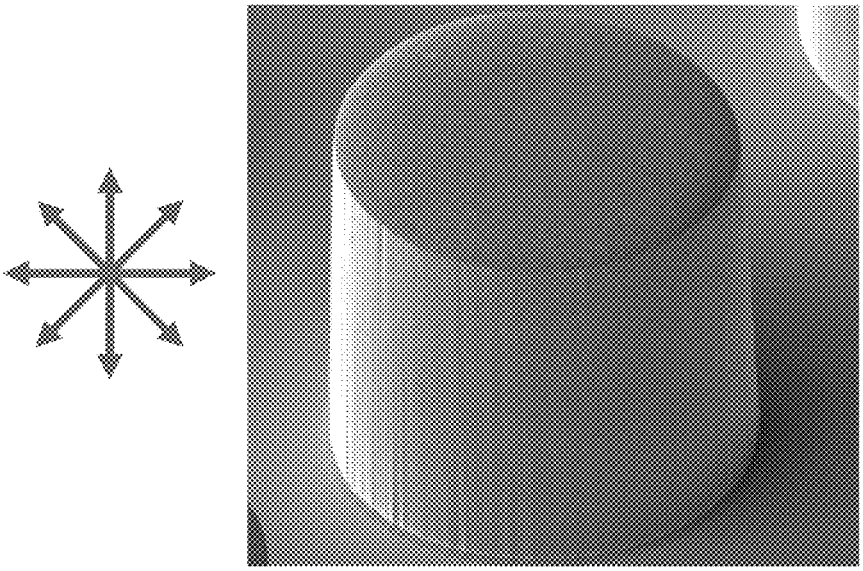

Example B. FIG. 36B shows an SEM image of electroplated feature, which was deposited in an electroplating apparatus with a sealed cross flow of plating solution, while implementing the intermittent rotation of the substrate, as described in the methods provided herein. Specifically, a dwell time of 15 seconds, a rotation angle of 113°, a maximum rotational velocity of 4 rpm (24°/s), a maximum rotational acceleration of 2000°/s$^2$, and a jerk of 10,000°/s$^3$ were used. The substrate was rotated in one direction during the course of electroplating. The arrows in FIG. 36B schematically show average cross flow in all directions in relation to a selected azimuthal position on the substrate. While the actual cross flow is still in a single direction relative to the plating cell, a selected azimuthal position on the substrate itself will experience cross flow of different directions due to rotation of the substrate. This evens out the non-uniformities caused by non-uniform flow direction. The ratio of the time that the apparatus spends in a sealed state to the total time, $r_{sealed}$, was calculated using the following parameters: rotation step angle θ, dwell time t, and jerk, acceleration, and velocity parameters for the substrate holder motion. This calculation was done by determining the amount of time required for the substrate holder to move to a new location ($t_{unsealed}$) given the parameters describing jerk, acceleration, and velocity, then comparing that time to the dwell time ($t_{sealed}$).

$$r_{sealed} = \frac{t_{sealed}}{t_{sealed} + t_{unsealed}} \quad \text{Equation 1}$$

Numeric calculations of motion profiles were performed using MATLAB, and three situations were tested: one in which motion was jerk-limited, one in which motion was acceleration-limited, and one in which motion was velocity-limited. These profiles were checked to see if they violated the substrate holder motion parameters (e.g., maximum acceleration may have been exceeded on a jerk-limited profile), and the profile with the shortest move time that did not violate any motion parameters was chosen.

Figures 36C, 36D:
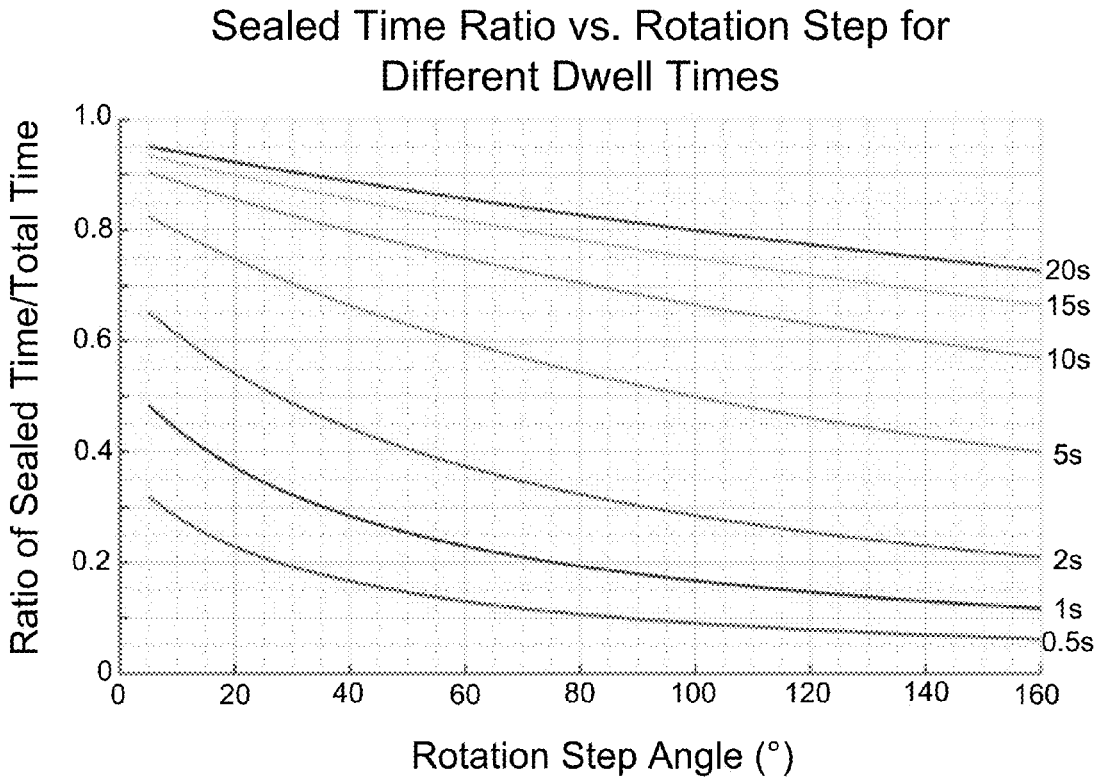
FIG. 36C provides a chart illustrating computational modeling results related to embodiments where the cross flow manifold is intermittently sealed and unsealed during electroplating, where the substrate is rotated when the cross flow manifold is unsealed.
FIG. 36D is a table describing the parameters used to create the modeling results shown in FIG. 36C.

FIG. 36C shows the results of these calculations in a plot, where the x-axis is the rotation step angle θ, and the y-axis is the fraction of the time the apparatus spends in a sealed state relative to the total time. Seven curves are shown, where for each curve dwell time was kept constant. From top curve to the bottom curve, the dwell times for each of the seven curves were 20, 15, 10, 5, 2, 1, and 0.5 seconds, respectively. The values of other parameters (presumed to be constant for the purposes of this calculation) are listed in a table presented in FIG. 36D. It can be seen that for dwell times of 10 seconds and greater the fraction of the time spent in a sealed state relative to the total time exceeds 0.5 for a wide range of rotation step angles.

The values obtained in a previous calculation can be used to calculate the fraction of the total electrolyte flow that is lost through the leakage gap during each rotation sequence. Assuming that 30% of the total electrolyte flow is lost when the apparatus is always unsealed, the fraction of lost electrolyte can be calculated using Equation 2:

$$f_{total} = f_{unsealed} \times (1 - r_{sealed}) \quad \text{Equation 2:}$$

where $f_{total}$ is the total fraction lost, $f_{unsealed}$ is the fraction lost when the apparatus is always unsealed, and $r_{sealed}$ is the ratio of sealed time to total time, as calculated above.

Figure 36E:
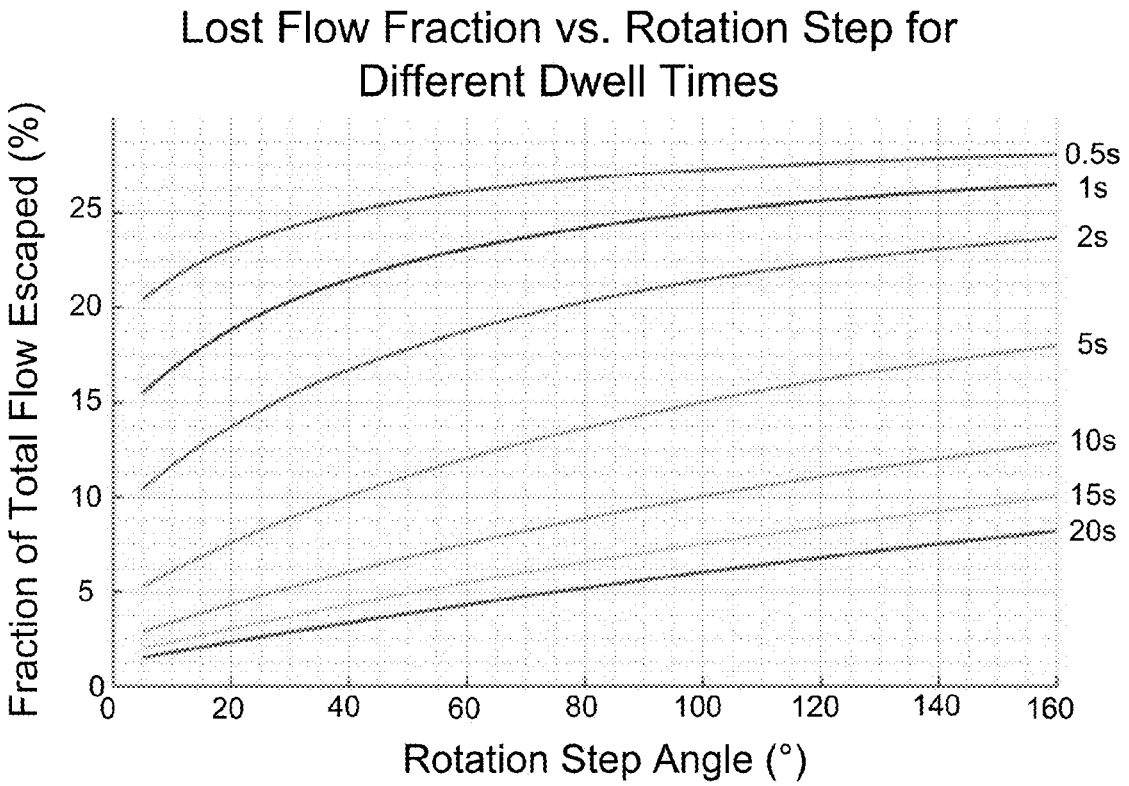
FIG. 36E is a chart showing computational modeling results related to embodiments where the cross flow manifold is intermittently sealed and unsealed during electroplating, where the substrate is rotated when the cross flow manifold is unsealed.

This calculation was also done using MATLAB. FIG. 36E shows a plot illustrating the results of this calculation, where rotation step is listed on the x-axis and the fraction of total flow that is lost is listed on the y-axis. Seven curves are shown, where for each curve dwell time was kept constant. From bottom curve to the top curve, the dwell times for each of the seven curves were 20, 15, 10, 5, 2, 1, and 0.5 seconds, respectively. It is shown that dwell times of greater than 15 seconds keep more than 90% of flow from escaping.

Figure 36F:
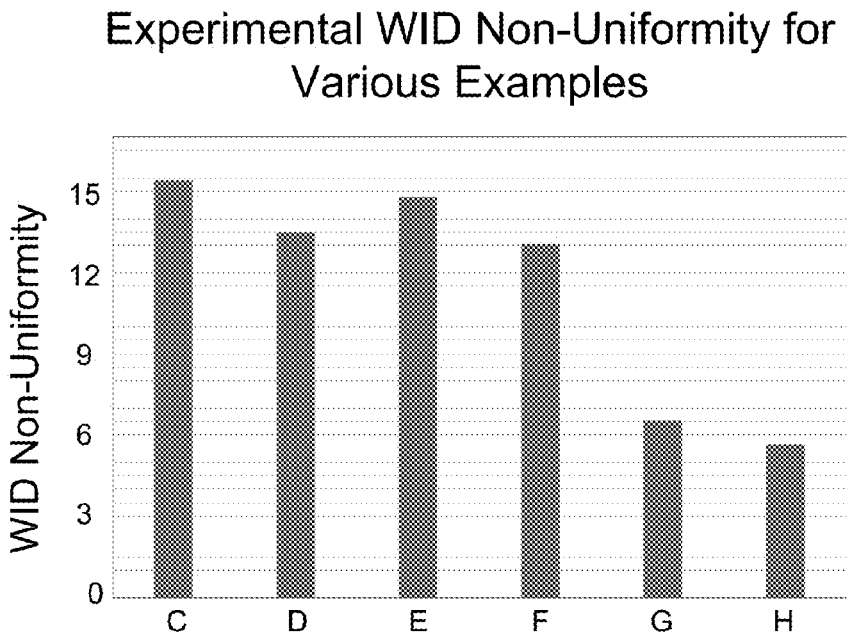
FIG. 36F provides experimental results related to WID non-uniformity for different example electroplating processes.

Experimental examples C, D, E, F, G and H are described in relation to FIG. 36F.

WID non-uniformity (as explained in relation to FIG. 34A) was measured for a number of substrates, where electroplating was performed in an apparatus capable of sealing between the substrate holder and the flow confinement element, both with and without intermittent rotation. The results are shown in the bar chart provided in FIG. 34A. In all examples C, D, E, F, G, and H, copper was electrodeposited on a substrate having a surface comprising recessed features made in a layer of photoresist, where a copper seed layer was exposed at the bottom of the recesses. The resulting pillars were 200 μm in width and approximately 200 μm tall.

In example C, plating was performed in an apparatus with constant rotation at 4 rpm, with no sealing between the substrate holder and the flow confinement ring. In example D, plating was performed under the same conditions as in example C, but with sealing and intermittent rotation, where the following rotation parameters were used: a dwell time of 15 seconds, a rotation angle of 113°, a maximum rotational velocity of 4 rpm, a maximum rotational acceleration of $2000°/s^2$, and a jerk of $10,000°/s^3$. 13% improvement in WID non-uniformity was achieved in example D in comparison with example C.

In example E, plating was performed in an apparatus with constant rotation at 4 rpm, with no sealing. In example F, plating was performed under the same conditions as in example E, but with sealing and intermittent rotation, where the following rotation parameters were used: a dwell time of 15 seconds, a rotation angle of 113°, a maximum rotational velocity of 4 rpm, a maximum rotational acceleration of $2000°/s^2$, and a jerk of $10,000°/s^3$. The conditions under which examples E and F were plated are identical to examples C and D, except that a different ionically resistive element was used in the plating cell. 12% improvement in WID non-uniformity was achieved in example F in comparison with example E.

In example H, plating was performed in an apparatus with constant rotation at 4 rpm and with no sealing. In example G, plating was performed under the same conditions as in example H, but with sealing and intermittent rotation, where the following rotation parameters were used: a dwell time of 15 seconds, a rotation angle of 113°, a maximum rotational velocity of 4 rpm, a maximum rotational acceleration of $2000°/s^2$, and a jerk of $10,000°/s^3$. The features in the photoresist layer used in examples G and H were more evenly distributed than the features in the photoresist layer used in examples C-F, reducing the unevenness of the current distribution and resulting in a comparatively lower WID non-uniformity. 15% improvement in WID non-uniformity was achieved in example H in comparison with example G.

In all cases, introduction of sealing and intermittent rotation according to the methods provided herein resulted in a reduction in WID non-uniformity. Reductions of between 12-15% were achieved.

Features of an Ionically Resistive Element

Electrical Function

In certain embodiments, the channeled ionically resistive element 206 approximates a nearly constant and uniform current source in the proximity of the substrate (cathode) and, as such, may be referred to as a high resistance virtual anode (HRVA) in some contexts. As noted above, this element may also be referred to as a channeled ionically resistive plate (CIRP) when provided in plate form. Normally, the CIRP 206 is placed in close proximity with respect to the wafer. In contrast, an anode in the same close-proximity to the substrate would be significantly less apt to supply a nearly constant current to the wafer, but would merely support a constant potential plane at the anode metal surface, thereby allowing the current to be greatest where the net resistance from the anode plane to the terminus (e.g., to peripheral contact points on the wafer) is smaller. So while the channeled ionically resistive element 206 has been referred to as a high-resistance virtual anode (HRVA), this does not imply that electrochemically the two are interchangeable. Under the best operational conditions, the CIRP 206 would more closely approximate and perhaps be better described as a virtual uniform current source, with nearly constant current being sourced from across the upper plane of the CIRP 206. While the CIRP is certainly viewable as a "virtual current source", i.e., it is a plane from which the current is emanating, and therefore can be considered a "virtual anode" because it can be viewed as a location or source from which anodic current emanates, it is the relatively high-ionic-resistance of the CIRP 206 (with respect to the electrolyte) that leads the nearly uniform current across its face and to further advantageous, generally superior wafer uniformity when compared to having a metallic anode located at the same physical location. The plate's resistance to ionic current flow increases with increasing specific resistance of electrolyte contained within the various channels of the plate 206 (often but not always having the same or nearly similar resistance of the catholyte), increased plate thickness, and reduced porosity (less fractional cross sectional area for current passage, for example, by having fewer holes of the same diameter, or the same number of holes with smaller diameters, etc.).

Structure

The CIRP 206 contains micro size (typically less than 0.04") through-holes that are spatially and ionically isolated from each other and do not form interconnecting channels within the body of CIRP, in many but not all implementations. Such through-holes are often referred to as non-communicating through-holes. They typically extend in one dimension, often, but not necessarily, normal to the plated surface of the wafer (in some embodiments the non-communicating holes are at an angle with respect to the wafer which is generally parallel to the CIRP front surface). Often the through-holes are parallel to one another. Often the holes are arranged in a square array. Other times the layout is in an offset spiral pattern. These through-holes are distinct from 3-D porous networks, where the channels extend in three dimensions and form interconnecting pore structures, because the through-holes restructure both ionic current flow and fluid flow parallel to the surface therein, and straighten the path of both current and fluid flow towards the wafer surface. However, in certain embodiments, such a porous plate, having an interconnected network of pores, may be used in place of the 1-D channeled element (CIRP). When the distance from the plate's top surface to the wafer is small (e.g., a gap of about 1/10 the size of the wafer radius, for example less than about 5 mm), divergence of both current flow and fluid flow is locally restricted, imparted and aligned with the CIRP channels.

One example CIRP 206 is a disc made of a solid, non-porous dielectric material that is ionically and electrically resistive. The material is also chemically stable in the plating solution of use. In certain cases the CIRP 206 is made of a ceramic material (e.g., aluminum oxide, stannic oxide, titanium oxide, or mixtures of metal oxides) or a plastic material (e.g., polyethylene, polypropylene, polyvinylidene difluoride (PVDF), polytetrafluoroethylene, polysulphone, polyvinyl chloride (PVC), polycarbonate, and the like), having between about 6,000-12,000 non-communicating through-holes. The disc 206, in many embodiments, is substantially coextensive with the wafer (e.g., the CIRP disc 206 has a diameter of about 300 mm when used with a 300 mm wafer) and resides in close proximity to the wafer, e.g., just below the wafer in a wafer-facing-down electroplating apparatus. Preferably, the plated surface of the wafer resides within about 10 mm, more preferably within about 5 mm of the closest CIRP surface. To this end, the top surface of the channeled ionically resistive plate 206 may be flat or substantially flat. Often, both the top and bottom surfaces of the channeled ionically resistive plate 206 are flat or substantially flat.

Another feature of the CIRP 206 is the diameter or principal dimension of the through-holes and its relation to the distance between the CIRP 206 and the substrate. In certain embodiments, the diameter of each through-hole (or of a majority of through-holes, or the average diameter of the through-holes) is no more than about the distance from the plated wafer surface to the closest surface of the CIRP 206. Thus, in such embodiments, the diameter or principal dimension of the through holes should not exceed about 5 mm, when the CIRP 206 is placed within about 5 mm of the plated wafer surface.

As above, the overall ionic and flow resistance of the plate 206 is dependent on the thickness of the plate and both the overall porosity (fraction of area available for flow through the plate) and the size/diameter of the holes. Plates of lower porosities will have higher impinging flow velocities and ionic resistances. Comparing plates of the same porosity, one having smaller diameter 1-D holes (and therefore a larger number of 1-D holes) will have a more micro-uniform distribution of current on the wafer because there are more individual current sources, which act more as point sources that can spread over the same gap, and will also have a higher total pressure drop (high viscous flow resistance).

In certain cases, however, the ionically resistive plate 206 is porous, as mentioned above. The pores in the plate 206 may not form independent 1-D channels, but may instead form a mesh of through holes which may or may not interconnect. It should be understood that as used herein, the terms channeled ionically resistive plate and channeled ionically resistive element (CIRP) are intended to include this embodiment, unless otherwise noted.

In a number of embodiments, the CIRP 206 may be modified to include (or accommodate) an edge flow element. The edge flow element may be an integral part of the CIRP 206 (e.g., the CIRP and edge flow element together form a monolithic structure), or it may be a replaceable part installed on or near the CIRP 206. The edge flow element promotes a higher degree of cross flow, and hence shear on the substrate surface, near the edge of the substrate (e.g., near an interface between the substrate and the substrate holder). Without an edge flow element, an area of relatively low cross flow may develop near the interface of the substrate and substrate holder, for example due to the geometry of substrate and substrate holder, and the direction of electrolyte flow. The edge flow element may act to increase cross flow in this area, thereby promoting more uniform plating results across the substrate. Further details related to the edge flow element are presented below.

In some cases, the CIRP 206 includes a series of protuberances thereon, as shown in FIGS. 33A-33E, described further below. The protuberances may be provided in a variety of shapes.

Vertical Flow through the Through-Holes

The presence of an ionically resistive but ionically permeable element (CIRP) 206 close to the wafer substantially reduces the terminal effect and improves radial plating uniformity in certain applications where terminal effects are operative/relevant, such as when the resistance of electrical current in the wafer seed layer is large relative to that in the catholyte of the cell. The CIRP 206 also simultaneously provides the ability to have a substantially spatially-uniform impinging flow of electrolyte directed upwards at the wafer surface by acting as a flow diffusing manifold plate. Importantly, if the same element 206 is placed farther from the wafer, the uniformity of ionic current and flow improvements become significantly less pronounced or non-existent.

Figure 9:
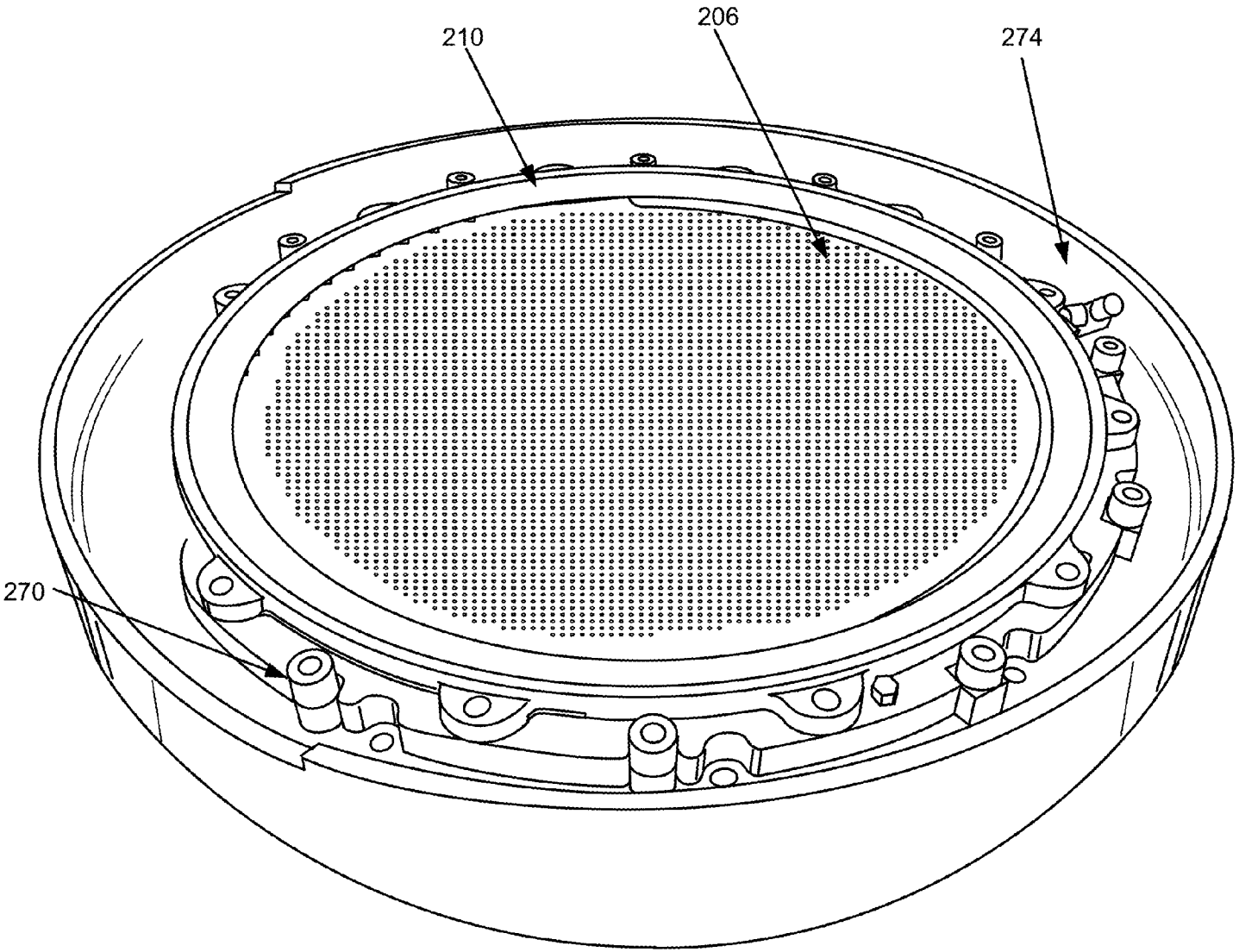
FIG. 9 shows an embodiment of a CIRP partially covered by a flow confinement ring and supported by a frame.

Further, because non-communicating through-holes do not allow for lateral movement of ionic current or fluid motion within the CIRP, the center-to-edge current and flow movements are blocked within the CIRP 206, leading to further improvement in radial plating uniformity. In the embodiment shown in FIG. 9, the CIRP 206 is a perforated plate having approximately 9000 uniformly spaced one-dimensional holes acting as microchannels and arranged in a square array (i.e., the holes are arranged in columns and rows) over the face of the plate (e.g., over a substantially circular area having a diameter of about 300 mm in the case of plating a 300 mm wafer) and with an effective average porosity of about 4.5%, and an individual microchannel hole size of about 0.67 mm (0.026 inches) in diameter. Also shown in FIG. 9 are the flow distribution adjustment rods 270, which may be used to preferentially direct flow to enter the cross flow manifold 226 either through the CIRP manifold 208 and up through the holes in the CIRP 206, or in through the cross flow injection manifold 222 and cross flow showerhead 242. The cross flow confinement ring 210 is fitted on top of the CIRP, which is supported by the membrane frame 274.

It is noted that in some embodiments, the CIRP plate 206 can be used primarily or exclusively as an intra-cell electrolyte flow resistive, flow controlling and thereby flow shaping element, sometimes referred to as a turboplate. This designation may be used regardless of whether or not the plate 206 tailors radial deposition uniformity by, for example, balancing terminal effects and/or modulating the electric field or kinetic resistances of plating additives coupled with the flow within the cell. Thus, for example, in TSV and WLP electroplating, where the seed metal thickness is generally large (e.g., >1000 Å thick) and metal is being deposited at very high rates, uniform distribution of electrolyte flow is very important, while radial non-uniformity control arising from ohmic voltage drop within the wafer seed may be less necessary to compensate for (at least in part because the center-to-edge non-uniformities are less severe where thicker seed layers are used). Therefore the CIRP plate 206 can be referred to as both an ionically resistive ionically permeable element, and as a flow shaping element, and can serve a deposition-rate corrective function by either altering the flow of ionic current, altering the convective flow of material, or both.

Distance between Wafer and Channeled Plate

In certain embodiments, a wafer holder 254 and associated positioning mechanism hold a rotating wafer very close to the parallel upper surface of the channeled ionically resistive element 206. During plating, the substrate is generally positioned such that it is parallel or substantially parallel to the ionically resistive element (e.g., within about 10°). Though the substrate may have certain features thereon, only the generally planar shape of the substrate is considered in determining whether the substrate and ionically resistive element are substantially parallel.

In typical cases, the separation distance is about 0.5-15 millimeters, or about 0.5-10 millimeters, or about 2-8 millimeters. In some cases, the separation distance is about 2 mm or less, for example about 1 mm or less. The separation distance between the wafer and the CIRP 206 corresponds to the height of the cross flow manifold. As mentioned above, this distance/height may be modulated during an electroplating process to promote a higher degree of mass transfer over the substrate surface.

The small plate to wafer distance can create a plating pattern on the wafer associated with proximity "imaging" of individual holes of the pattern, particularly near the center of wafer rotation. In such circumstances, a pattern of plating rings (in thickness or plated texture) may result near the wafer center. To avoid this phenomenon, in some embodiments, the individual holes in the CIRP 206 (particularly at and near the wafer center) can be constructed to have a particularly small size, for example less than about $1/5^{th}$ the plate to wafer gap. When coupled with wafer rotation, the small pore size allows for time averaging of the flow velocity of impinging fluid coming up as a jet from the plate 206 and reduces or avoids small scale non-uniformities (e.g., those on the order of micrometers). Despite the above precaution, and depending on the properties of the plating bath used (e.g., particular metal deposited, conductivities, and bath additives employed), in some cases deposition may be prone to occur in a micro-non-uniform pattern (e.g., forming center rings) as the time average exposure and proximity-imaging-pattern of varying thickness (for example, in the shape of a "bulls eye" around the wafer center) and corresponding to the individual hole pattern used. This can occur if the finite hole pattern creates an impinging flow pattern that is non-uniform and influences the deposition. In this case, introducing lateral flow across the wafer center, and/or modifying the regular pattern of holes right at and/or near the center, have both been found to largely eliminate any sign of micro-non-uniformities otherwise found there.

Porosity of Channeled Plate

In various embodiments, the channeled ionically resistive plate 206 has a sufficiently low porosity and pore size to provide a viscous flow resistance backpressure and high vertical impinging flow rates at normal operating volumetric flow rates. In some cases, about 1-25% of the channeled ionically resistive plate 206 is open area allowing fluid to reach the wafer surface. In particular embodiments, about 2-5% the plate 206 is open area. In another embodiment, between about 5-25%, or between about 10-25%, or between about 15-25%, or between about 15-20% of the plate 206 is open area. In a specific example, the open area of the plate 206 is about 3.2% and the effective total open cross sectional area is about 23 $cm^2$.

In cases where the height of the cross flow manifold is modulated, the CIRP should have a sufficiently low porosity to allow the modulation to achieve the desired electrolyte pumping effect. If the CIRP is too porous, the height modulation may not have the desired effect. Relatedly, in cases where the cross flow manifold is intermittently sealed during electroplating, the CIRP should be sufficiently resistant to flow through the CIRP to ensure that a substantial majority of the electrolyte flow originating from the side inlet remains within the cross flow manifold when the cross flow manifold is sealed (and/or unsealed). Otherwise, an unacceptably large portion of the electrolyte flow originating from the side inlet may flow downwards through the pores in the CIRP 206 into the CIRP manifold 208. After some period of time, such electrolyte may pass upwards through the pores in the CIRP 206 into the cross flow manifold 226, often at a more downstream location near the side outlet. This electrolyte flow away from the substrate is permissible to some degree, but should not be so great as to unacceptably reduce the cross flow over the plating face of the substrate. In some cases, the pores in the CIRP may be configured (e.g., at an appropriate size and density) to ensure that a maximum of about 20% of the electrolyte flow originating from the side inlet is able to pass through the pores in the CIRP and into the CIRP manifold. Generally speaking, the CIRP may be more porous in cases where the cross flow manifold is intermittently sealed, compared to more conventional cases where no such sealing occurs. In conventional cases, CIRP porosity was sometimes limited to about 5% or less. In various embodiments herein where the cross flow manifold is intermittently (or continuously) sealed, CIRP porosity may be greater, for example a maximum porosity of about 10%, or about 15%, or about 20%, or about 25%. In some such embodiments, the CIRP may have a minimum porosity of about 3%, or about 5%, or about 10%, or about 15%.

Hole Size of Channeled Plate

The porosity of the channeled ionically resistive plate 206 can be implemented in many different ways. In various embodiments, it is implemented with many vertical holes of small diameter. In some cases the plate 206 does not consist of individual "drilled" holes, but is created by a sintered plate of continuously porous material. Examples of such sintered plates are described in U.S. Pat. No. 6,964,792, which is herein incorporated by reference in its entirety. In some embodiments, drilled non-communicating holes have a diameter of about 0.01 to 0.05 inches. In some cases, the holes have a diameter of about 0.02 to 0.03 inches. As mentioned above, in various embodiments the holes have a diameter that is at most about 0.2 times the gap distance between the channeled ionically resistive plate 206 and the wafer. The holes are generally circular in cross section, but need not be. Further, to ease construction, all holes in the plate 206 may have the same diameter. However this need not be the case, and both the individual size and local density of holes may vary over the plate surface as specific requirements may dictate.

As an example, a solid plate 206 made of a suitable ceramic or plastic material (generally a dielectric insulating and mechanically robust material), having a large number of small holes provided therein, e.g., at least about 1000 or at least about 3000 or at least about 5000 or at least about 6000 (9465 holes of 0.026 inches diameter has been found useful). As mentioned, some designs have about 9000 holes. The porosity of the plate 206 is sometimes less than about 25 percent, or less than about 20 percent, or less than about 5 percent so that the total flow rate necessary to create a high impinging velocity is not too great. Using smaller holes helps to create a large pressure drop across the plate as compared to larger holes, aiding in creating a more uniform upward velocity through the plate.

Generally, the distribution of holes over the channeled ionically resistive plate 206 is of uniform density and non-random. In some cases, however, the density of holes may vary, particularly in the radial direction. In a specific embodiment, as described more fully below, there is a greater density and/or diameter of holes in the region of the plate that directs flow toward the center of the rotating substrate. Further, in some embodiments, the holes directing electrolyte at or near the center of the rotating wafer may induce flow at a non-right angle with respect to the wafer surface. Further, the hole patterns in this region may have a random or partially random distribution of non-uniform plating "rings" to address possible interaction between a limited number of holes and the wafer rotation. In some embodiments, the hole density proximate an open segment of a flow diverter or confinement ring 210 is lower than on regions of the channeled ionically resistive plate 206 that are farther from the open segment of the attached flow diverter or confinement ring 210.

Protuberances

In certain embodiments, the top face of the CIRP may be modified to increase the maximum deposition rate and improve plating uniformity both over the face of the wafer and within individual plating features. The modification on the top face of the CIRP may take the form of a collection of protuberances.

Figure 33A:
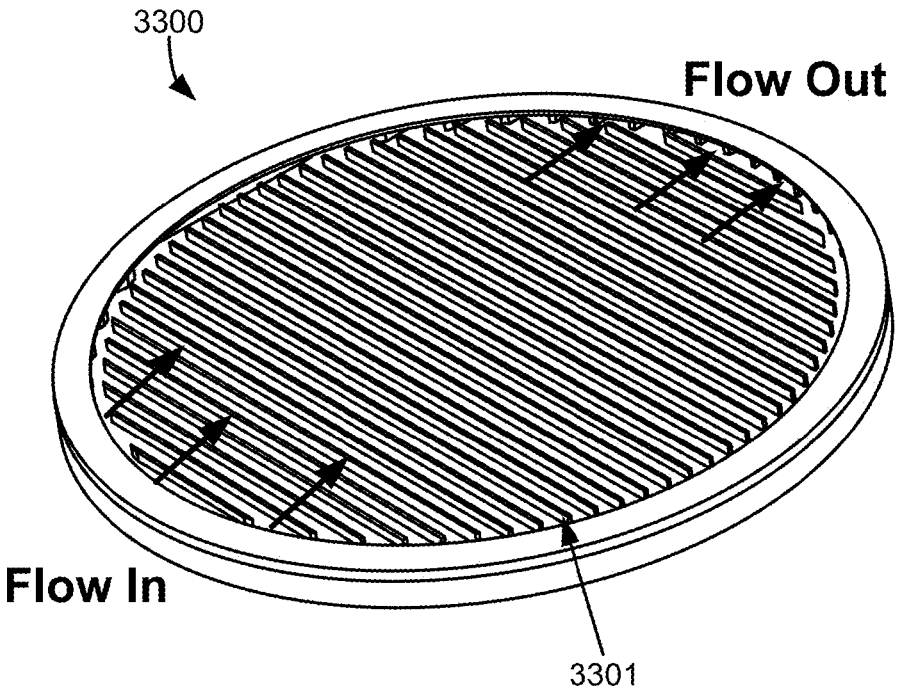
FIG. 33A illustrates a channeled ionically resistive element having a series of linear protuberances thereon.

A protuberance is defined as a structure that is placed/attached on a substrate-facing side of a CIRP that extends into the cross flow manifold between the CIRP plane and the wafer. The CIRP plane (also referred to as an ionically resistive element plane) is defined as the top surface of the CIRP, excluding any protuberances. The CIRP plane is where the protuberances are attached to the CIRP, and is also where fluid exits the CIRP into the cross flow manifold. FIG. 33A shows an isometric view of CIRP 3300 having linear protuberances 3301 oriented perpendicular to the direction of cross flow. The linear protuberances may also be referred to as ribs, and a CIRP having a series of ribs (as shown in FIG. 33A, for example) may be referred to as a ribbed CIRP. The CIRP 3300 may include a peripheral region where no protuberances are located, in order to allow catholyte to travel up and into the cross flow manifold. In many cases, the protuberances 3301 are substantially coextensive with the plating face of a substrate being plated (e.g., the diameter of the protuberance region on the CIRP may be within about 5%, or within about 1%, of the diameter of the substrate).

Figure 33B:
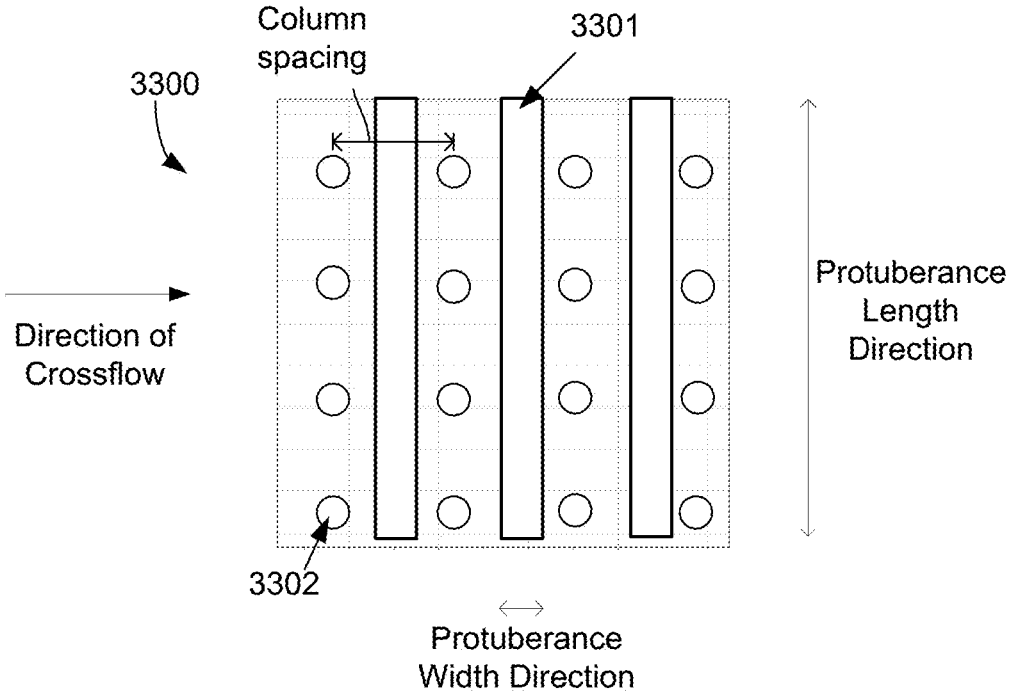
FIG. 33B depicts a close-up view of a portion of a channeled ionically resistive element having linear protuberances thereon.

The protuberances may be oriented in a variety of manners, but in many implementations the protuberances are in the form of long, thin ribs located between columns of holes in the CIRP, and oriented such that the length of the protuberance (i.e., its principal/longest dimension) is perpendicular to the cross flow through the cross flow manifold. A close-up top-down view of a CIRP 3300 having long thin linear protuberances 3301 between columns of CIRP holes 3302 is shown in FIG. 33B. The protuberances 3301 modify a flow field adjacent to the wafer to improve mass transfer to the wafer and improve the uniformity of the mass transfer over the entire face of the wafer. The protuberances may be machined into existing CIRP plates, in some cases, or they may be formed at the same time that a CIRP is fabricated. As shown in FIG. 33B, the protuberances 3301 may be arranged such that they do not block the existing 1-D CIRP through-holes 3302. In other words, the width of the protuberances 3301 may be less than the distance between each column of holes 3302 in the CIRP 3300. Where the protuberances are oriented such that their lengths are perpendicular to the direction of cross flowing electrolyte, the width of each protuberance 3301 may be measured in the direction of cross flowing electrolyte. FIG. 33B indicates the directions in which the length and width of the protuberances may be measured with respect to the direction of cross flowing electrolyte. The height of the protuberances in FIG. 33B extends out of the page.

In one example, the CIRP holes 3302 are located 2.69 mm apart, center-to-center, and the holes are 0.66 mm in diameter. Thus, the protuberances may be less than about 2 mm wide (2.69−2*(0.66/2) mm=2.03 mm). In certain cases, the protuberances may be less than about 1 mm wide. In certain cases, the protuberances have a length to width aspect ratio of at least about 3:1, or at least about 4:1, or at least about 5:1.

In many implementations, the protuberances are oriented such that their length is perpendicular or substantially perpendicular to the direction of cross flow across the face of the wafer (sometimes referred to as the "z" direction herein), as shown in FIG. 33B for instance. In certain cases, the protuberances are oriented at a different angle or set of angles.

A wide variety of protuberance shapes, sizes and layouts may be used. In some embodiments, the protuberances have a face which is substantially normal to the face of the CIRP, while in other implementations the protuberances have a face which is positioned at an angle relative to the face of the CIRP. In yet further implementations, the protuberances may be shaped such that they do not have any flat faces. Some embodiments may employ a variety of protuberance shapes and/or sizes and/or orientations.

Figure 33C:
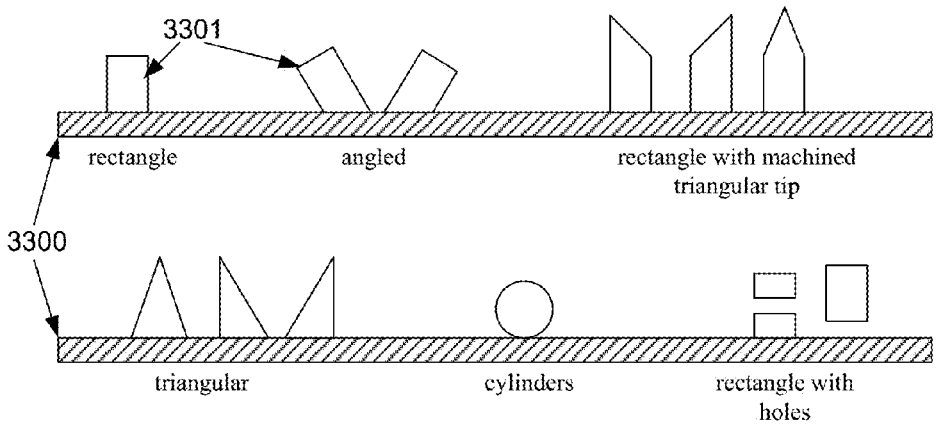
FIG. 33C illustrates various cross-sectional shapes that may be used for protuberances on a channeled ionically resistive element according to certain embodiments.

FIG. 33C provides examples of protuberance shapes, shown as cross sections of protuberances 3301 on CIRP 3300. In some implementations, the protuberances are generally rectangularly shaped. In other implementations, the protuberances have cross-sections that are triangular, cylindrical, or some combination thereof. The protuberances may also be generally rectangular with a machined triangular tip. In certain embodiments the protuberances may include holes through or on them, oriented substantially parallel to the direction of cross flow across the wafer.

Figure 33D:
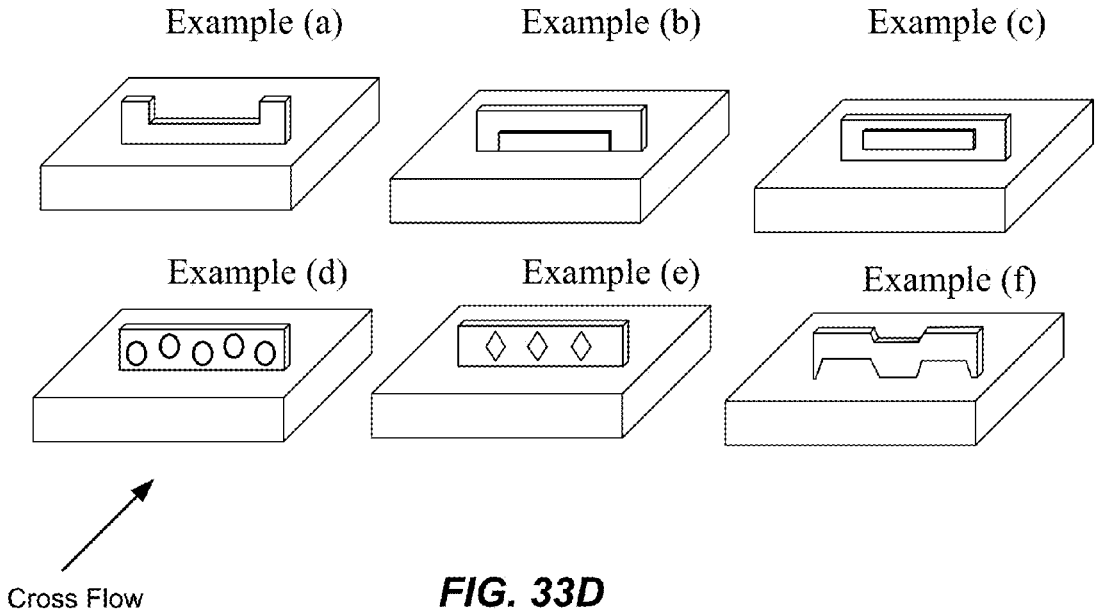
FIG. 33D shows a number of cutouts that may be present on protuberances in certain implementations.

FIG. 33D provides several examples of protuberances having different types of cutouts. These structures may also be referred to as flow relief structures, through-holes, holes, or cutout portions. A through-hole (or hole) is a type of cutout through which electrolyte can flow (see examples (b)-(e) and the lower cutouts of example (f)). By contrast, electrolyte may flow through or over a cutout (see example (a) and the upper cutouts of example (f) for cutouts that are not through-holes). These structures may help disrupt the flow pattern such that the flow is convoluted in all directions (x-direction, y-direction and z-direction)

With respect to FIG. 33D, example (a) shows a protuberance having a rectangular cutout at the top of the protuberance, example (b) shows a protuberance having a through-hole formed by a cutout near the bottom portion of the protuberance, example (c) shows a protuberance having a through-hole formed by a rectangular cutout in the middle of the height of the protuberance, example (d) shows a protuberance having a series of through-holes cut out in circle/oval patterns, example (e) shows a protuberance having a series of through-holes cut out in diamond patterns, and example (f) shows a protuberance having top and bottom portions alternately cut out in a trapezoid pattern, where the bottom cutouts form through-holes. The holes may be horizontally in line with one another, or they may be offset from one another as shown in examples (d) and (f).

CIRPs having protuberances thereon may be particularly beneficial when combined with plating techniques that modulate the height of the cross flow manifold. For example, small scale interaction of the protuberances with cross flow and modulation of the height of the cross flow manifold may create more mixing and turbulence within the features. The ribs/protuberances may preferentially increase the flow velocity in certain directions compared to others.

Figure 33E:
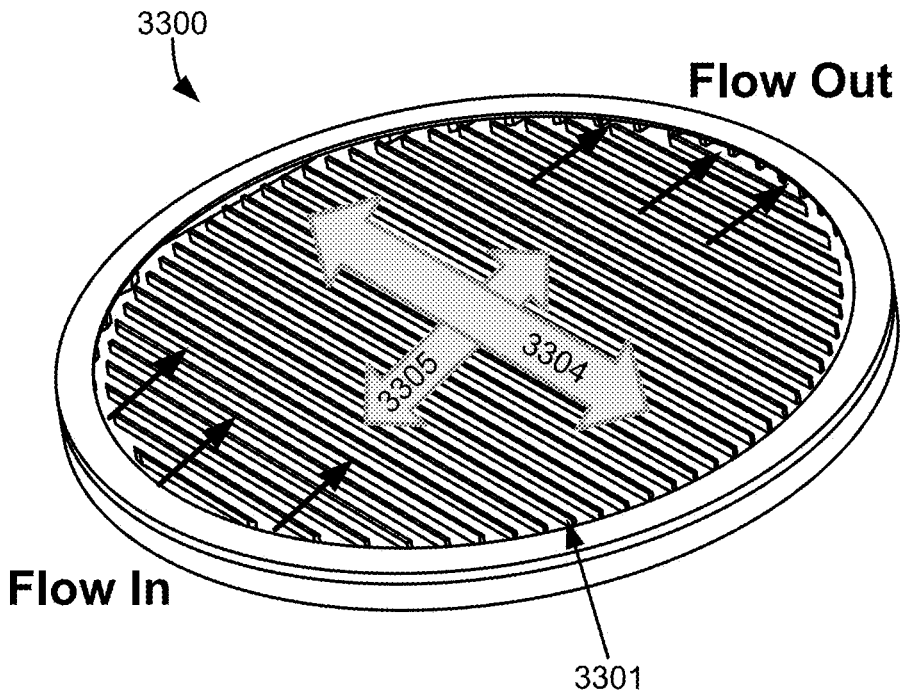
FIG. 33E shows a channeled ionically resistive element having a series of linear protuberances thereon similar to FIG. 33A, illustrating how the protuberances may preferentially direct electrolyte during electroplating when the height of the cross flow manifold is modulated.

FIG. 33E illustrates a CIRP 3300 having a series of linear protuberances 3301 thereon. Where the CIRP 3300 includes a series of protuberances 3301, modulating the height of the cross flow manifold may preferentially increase the flow velocity in the direction of the length/principal dimension of the protuberances. In effect, the protuberances may act as channels that preferentially direct the electrolyte perpendicular to the direction of the cross flowing electrolyte, as shown by arrow 3304 in FIG. 33E. Modulating the height of the cross flow manifold also increases the flow velocity in the direction parallel to the direction of cross flowing electrolyte, as shown by arrow 3305. However, the flow velocity increases more substantially in the direction perpendicular to cross flow and parallel to the length/principal dimension of the protuberances 3301. Therefore, arrow 3304 is shown to be larger than arrow 3305. This directionally preferential increase in flow velocity may promote improved plating results.

CIRPs having protuberances thereon are further discussed in U.S. patent application Ser. No. 14/103,395, which is herein incorporated by reference in its entirety.

Alternative Embodiments of the Tonically Resistive Element

In various embodiments, the ionically resistive element may have properties that differ from those described above. For instance, while much of the foregoing description has referred to the channeled ionically resistive element as a plate, the ionically resistive element can also be provided as a membrane, filter, or other porous structure. Examples of porous structures that may be used as ionically resistive elements include, but are not limited to, ionically resistive membranes and filters, nano-porous cationic membranes, and other porous plates and membranes having appropriate ionic resistivity. Broadly, such ionically resistive elements may shaped, sized, positioned, and have the same or similar properties as described above in relation to a channeled ionically resistive plate. As such, any description provided herein (e.g., in relation to size, porosity, ionic resistivity, materials, etc.) in relation to a channeled ionically resistive plate may also apply to a different ionically resistive element used in place of a CIRP.

Such structures may also have certain properties that differ from those described herein with respect to the CIRP. For instance, an ionically resistive membrane used in place of a CIRP may be thinner than a typical CIRP. In certain implementations, a porous structure used in place of a CIRP may be provided on a scaffold or other structure for structural stability. In some embodiments, the ionically resistive element may have through-holes that communicate with one another, while in other cases the through-holes may be non-communicating.

In cases where the cross flow manifold is defined between the substrate and a supported membrane or sintered element structure (e.g., a supported filter media, a fritted glass or porous ceramic element), the pore sizes of each pore may be less than about 0.01". For non-drilled continuously porous materials of this class, the open area may be larger (e.g., an open area greater than about 30%, with a maximum open area of about 50% or 40% in some embodiments) than the open area in channeled plates made by drilling individual holes in a solid piece of material. Ionically resistive structures made of non-drilled continuously porous materials may utilize a much smaller pore size (e.g., compared to a drilled CIRP) to impart viscous flow resistance to avoid having the electrolyte flow short circuiting through the membrane/element surface. There is a balance between pore size, open area, and net flow resistance to avoid flow-short-circuiting. Higher porosity materials/structures typically utilize smaller pores and/or greater element thickness to achieve this balance.

One example of a suitable material of this class would be a sheet of mechanically strong filter media stretched tight across and supported from below by an open frame network, with an average pore size of less than about 5 μm, and a porosity of about 35% or less and 0.001" thick or greater. A few specific examples of appropriate sheet membranes include SelRO nanofiltration MPF-34 membranes, HKF-328 polysulfone ultrafiltration membranes, and MFK-618 0.1 μm pore size polysulfone membranes, all supplied by Koch Membrane systems of Willington, Mass. Cationic and anionic membranes can also be used (e.g., Nafion™), as they provide high flow resistance and an ability to conduct ionic electricity across the membranes. In the case where the ionically resistive element is a sintered (fritted) porous glass or ceramic element, the thickness of the element as well as the average and maximum pore size determine the resistance to flow through the ionically resistive element. In general, the resistance to flow through the ionically resistive element (whether implemented as a membrane, filter, sintered/fritted glass element, porous ceramic element, CIRP, etc.) should allow less than about 100 ml/min per $cm^2$ of surface area per inch of static water pressure, more commonly less than about 20 ml/min/$cm^2$/in of water, such as less than about 5 ml/min/$cm^2$/in of water.

Edge Flow Element

In many implementations, electroplating results may be improved through the use of an edge flow element and/or a flow insert. Generally speaking, an edge flow element affects the flow distribution near the periphery of the substrate, proximate the interface between the substrate and substrate holder. In some embodiments, the edge flow element may be integral with a CIRP. In some other embodiments, the edge flow element may be integral with a substrate holder. In yet other embodiments, the edge flow element may be a separate piece that can be installed on a CIRP or substrate holder. The edge flow element may be used to tune the flow distribution near the edge of the substrate, as is desired for a particular application. Advantageously, the flow element promotes a high degree of cross flow near the periphery of the substrate, thereby promoting more uniform (from center to edge of the substrate), high quality electroplating results. An edge flow element is typically positioned, at least partially, radially inside of the inner edge of the substrate holder/the periphery of the substrate. In some cases, an edge flow element may be at least partially positioned at other locations, for example under the substrate holder and/or radially outside of the substrate holder, as described further below. In a number of drawings herein, the edge flow element is referred to as the "flow element."

The edge flow element may be made of various materials. In some cases, the edge flow element may be made of the same material as the CIRP and/or the substrate holder. Generally speaking, it is desirable for the material of the edge flow element to be electrically insulating.

Another method for improving cross flow near the periphery of the substrate is to use a high rate of substrate rotation. However, fast substrate rotation presents its own set of disadvantages, and in various embodiments may be avoided. For example, where the substrate is rotated too quickly, it can prevent formation of an adequate cross flow across the substrate surface. In certain embodiments, therefore, the substrate may be rotated at a rate between about 50-300 RPM, for example between about 100-200 RPM. Similarly, cross flow near the periphery of the substrate can be promoted by using a relatively smaller gap between the CIRP and the substrate. However, smaller CIRP-substrate gaps result in electroplating processes that are more sensitive and have tighter tolerance ranges for process variables.

Figure 13A:
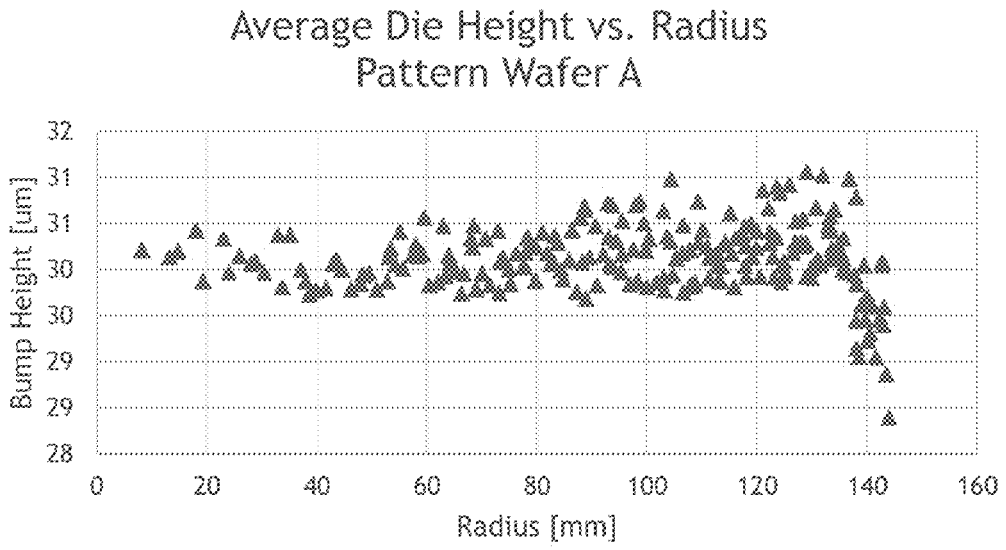
FIGS. 13A and 13B present experimental results showing bump height vs. radial position on the substrate, illustrating problems related to a low plating rate near the periphery of the substrate.
Figure 13B:
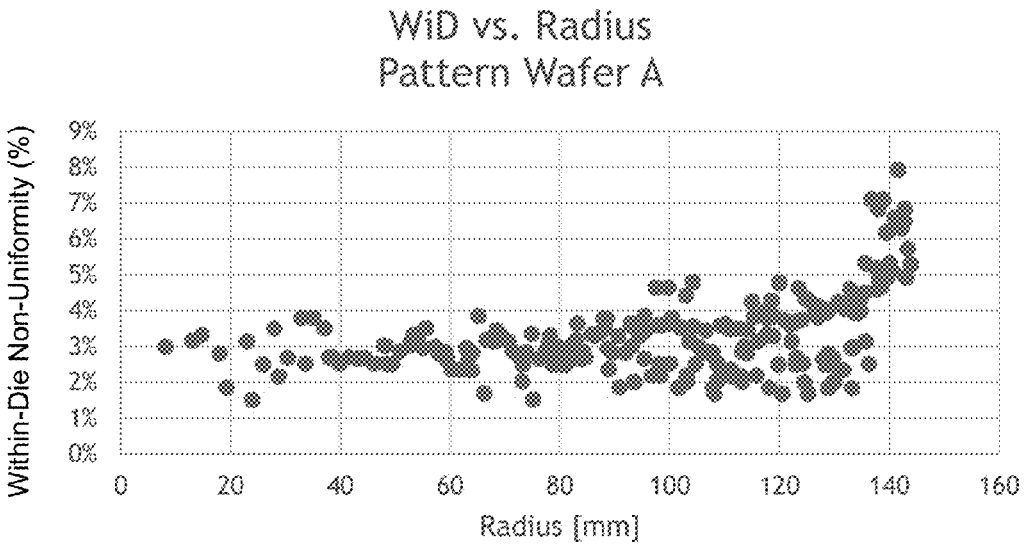

FIG. 13A presents experimental results showing bump height vs. radial position on the substrate for patterned substrates electroplated without an edge flow element. FIG. 13B presents experimental results showing within-die non-uniformity vs. radial position on the substrate for the patterned substrates described in relation to FIG. 13A. Notably, the bump height decreases toward the edge of the substrate. Without wishing to be bound by theory or mechanism of action, it is believed that this low bump height is a result of relatively low electrolyte flow near the periphery of the substrate. The poor convection conditions near the substrate-substrate holder interface lead to a lower local metal concentration, which leads to a reduced plating rate. Further, photoresist is often thicker near the edge of a substrate, and this increased photoresist thickness leads to deeper features, for which it is more difficult to achieve adequate convection, thereby leading to a lower plating rate at the edge of the substrate. As shown in FIG. 13B, this decreasing plating rate/decreased bump height near the edge of the substrate corresponds with an increase in within-die non-uniformity. The within-die non-uniformity was calculated as the ((max bump height in a die)−(min bump height in the die))/(2*average bump height in the die).

Figure 14A:
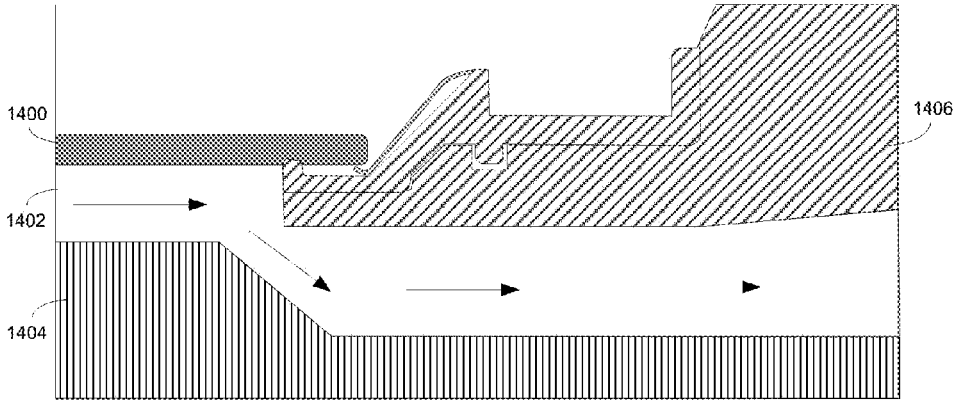
FIG. 14A depicts a cross-sectional view of a portion of an electroplating apparatus.
Figure 14B:
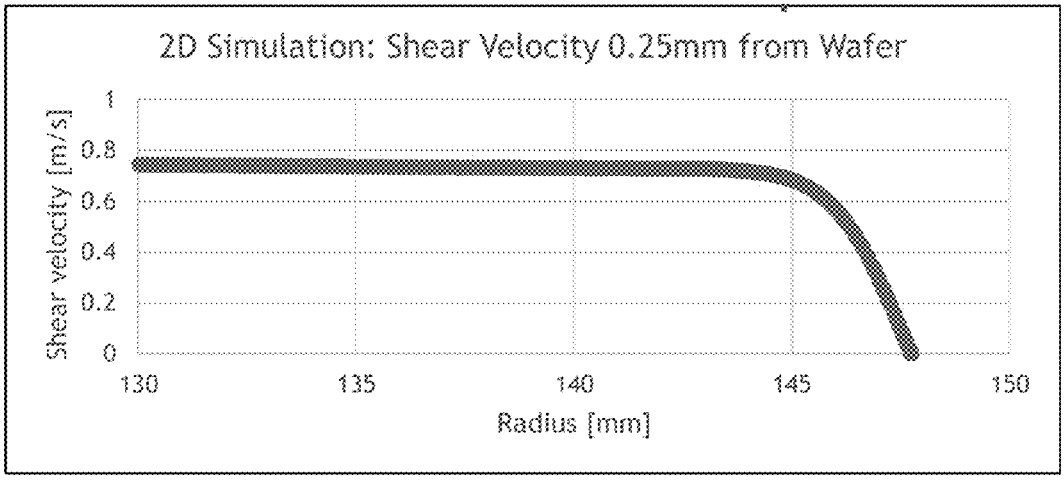
FIG. 14B shows modeling results related to the flow through the apparatus depicted in FIG. 14A.

FIG. 14A depicts the structure of an electroplating apparatus near the periphery of the substrate 1400 at the outlet side of the apparatus. Electrolyte exits the cross flow manifold 1402 by flowing over the CIRP 1404 and under the substrate 1400, and out under the substrate holder 1406, as shown by the arrows. In this example, the CIRP 1404 has a substantially flat portion that sits under the substrate 1400. At the edge of this region, near the interface between the substrate 1400 and substrate holder 1406, the CIRP 1404 angles downward, then flattens out again. FIG. 14B depicts a graph presenting modeling results related to the flow distribution between the substrate 1400 and the CIRP 1404 in the region shown in FIG. 14A.

The modeling results show the predicted shear velocity at a location 0.25 mm from the surface of the substrate. Notably, the shear flow decreases dramatically near the edge of the substrate.

Figure 15:
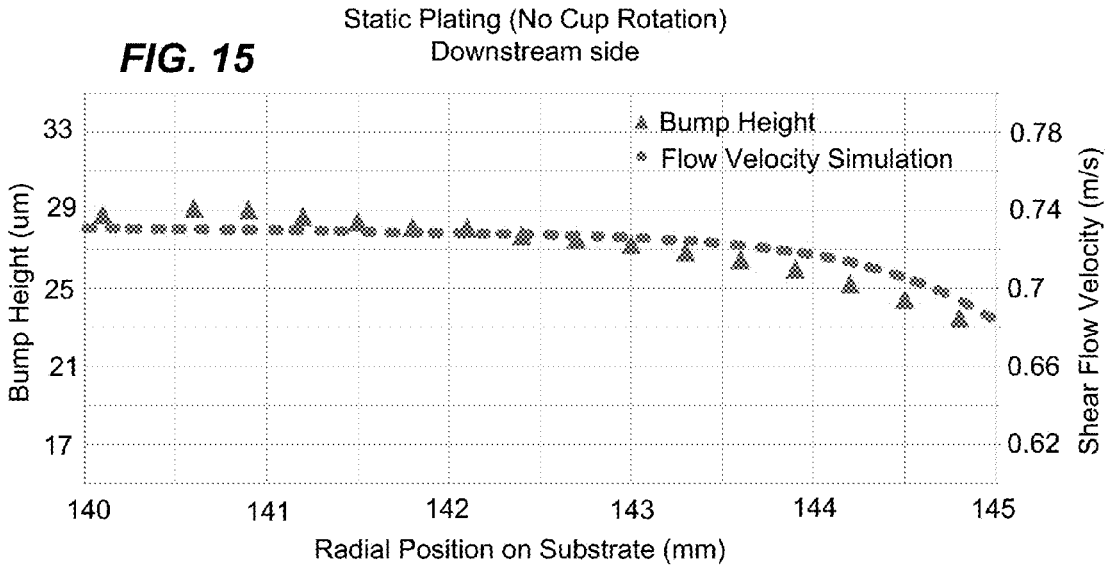
FIG. 15 depicts modeling results related to shear flow velocity vs. radial position on the substrate and experimental results related to bump height vs. radial position on the substrate, showing a lower degree of plating near the periphery of the substrate.

FIG. 15 depicts experimental results related to bump height vs. radial position on the substrate, and modeling results showing the shear flow vs. radial position on the substrate (on the electrolyte outlet side). In this example, the substrate was not rotated during plating. The experimental bump height results followed the same trend as the predicted shear velocity, indicating that the lower shear velocity likely plays a role in low edge bump height.

Figure 16A:
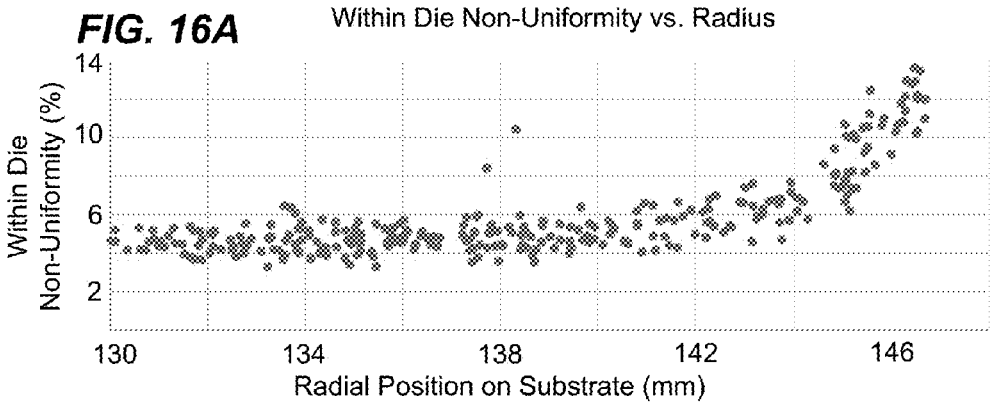
FIGS. 16A and 16B show experimental results related to within-die thickness non-uniformity (FIG. 16A) and photoresist thickness (FIG. 16B) at different radial positions on the substrate.
Figure 16B:
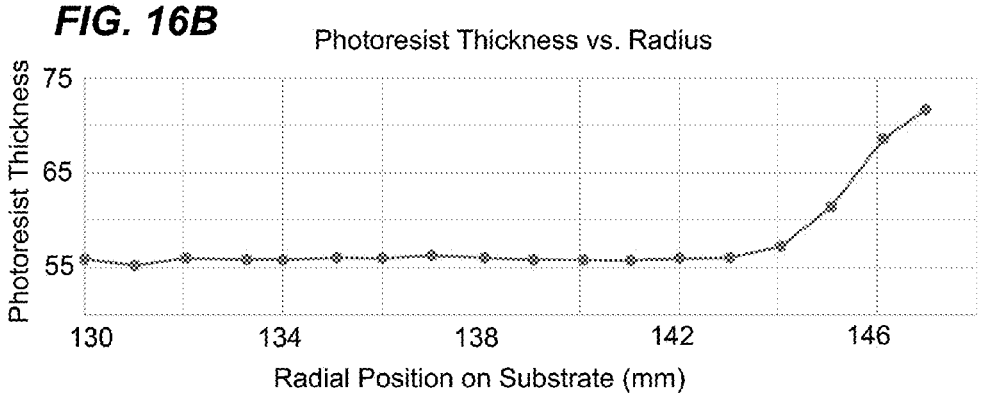

FIG. 16A depicts experimental results showing within-die non-uniformity vs. radial position on the substrate. FIG. 16B depicts experimental results showing the thickness of photoresist vs. radial position on the substrate. Together, FIGS. 16A and 16B suggest there is a strong correlation between photoresist thickness and within-die non-uniformity, with higher resist thickness and non-uniformity being found near the edge of the substrate.

Figure 17A:
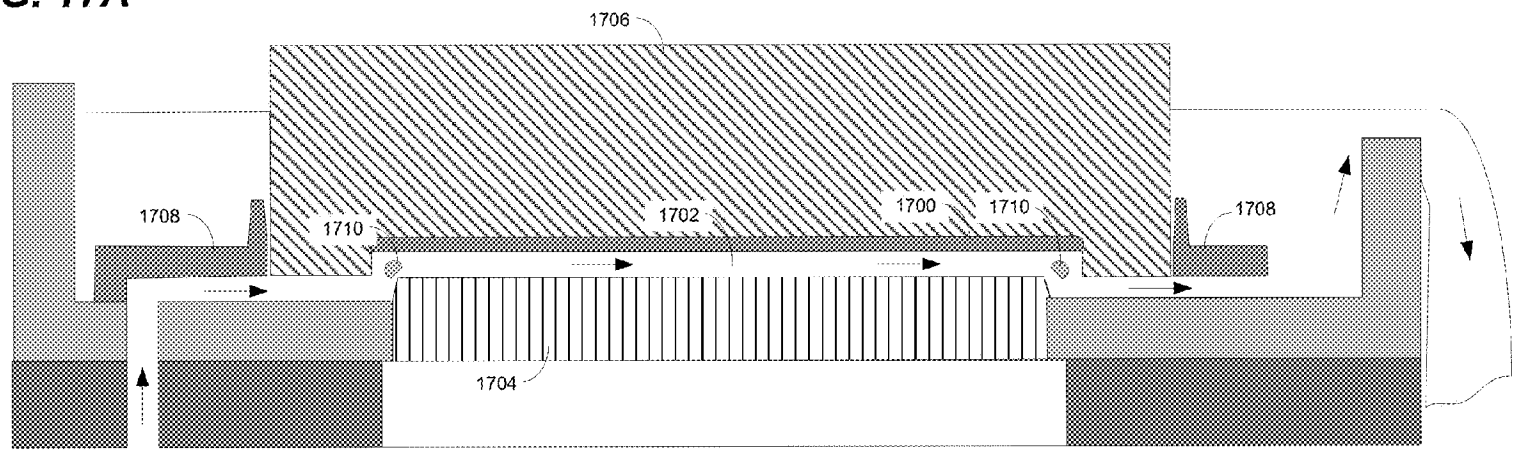
FIGS. 17A and 17B depicts a cross-sectional view of an electroplating apparatus according to one embodiment where an edge flow element is used.
Figure 17B:
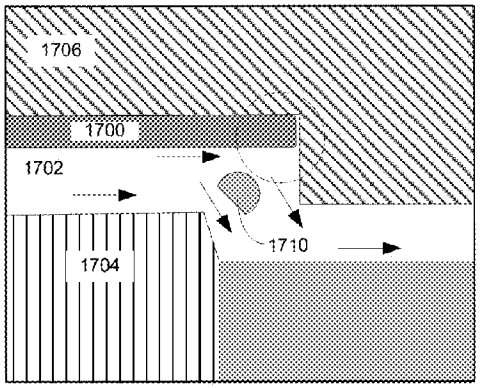

FIG. 17A illustrates a cross-sectional view of an electroplating cell having an edge flow element 1710 installed therein. The edge flow element 1710 is situated under the edge of the substrate 1700, proximate the interface between the substrate 1700 and substrate holder 1706. In this example, the CIRP 1704 is shaped to include a raised plateau region which is nearly coextensive with the substrate 1700. In certain embodiments, an edge flow element 1710 may be positioned, wholly or partially, radially outside of the raised portion of the CIRP 1704. The edge flow element 1710 may also be positioned, wholly or partially, on the raised portion of the CIRP 1704. Electrolyte flows through the cross flow manifold 1702 as shown by the arrows. A flow diverter 1708 helps shape the path through which the electrolyte flows. The flow diverter 1708 is shaped differently at the inlet side (where the cross flow originates) compared to the outlet side to promote cross flow across the surface of the substrate.

As shown in FIG. 17A, electrolyte enters the cross flow manifold 1702 on the inlet side of the electroplating cell. The electrolyte flows around the edge flow element 1710, through the cross flow manifold 1702, around the edge flow element 1710 a second time, and out through an outlet. As mentioned above, electrolyte also enters the cross flow manifold 1702 by traveling upwards through holes in the CIRP 1704. One purpose of the edge flow element 1710 is to increase convection at the interface between the substrate 1700 and the substrate holder 1706. This interface is shown in greater detail in FIG. 17B. Without the use of an edge flow element 1710, the convection in the region shown in the dotted circle is undesirably low. The edge flow element 1710 affects the flow path of electrolyte near the edge of the substrate 1700, promoting greater convection in the region shown in the dotted circle. This helps overcome low convection and low plating rates near the substrate edge. This may also help combat differences that arise due to differing photoresist/feature height, as explained in relation to FIGS. 16A and 16B.

In certain embodiments, the edge flow element 1710 may be shaped such that the cross flow in the cross flow manifold 1702 is directed more favorably into the corner formed by the substrate 1700 and substrate holder 1706. A variety of shapes may be used to achieve this purpose.

FIGS. 18A-18C depict three available configurations for installing an edge flow element 1810 in an electroplating cell. Various other configurations may be used, as well. Regardless of the exact configuration, the edge flow element 1810 may be shaped like a ring or arc in many cases, though FIGS. 18A-18C only show a cross-sectional view of one side of the edge flow element 1810. In the first configuration (Type 1, FIG. 18A), the edge flow element 1810 is attached to the CIRP 1804. The edge flow element 1810 in this example does not include any flow bypass for electrolyte to flow between the edge flow element 1810 and the CIRP 1804. As such, all the electrolyte flows over the edge flow element 1810. In the second configuration (Type 2, FIG. 18B), the edge flow element 1810 is attached to the CIRP 1804 and includes a flow bypass between the edge flow element and the CIRP. The flow bypass is formed by passages in the edge flow element 1810. These passages permit some amount of electrolyte to flow through the edge flow element 1810 (between the upper corner of the edge flow element 1810 and the CIRP 1804). In the third configuration (Type 3, FIG. 18C), the edge flow element 1810 is attached to the substrate holder 1806. In this example, electrolyte may flow between the edge flow element 1810 and the CIRP 1804. Further, passages in the edge flow element 1810 permit flow of electrolyte through the edge flow element 1810, very near the interface between the substrate 1800 and the substrate holder 1806. FIG. 18D presents a table summarizing some of the features of the edge flow elements shown in FIGS. 18A-18C.

Figure 19A:
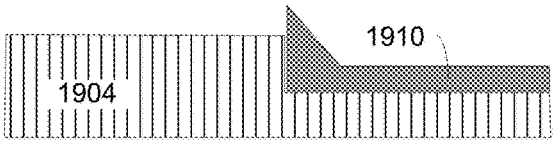
FIGS. 19A-19E illustrate methods for adjusting an edge flow element in an electroplating apparatus.

FIGS. 19A-19E present examples for different methods of achieving adjustability in an edge flow element 1910. In some embodiments, the edge flow element 1910 may be installed at a fixed location, e.g., on the CIRP 1904, and have a fixed geometry, as shown in FIG. 19A. However, in many other cases, there may be additional flexibility in the way the edge flow element is installed/used. For example, in some cases the position/shape of the edge flow element may be adjusted (manually or automatically), either between electroplating processes (e.g., to tune a particular plating process, as desired, compared to other plating processes), or within an electroplating process (e.g., to tune plating parameters over time within a single plating process).

Figure 19B:
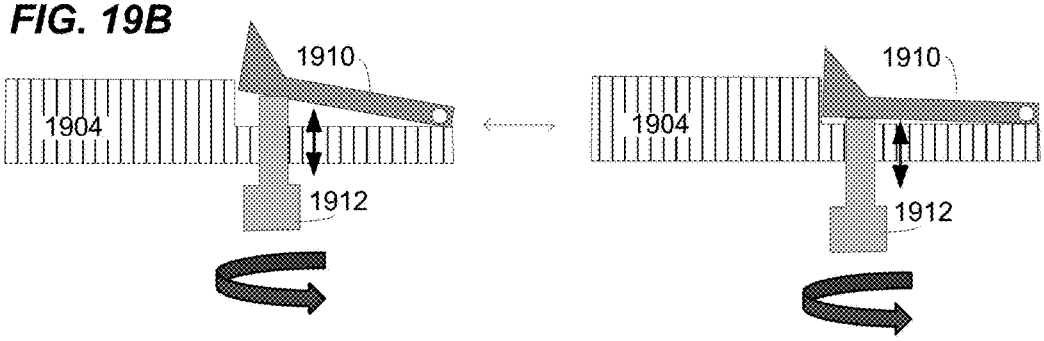
Figure 19C:
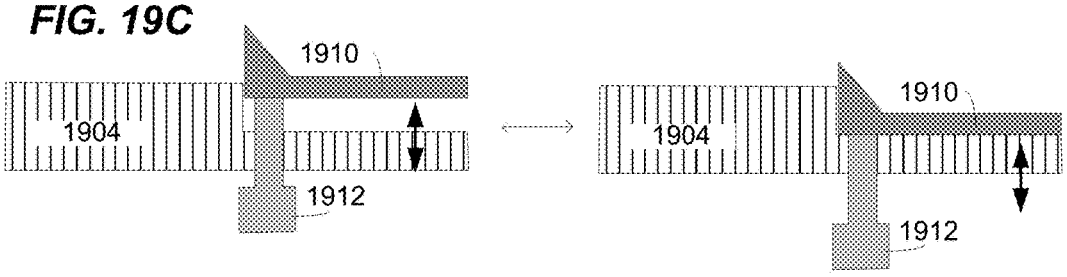

In one example, shims may be used to adjust the position (and to some degree shape) of an edge flow element. For instance, a series of shims may be provided, with shims of various heights for different applications and desired flow patterns/characteristics. The shims may be installed between the CIRP and the edge flow element to raise the height of the edge flow element, thereby reducing the distance between the edge flow element and the substrate/substrate holder. In some cases, the shims may be used in an azimuthally asymmetric way, thereby achieving a different edge flow element height at different azimuthal locations. The same result can be achieved using screws (as shown by element 1912 in FIGS. 19B and 19C) or other mechanical features to position the flow shaping element. FIGS. 19B and 19C illustrate two embodiments where screws 1912 may be used to control the position of the edge flow element 1910. As with the shims, the screws 1912 (located at different positions along the edge flow element 1910) may be positioned in a way that results in azimuthally asymmetric positioning of the edge flow element 1910 (e.g., by positioning the screws 1912 at different heights). In each of FIGS. 19B and 19C, the edge flow element 1910 is shown at two different positions. In FIG. 19B, the edge flow element changes between the two (or more) positions by rotating about a pivot point. In FIG. 19C, the edge flow element changes between the two (or more) positions by moving the edge flow element in a linear manner. Additional screws or other positioning mechanisms may be provided for extra support.

Figure 19D:
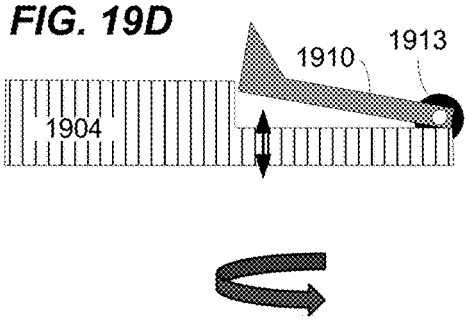
Figure 19E:
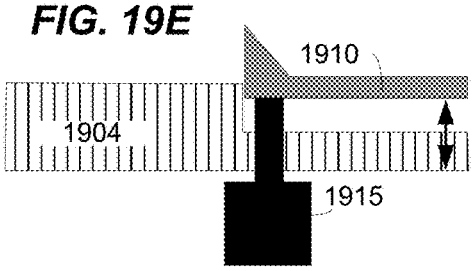

In some implementations, the position and/or shape of the edge flow element 1910 may be dynamically adjusted during a plating process, for example using electric or pneumatic actuators. FIGS. 19D and 19E present embodiments where the edge flow element 1910 can by dynamically moved, even during an electroplating process, using a rotary actuator 1913 (FIG. 19D) or a linear actuator 1915 (FIG. 19E). Such adjustments allow for precise control of the electrolyte flow over time, thereby allowing a high degree of tunability and promoting high quality plating results.

Returning to FIG. 18D, the first and second configurations shown in FIGS. 18A and 18B, respectively, allow for the edge flow element 1810 to be azimuthally asymmetric because the edge flow element 1810 is attached to the CIRP 1804 (which typically does not rotate during plating). The asymmetry may relate to differences in shape between portions of the edge flow element 1810 that are positioned near the inlet side of the electroplating cell vs. portions of the edge flow element that are positioned elsewhere, for example near the outlet side of the electroplating cell. Such azimuthal asymmetries may be used to combat non-uniformities that arise due to the way electrolyte cross flows across the substrate surface during electroplating. Such asymmetry may relate to differences in a number of characteristics in the shape of the edge flow element 1810, for example height, width, roundness/sharpness of edges, presence of flow bypass passages, vertical position, horizontal/radial position, etc. The third configuration shown in FIG. 18C, being installed on the substrate holder 1806, may also be azimuthally asymmetric. However, because in many embodiments the substrate 1800 and substrate holder 1806 rotate during electroplating, any asymmetry in the edge flow element 1810 would likely average-out due to the fact that the edge flow element 1810 rotates with the substrate 1800 during electroplating (at least in cases where the edge flow element is attached to the substrate holder 1806, as in the embodiment of FIG. 18C). As such, it is generally not as beneficial to have an azimuthally asymmetric edge flow element when the edge flow element is attached to, and rotates with, the substrate holder. For this reason, FIG. 18D lists "No*" in relation to azimuthal asymmetry for the third configuration. All of the configurations described are considered to be within the scope of the present embodiments.

Figure 20A:
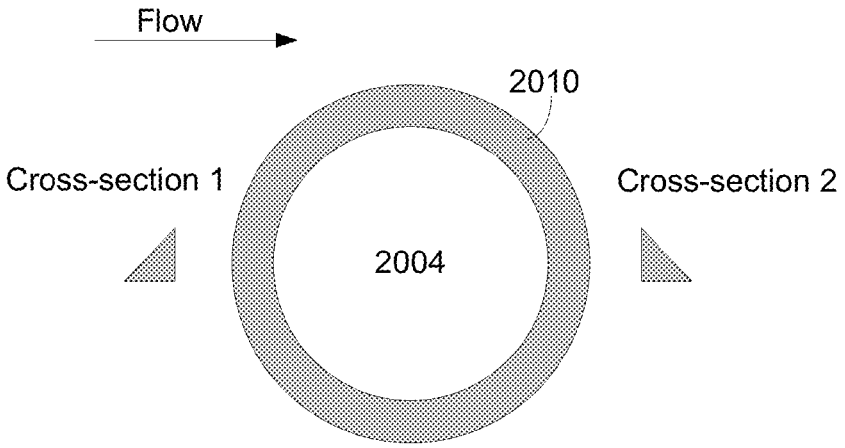
FIGS. 20A-20C illustrate several types of edge flow elements that may be used according to various embodiments, some of which are azimuthally asymmetric.
Figure 20B:
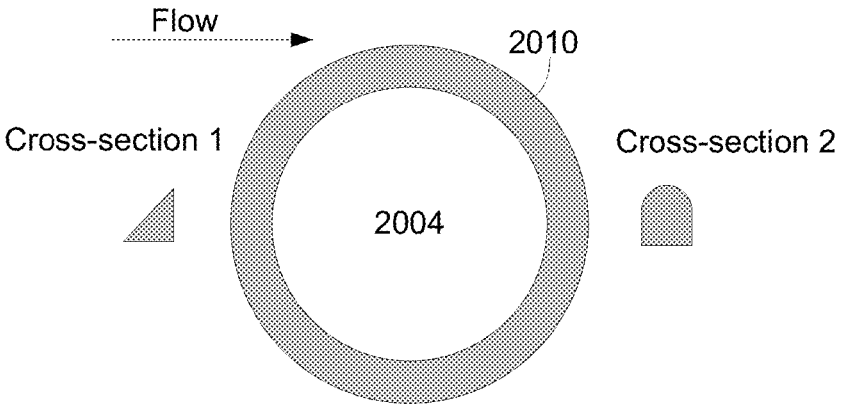
Figure 20C:
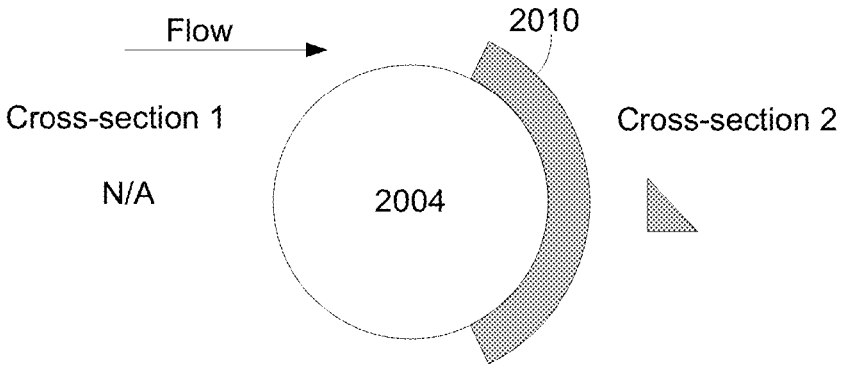

FIGS. 20A-20C illustrate a number of ways in which the edge flow element 2010 may be azimuthally asymmetric. FIGS. 20A-20C depict top views of an edge flow element 2010 positioned in an electroplating cell, for example on a CIRP 2004. Other attachment methods may also be used, as discussed above. In each example, the cross-sectional shape of the edge flow element 2010 is shown. In FIG. 20A, the edge flow element 2010 is azimuthally symmetric and extends around the entire perimeter of the substrate. Here, the edge flow element 2010 has a triangular cross-section, with the tallest portion positioned toward the inside edge of the edge flow element 2010. In FIG. 20B, the edge flow element is azimuthally asymmetric and extends around the entire perimeter of the edge flow element 2010. Here, the azimuthal asymmetry results because the edge flow element has a first cross-sectional shape (e.g., triangular) near the electrolyte inlet, and a second cross-sectional shape (e.g., rounded pillar) near the electrolyte outlet (positioned opposite the inlet).

In similar embodiments, any combination of cross-sectional shapes may be used. Generally speaking, the cross-sectional shapes may be any shapes including, but not limited to, triangular, square, rectangular, circular, ellipsoidal, rounded, curved, pointed, trapezoidal, corrugated, hourglass shaped, etc. Flow through passages may or may not be provided through the edge flow element 2010 itself. In another similar embodiment, the cross-sectional shapes may be similar, but of varying sizes around the periphery, thus introducing the azimuthal asymmetry. Likewise, the cross-sectional shapes may be the same or similar, but positioned at different vertical and/or horizontal locations with respect to the substrate/substrate holder and/or CIRP 2004. The transition to different cross-sectional shapes may be abrupt or gradual. In FIG. 20C, the edge flow element 2010 is only present at certain azimuthal locations. Here, the edge flow element 2010 is only present on the downstream (outlet) side of the plating cell. In a similar embodiment, the edge flow element may only be present on the upstream (inlet) side of the plating cell. Azimuthally asymmetric edge flow elements may be particularly advantageous for tuning electroplating results to overcome any asymmetries that may arise as a result of cross flowing electrolyte. This helps promote uniform, high quality plating results. As should be apparent, the azimuthal asymmetry may result from azimuthal variations in edge flow element shape, dimensions (e.g., height and/or width), position with respect to the substrate edge, bypass region presence or configuration, and the like.

With respect to FIG. 20C, in certain embodiments an arc-shaped edge flow element 2010 may extend at least about 60°, at least about 90°, at least about 120°, at least about 150°, at least about 180°, at least about 210°, at least about 240°, at least about 270°, or at least about 300° proximate the periphery of the substrate. In these or other embodiments, the arc-shaped edge flow element may extend no more than about 90°, no more than about 120°, no more than about 150°, no more than about 180°, no more than about 210°, no more than about 240°, no more than about 270°, no more than about 300°, or no more than about 330°. The center of the arc may be positioned proximate the inlet area, the outlet area (opposite the inlet area), or at some other location offset from the inlet/outlet areas. In certain other embodiments where azimuthal asymmetries are used, the arc shapes described in this paragraph may correspond to the size of a region exhibiting such asymmetry. For example, a ring-shaped edge flow element may have an azimuthal asymmetry as a result of having different shim heights installed at different positions along the edge flow element, as explained with reference to FIG. 22 (further described below), for instance. In some such embodiments, a region having relatively thicker or thinner shims (thus resulting in a relatively taller or shorter edge flow element, respectively, after installation) may span an arc having any of the minimum and/or maximum dimensions described above. In one example, a region having relatively larger shims spans at least about 60°, and no more than about 150°. Any combination of the listed arc dimensions may be used, and the azimuthal asymmetry present may be any type of asymmetry described herein.

Figure 21:
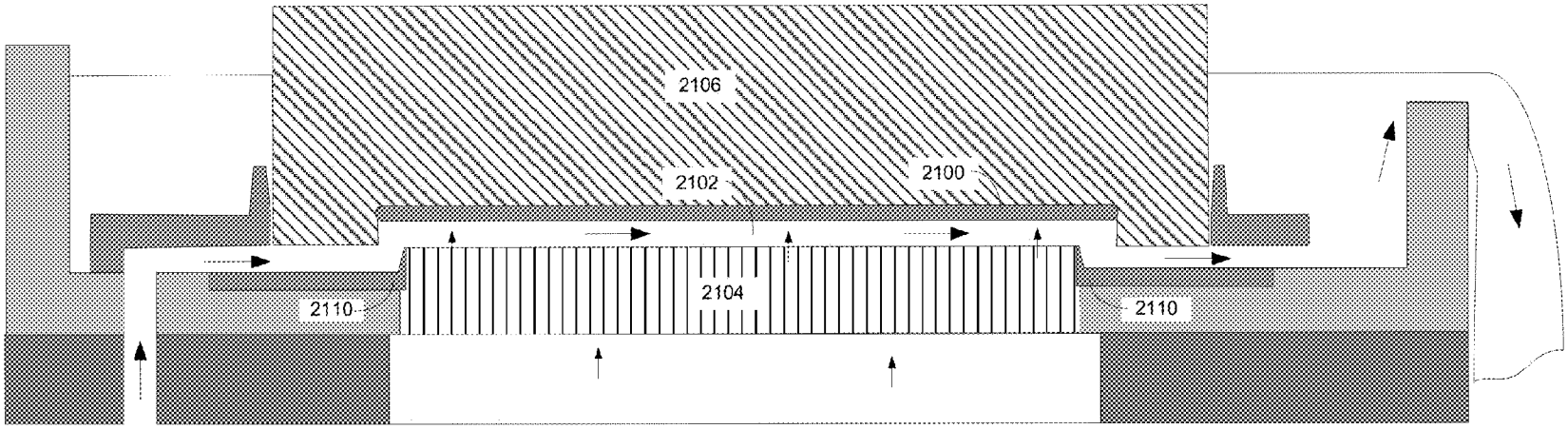
FIG. 21 illustrates a cross-sectional view of an electroplating cell according to certain embodiments where an edge flow element and top flow insert are used.

FIG. 21 depicts a cross-sectional view of an electroplating cell having an edge flow element 2110 installed therein. In this example, the edge flow element 2110 is positioned radially outside of the raised plateau portion of the CIRP 2104. The shape of the edge flow element 2110 allows electrolyte near the inlet to travel upwards at an angle to reach the cross flow manifold 2102, and similarly, allows electrolyte near the outlet to travel downwards at an angle to exit the cross flow manifold 2102. As shown in FIGS. 19A-19E, the uppermost portion of the edge flow element may extend above the plane of the raised portion of the CIRP. In other cases, the uppermost portion of the edge flow element may be flush with the raised portion of the CIRP 2104. In some cases, the position of the edge flow element is adjustable, as described elsewhere herein. The shape and position of the edge flow element 2110 may promote a higher degree of cross flow near the corner formed between the substrate 2100 and substrate holder 2106.

Figure 22B:
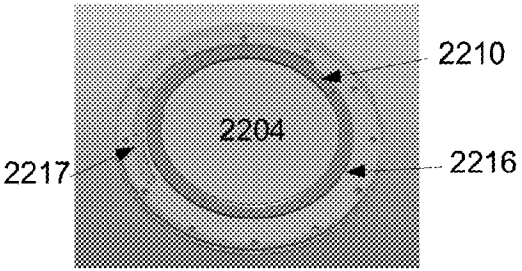
FIGS. 22A and 22B depicts a channeled ionically resistive plate (CIRP) having a groove therein, into which an edge flow element is installed.
Figure 22A:
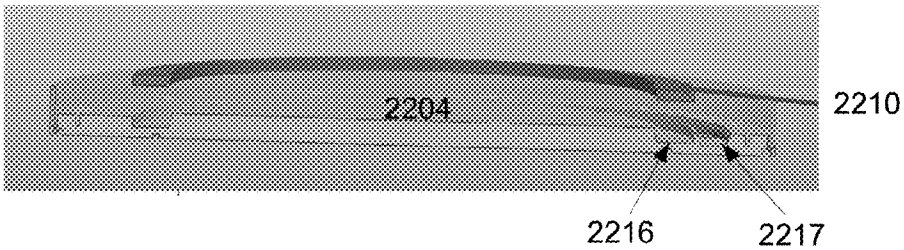

FIG. 22A illustrates a cross-sectional view of a CIRP 2204 and edge flow element 2210. In this example, the edge flow element 2210 is a removable piece that fits into a groove 2216 in the CIRP 2204. FIG. 22B provides an additional view of the edge flow element 2210 and CIRP 2204 shown in FIG. 22A. In this embodiment, the edge flow element 2210 is held in place on the CIRP 2204 using up to 12 screws, which provides 12 individual locations for tuning the height/position of the edge flow element 2210. In similar embodiments, any number of screws/adjustment/attachment points may be used. The CIRP 2204 may include a second groove 2217, which may provide an outlet for the electrolyte to exit from the cross flow manifold, thereby promoting cross flowing electrolyte. The edge flow element 2210 is secured into the groove 2216 in the CIRP 2204 using a series of screws (not shown in FIGS. 22A and 22B).

Figure 22C:
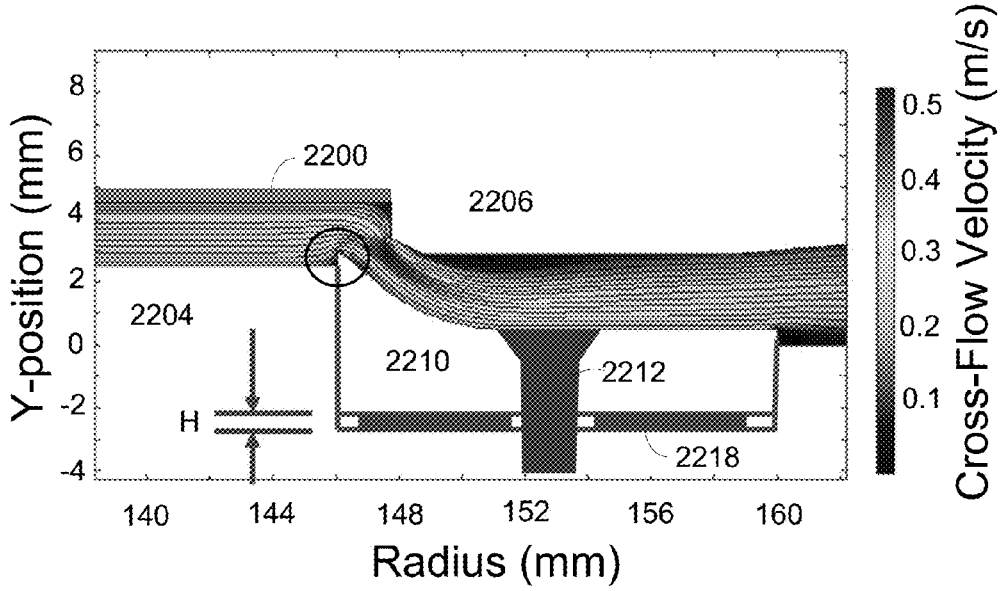
FIGS. 22C and 22D depict modeling results describing the flow velocity near the edge of the substrate for various shim thicknesses.

FIG. 22C provides modeling results related to the x-direction velocity of cross flow as electrolyte exits the cross flow manifold. Also shown in FIG. 22C, a series of shims 2218 may be used (in this example, shim washers that fit around the screws 2212 that secure the edge flow element 2210 into the groove 2216 in the CIRP 2204) to adjust the height of the edge flow element 2210 at individual locations around the edge flow element 2210. The height of the shim is labeled H. These heights may be adjusted independently to achieve an azimuthally asymmetric distance between the top of the edge flow element 2210 and the substrate (not shown). In this example, the edge flow element 2210 is positioned such that an inner edge of the edge flow element 2210 extends to a height/position that is above the raised portion of the CIRP 2204, as shown in the black circle.

In some embodiments, the vertical distance between the uppermost part of an edge flow element and the uppermost portion of a CIRP may be between about 0-5 mm, for example between about 0-1 mm. In these or other cases, this distance may be at least about 0.1 mm, or at least about 0.25 mm, at one or more locations on the edge flow element. The vertical distance between the uppermost part of an edge flow element and the substrate may be between about 0.5-5 mm, in some cases between about 1-2 mm. In various embodiments, the distance between the uppermost part of an edge flow element and the uppermost portion of the CIRP is between about 10-90% of the distance between the raised portion of the CIRP and the substrate surface, in some cases between about 25-50%. The "uppermost portion of the CIRP" referenced in this paragraph excludes the edge flow element itself (e.g., in cases where the edge flow element is integral with the CIRP). Typically, the uppermost portion of the CIRP is an upper surface of the CIRP, positioned opposite the substrate in the cross flow manifold. In various embodiments, as shown in FIG. 21, the CIRP includes a raised plateau portion. The "uppermost portion of the CIRP" in such embodiments is the raised plateau portion of the CIRP. In embodiments where the CIRP includes a series of protuberances thereon, the top of the protuberances corresponds to the "uppermost portion of the CIRP." Only regions of the CIRP that are directly under the substrate are considered when determining what is the uppermost portion of the CIRP.

Returning to the embodiment of FIG. 22C, without the shims 2218 (or with appropriately thin shims 2218), the top of the edge flow element 2210 may be about coplanar with the raised portion of the CIRP 2204. In one particular embodiment, the edge flow element 2210 is as shown in FIG. 22C, and the shims 2218 are provided in an azimuthally asymmetric way such that near the inlet side of the electroplating cell, the top of the edge flow element 2210 is about coplanar with, or below, the raised portion of the CIRP 2204 (e.g., no shims, fewer shims, and/or thinner shims are provided near the inlet) and near the outlet side of the electroplating cell, the top of the edge flow element 2210 is above, though radially outside of, the raised portion of the CIRP 2204 (e.g., more shims and/or thicker shims are provided near the outlet compared to the inlet).

Notably, the flow in the corner formed between the substrate 2200 and the substrate holder 2206 is somewhat low, but is improved compared to the case where no edge flow element 2210 is provided.

Figure 22D:
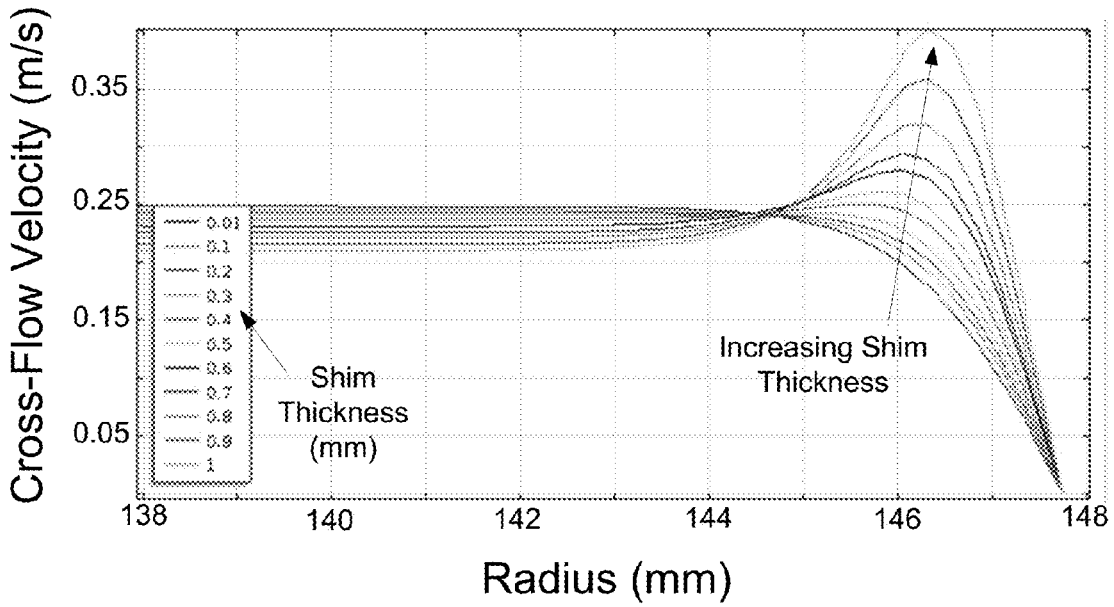

FIG. 22D depicts modeling results showing the x-direction velocity of cross flow (i.e., flow in the horizontal direction) near the substrate vs. radial location on the substrate for several different shim thicknesses using the setup shown in FIG. 22C. The height of the shim has a strong effect on the velocity of cross flow near the edge of the substrate. Generally speaking, the thicker the shim, the higher the velocity of cross flow near the edge of the substrate. This increase in cross flow near the periphery of the substrate may compensate for the low plating rate that is typically achieved near the substrate edge (e.g., as a result of apparatus geometry and/or photoresist thickness, as described above). These differences allow for the modulation/tunability of the edge flow profile by simply changing the height of the shims at relevant locations.

In certain embodiments, the edge flow element has a width (measured as the difference between the outer radius and the inner radius) between about 0.1-50 mm. In some such cases, this width is at least about 0.01 mm or at least about 0.25 mm. Typically, at least a portion of this width is positioned radially interior of the inner edge of the substrate holder. The height of the edge flow element depends in large part upon the geometry of the remaining parts of the electroplating apparatus, for example the height of the cross flow manifold. Further, the height of the edge flow element depends on how this element is installed in an electroplating apparatus, and the accommodations made in other pieces of equipment (e.g., grooves machined into the CIRP). In certain implementations, an edge flow element may have a height that is between about 0.1-5 mm, or between about 1-2 mm. Where shims are used, they can be provided at a variety of thicknesses. These thicknesses are also dependent upon the geometry of the plating apparatus and the accommodations made in the CIRP or other portion of the apparatus for securing the edge flow element therein. For example, if the edge flow element fits into a groove in the CIRP, as shown in FIGS. 22A and 22B, relatively thicker shims may be needed if the groove in the CIRP is relatively deeper. In some embodiments, the shims may have thicknesses between about 0.25-4 mm, or between about 0.5-1.5 mm.

In terms of position, the edge flow element is typically positioned such that at least a portion of the edge flow element is radially interior of the inner edge of the substrate support. In many cases this means that the edge flow element is positioned such that at least a portion of the edge flow element is radially interior of the edge of the substrate itself. The horizontal distance by which the edge flow element extends inward from the inner edge of the substrate support may in certain embodiments be at least about 1 mm, or at least about 5 mm, or at least about 10 mm, or at least about 20 mm. In some embodiments, this distance is about 30 mm or less, for example about 20 mm or less, about 10 mm or less, or about 2 mm or less. In these or other embodiments, the horizontal distance by which the edge flow element extends radially outward from the inner edge of the substrate support may be at least about 1 mm, or at least about 10 mm. Generally, there is no upper limit for the distance by which the edge flow element extends radially outward from the inner edge of the substrate support, so long as the edge flow element can fit in the electroplating apparatus.

Figure 23A:
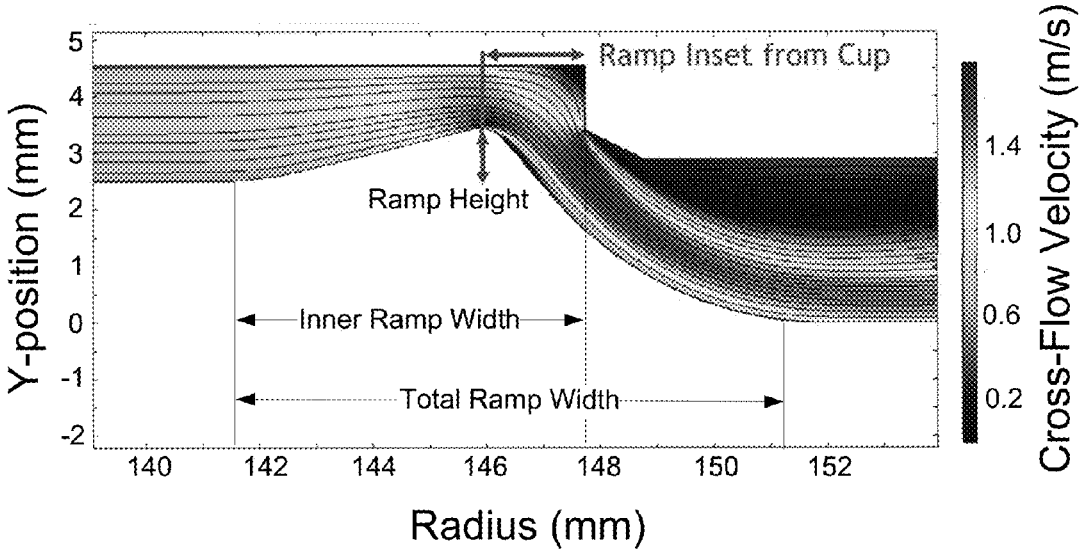
FIGS. 23A and 23B present modeling results related to an electroplating apparatus having an edge flow element that has a ramp shape, according to certain embodiments.

FIG. 23A depicts modeling results for electrolyte flow where an edge flow element having a ramp-shape is used. In FIG. 23A, the shaded area relates to the area through which electrolyte flows. The different shades indicate the rate at which electrolyte is flowing. The white space above the shaded area corresponds to the substrate and substrate holder (for example as labeled in FIG. 22C). The white space below the shaded area corresponds to the CIRP and the edge flow element. For this example, the edge flow element may be any shape that, together with the CIRP, results in a flow path having the shape shown in FIG. 23A. In some cases, the edge flow element may simply be the edge of the CIRP. In FIG. 23A, the CIRP/edge flow element together result in a ramp shape near the interface between the substrate and substrate holder. The ramp has a ramp height, shown in the figure, which extends above the raised portion of the CIRP. The ramp has a maximum height that is located radially inside of the interface between the edge of the substrate and the substrate holder. In some embodiments, the ramp height may be between about 0.25-5 mm, for example between about 0.5-1.5 mm. A horizontal distance between the maximum height of the ramp and the inner edge of the substrate holder (labeled in FIG. 23A as the "Ramp Inset from Cup") may be between about 1-10 mm, for example between about 2-5 mm. A horizontal distance between the inner edge of the substrate holder and the beginning of the ramp (labeled in FIG. 23A as the "Inner Ramp Width" may be between about 1-30 mm, for example between about 5-10 mm. A horizontal distance between the beginning of the ramp and the end of the ramp (labeled in FIG. 23A as the "Total Ramp Width" may be between about 5-50 mm, for example between about 10-20 mm. The average angle at which the ramp is inclined on the inner edge of the ramp may be between about 10-80 degrees. The average angle at which the ramp is declined on the outer edge of the ramp may be between about 10-80 degrees, for example between about 40-50 degrees. The top of the ramp may be a sharp angle, or it may be smooth, as shown.

Figure 23B:
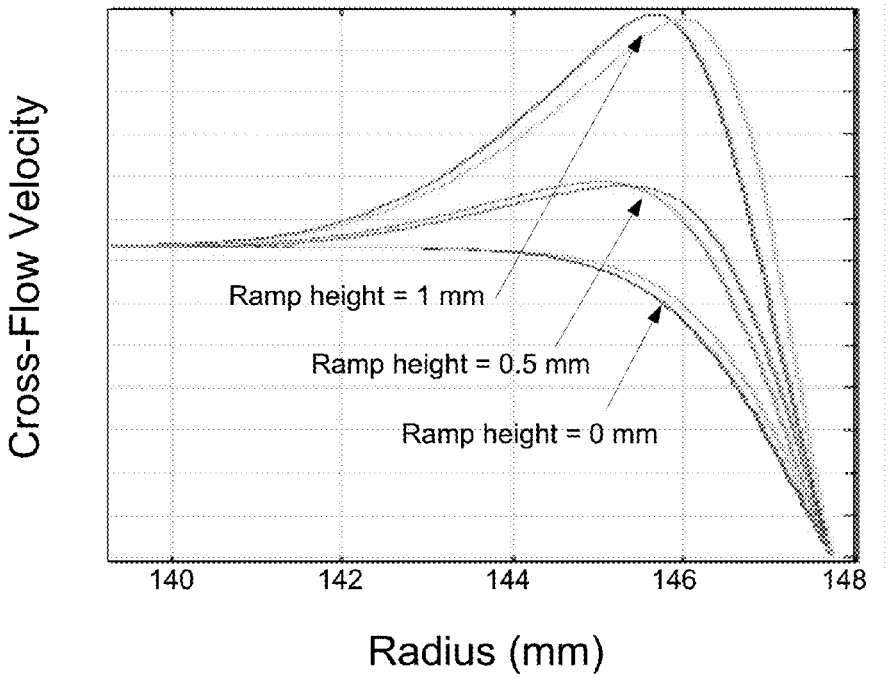

FIG. 23B depicts modeling results illustrating flow velocity vs. radial position on the substrate for different ramp heights. Higher ramp heights result in higher velocity flow. Higher ramp heights also correlate with more significant pressure drops.

Figure 24A:
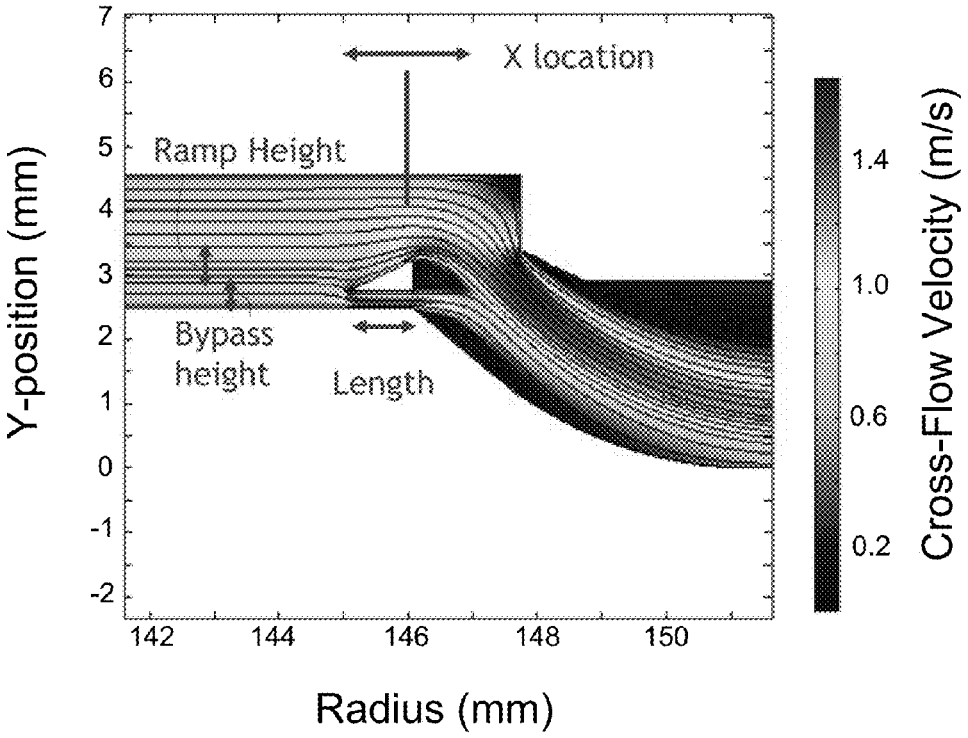
FIGS. 24A, 24B, and 25 present modeling results related to electroplating apparatus having edge flow elements that include different types of flow bypass passages according to certain embodiments.

FIG. 24A depicts modeling results related to another type of edge flow element. In this example, the edge flow element (which, like the one in FIG. 23A, may be a separate piece that attaches to the CIRP, or may be integral with the CIRP), includes a flow bypass that allows electrolyte to flow through passages in the edge flow element. The length of the flow bypass passage is labeled "Length," and the height of the flow bypass passage is labeled "Bypass height." The "Ramp Height" refers to the vertical distance between the top of the flow bypass passage and the top of the ramp. In certain embodiments, the flow bypass passage may have a minimum length of at least about 1 mm, or at least about 5 mm, and/or a maximum length of about 2 mm, or about 20 mm. The height of the flow bypass passage may be at least about 0.1 mm, or at least about 4 mm. In these or other cases the height of the flow bypass passage may be about 1 mm or less, or about 8 mm or less. In some embodiments, the height of the flow bypass passage may be between about 10-50% the distance between the CIRP (e.g., the raised portion of the CIRP, if present) and the substrate (this distance is also the height of the cross flow manifold). Similarly, the height of the ramp may be between about 10-90% the distance between the CIRP and the substrate. This may correspond to a ramp height of at least about 0.2 mm, or at least about 4.5 mm in some cases. In these or other cases, the ramp height may be about 6 mm or less, for example about 1 mm or less.

Figure 24B:
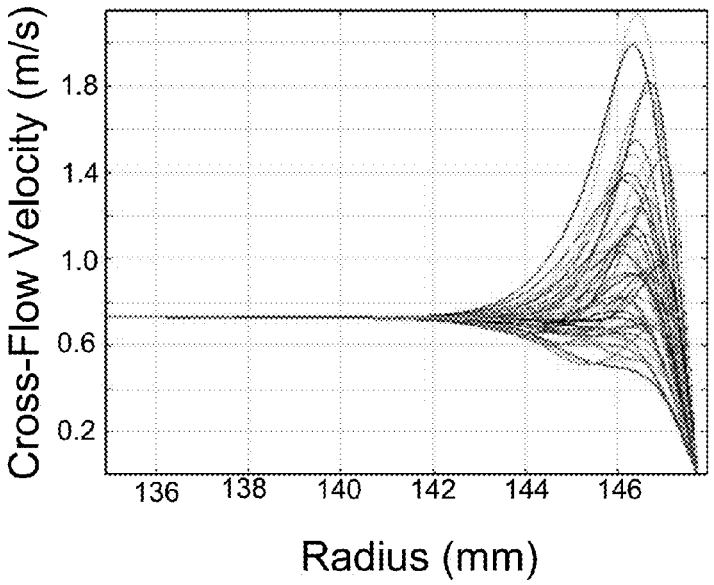

FIG. 24B depicts modeling results that were run using different values for the parameters labeled in FIG. 24A. Notably, the results show that these geometrical parameters may be varied to tune the flow near the edge of the substrate, thereby achieving a desired flow pattern for any given application. It is not necessary to distinguish between the different cases shown in this graph. Instead, the results are relevant for showing that many different flow patterns may be achieved by varying the geometry of the edge flow element.

Figure 25:
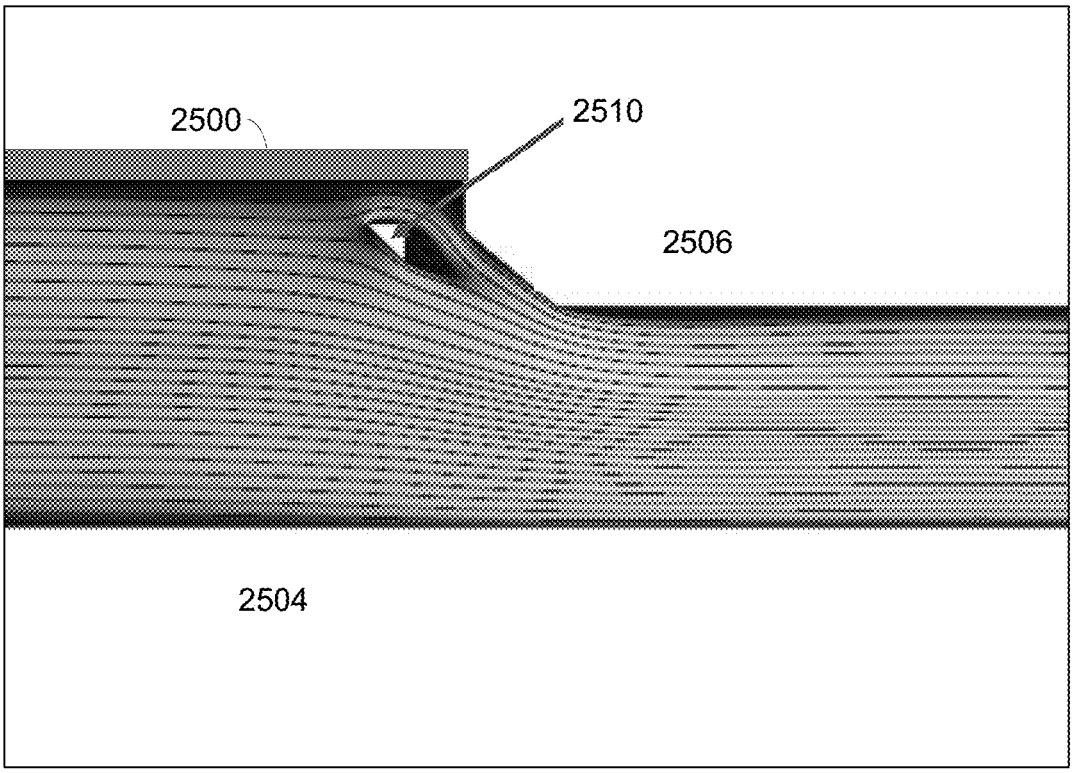

FIG. 25 presents flow modeling results related to an edge flow element 2510 that is positioned in the corner formed between the substrate 2500 and substrate holder 2506. In this example, the edge flow element 2510 includes flow bypass passages to allow electrolyte to flow, as shown. Notably, electrolyte can flow between the CIRP 2504 and the edge flow element 2510, and also between the edge flow element 2510 and the substrate 2500/substrate holder 2506. In one example, the edge flow element may be attached directly to the substrate holder, as described in relation to FIG. 18C. In another example, the edge flow element may be attached directly to the CIRP, as described in relation to FIG. 18B.

Figure 26B:
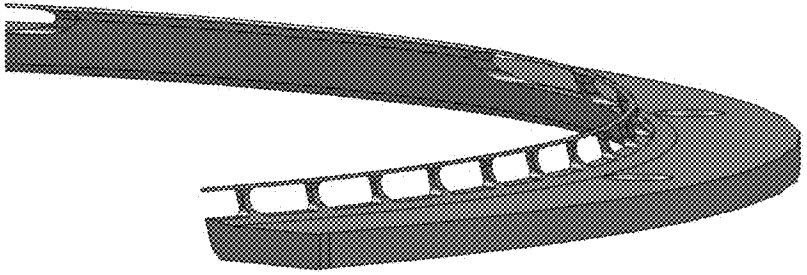
FIGS. 26A-26D illustrates several examples of an edge flow element, each having flow bypass passages therein.
Figure 26D:
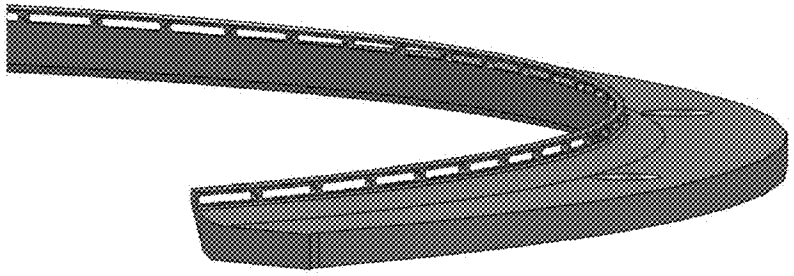
Figure 26A:
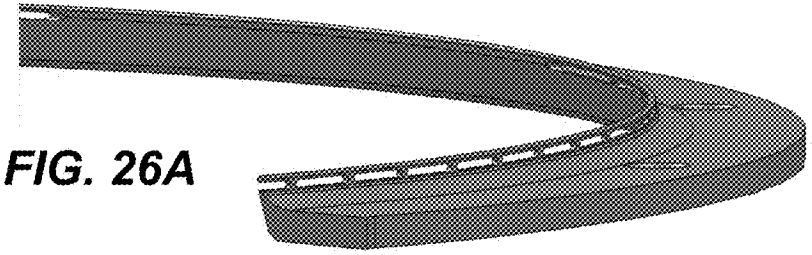
Figure 26C:
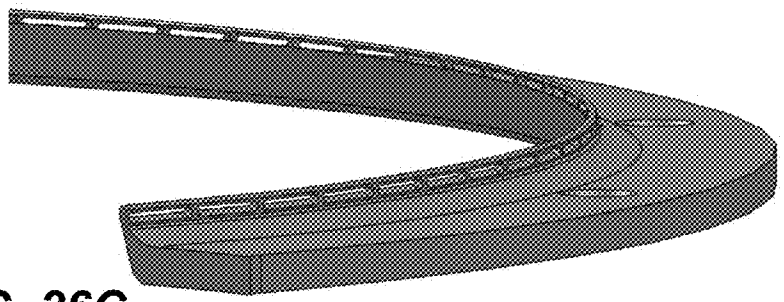

FIGS. 26A-26D depict several examples of edge flow inserts according to various embodiments. Only a portion of the edge flow element is shown in each case. These edge flow elements may be installed in an electroplating cell by attaching them to the CIRP, for example within a groove as described in relation to FIG. 22A. The edge flow elements shown in FIGS. 26A-26D are fabricated to have different heights, different flow bypass passage heights, different angles, different degrees of azimuthal symmetry/asymmetry, etc. One type of asymmetry that is easily visible in the edge flow elements of FIGS. 26A and 26B is that at certain azimuthal positions, no flow bypass passages are present and the electrolyte must travel all the way over the uppermost portion of the edge flow element at these locations to exit the electroplating cell. At other positions on the edge flow element, flow bypass passages are present, allowing electrolyte to flow both over and under the uppermost portion of the edge flow element. In certain embodiments, an edge flow element includes portion(s) that have flow bypass passages and portion(s) that do not have flow bypass passages, the different portions being positioned at different azimuthal locations, as depicted in FIGS. 26A and 26B. The edge flow element may be installed in an electroplating apparatus such that the portion(s) having the flow bypass passages is aligned with either or both of the inlet/outlet areas of the electroplating cell. In some embodiments, the edge flow element may be installed in an electroplating apparatus such that the portion(s) lacking the flow bypass passages are aligned with either or both of the inlet/outlet areas of the electroplating cell.

Another way in which the edge flow element may be azimuthally asymmetric is by providing flow bypass passages of different dimensions at different locations on the edge flow element. For example, the flow bypass passages near the inlet and/or outlet may be wider or narrower, or taller or shorter, than flow bypass passages farther away from the inlet and/or outlet. Similarly, the flow bypass passages near the inlet may be wider or narrower, or taller or shorter, than flow bypass passages near the outlet. In these or other cases, the space between adjacent flow bypass passages may be non-uniform. In some embodiments, the flow bypass passages may be closer together (or farther apart) near the inlet and/or outlet regions, compared to regions that are farther away from the inlet and/or outlet. Similarly, the flow bypass passages may be closer together (or farther apart) near the inlet area compared to the outlet area. The shape of the flow bypass passages may also be azimuthally asymmetric, for example to promote cross flow. One way to accomplish this in certain implementations may be to use flow bypass passages that are, to some degree, aligned with the direction of cross flow. In some embodiments, the height of the edge flow element is azimuthally asymmetric. The relatively higher portions may be aligned with an inlet and/or outlet side of the electroplating apparatus in some embodiments. This same result can be accomplished using an edge flow element having an azimuthally symmetric height, installed onto a CIRP using shims of varying heights.

While it is understood that electrolyte may exit the electroplating cell at many positions, the "outlet area" of the electroplating cell is understood to be the area opposite the inlet (where the cross flowing electrolyte originates, not considering electrolyte which enters the cross flow manifold through holes in the CIRP). In other words, the inlet corresponds to the upstream area, where the cross flow substantially originates, and the outlet corresponds to the downstream area that is opposite the upstream area.

Figure 27A:
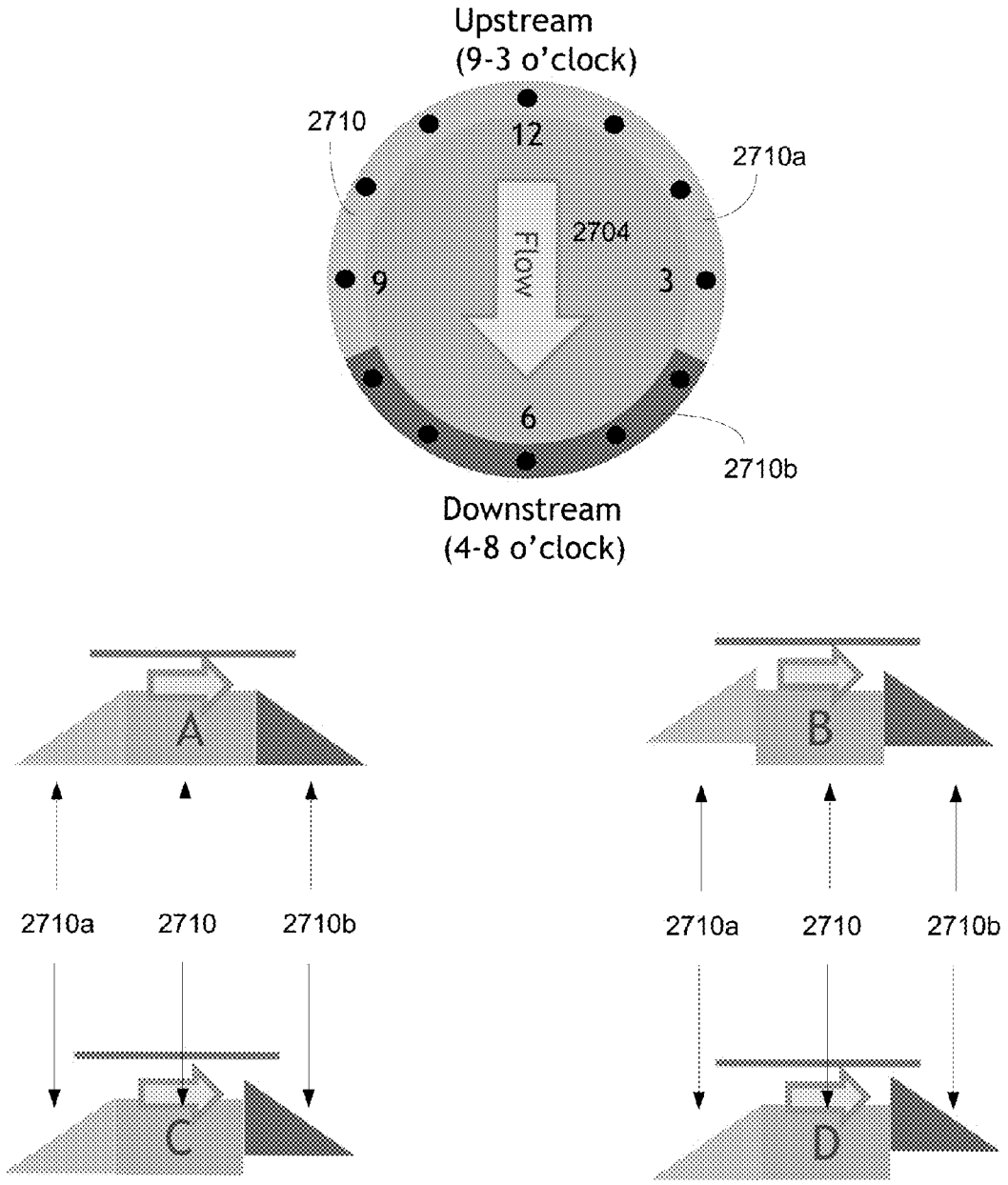
FIGS. 27A-27C describe an experimental setup used to generate the results shown in FIGS. 28-30.
Figures 27B, 27C:
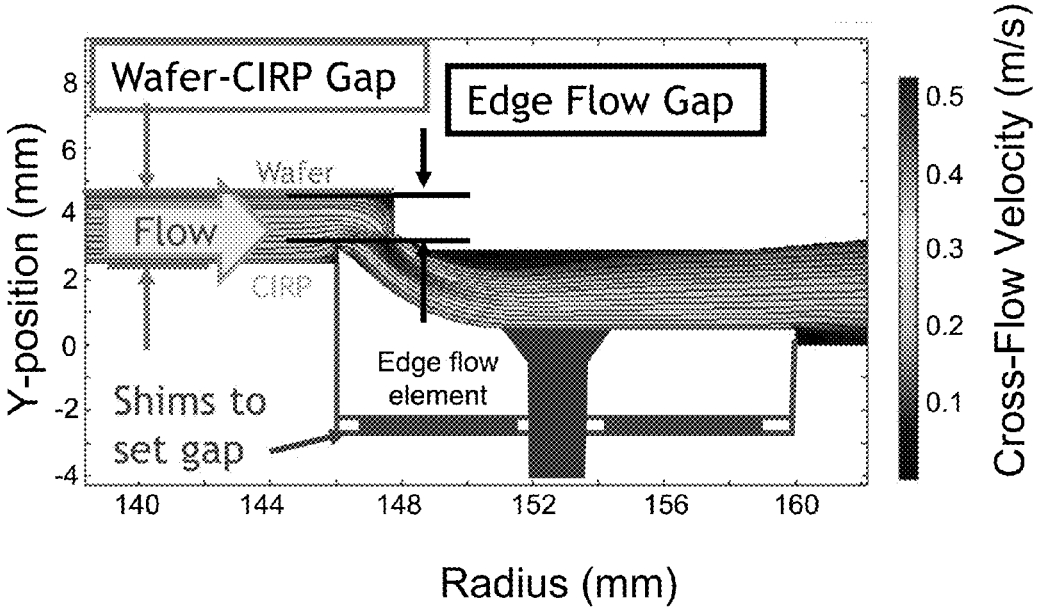
Figure 28:
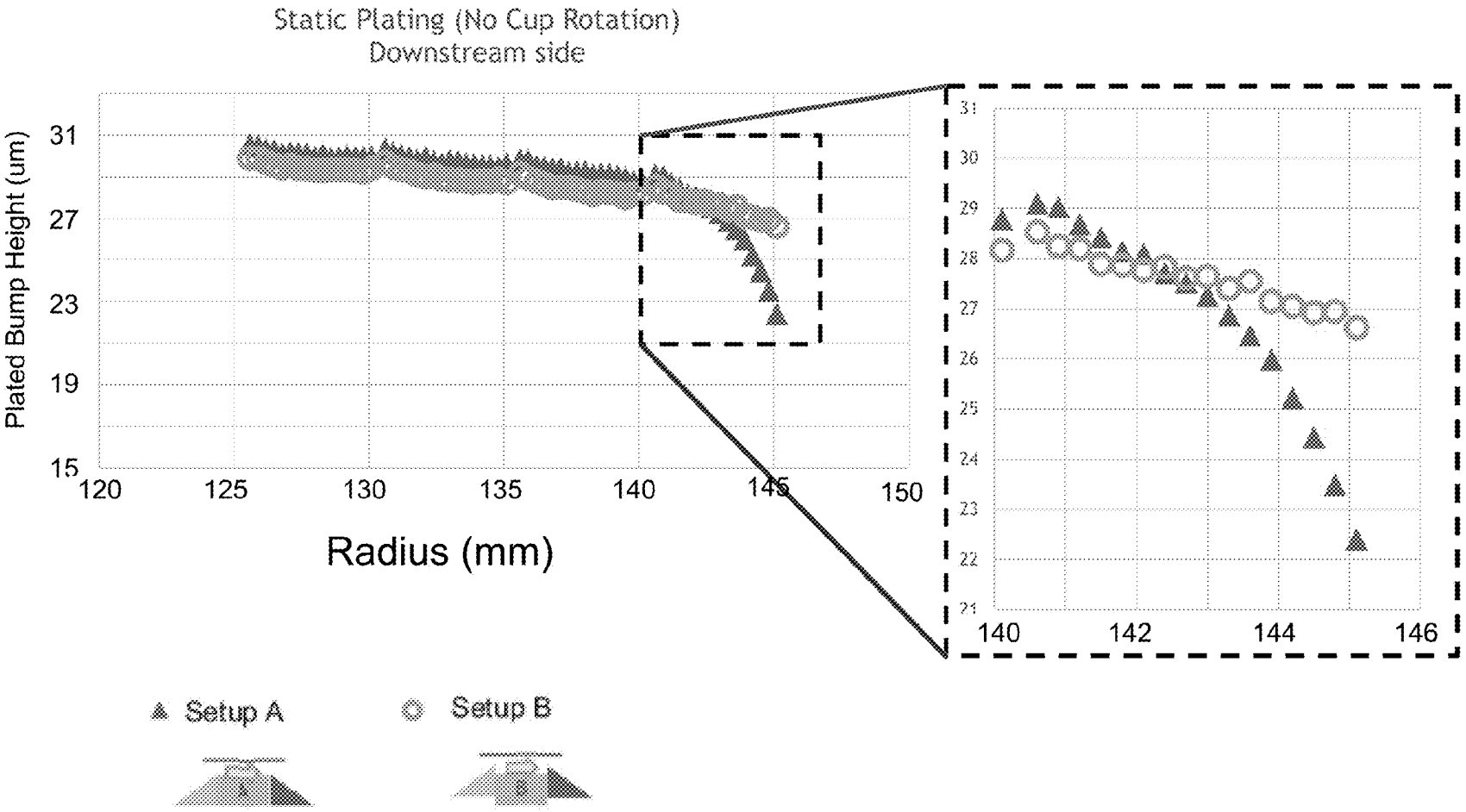
FIGS. 28-30 present experimental results related to plated bump height (FIGS. 28 and 30) or within-die thickness non-uniformity (FIG. 29) vs. radial position on the substrate, for the experimental setups described in relation to FIGS. 27A-27C.
Figure 29:
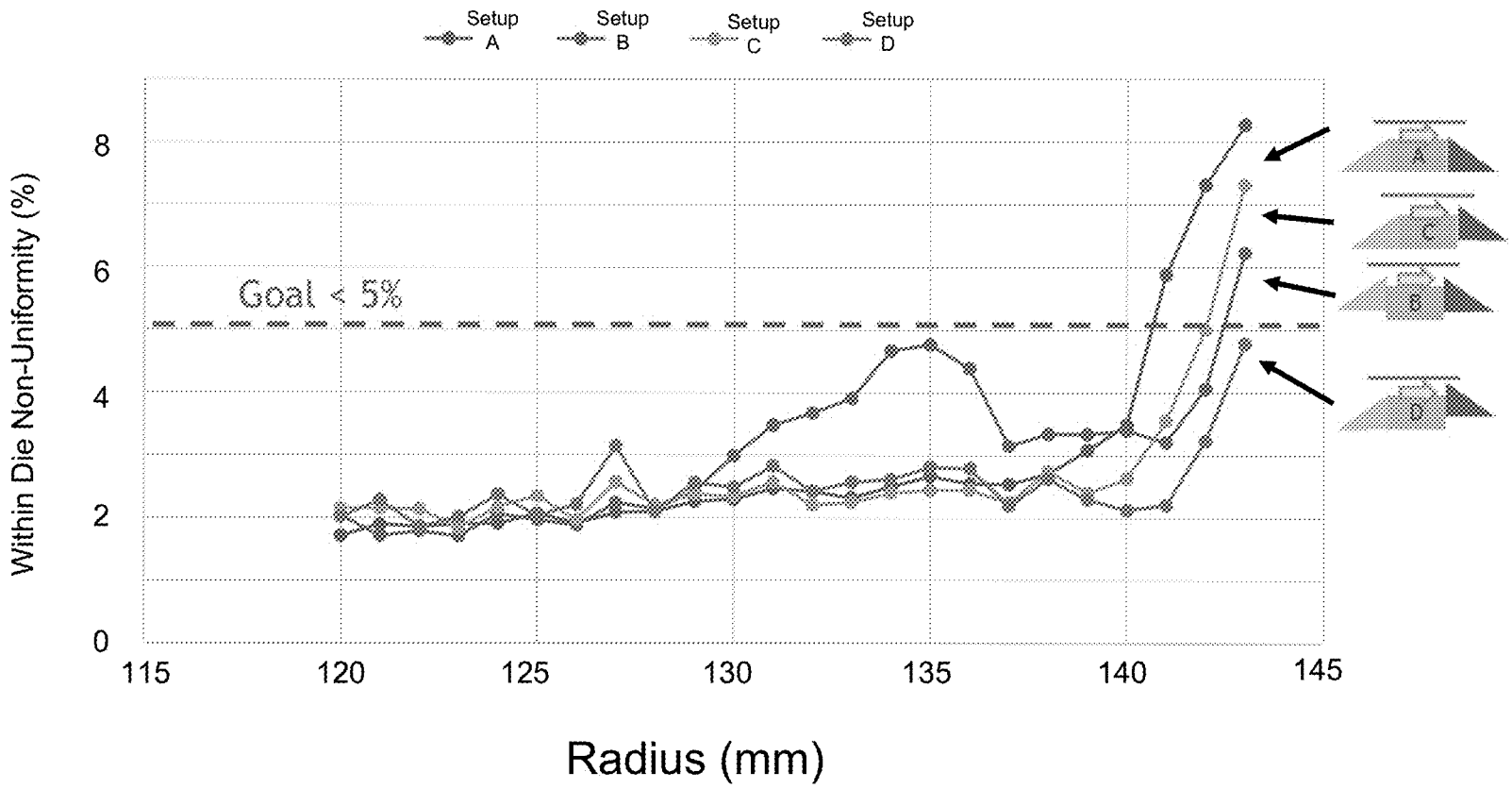
Figure 30:
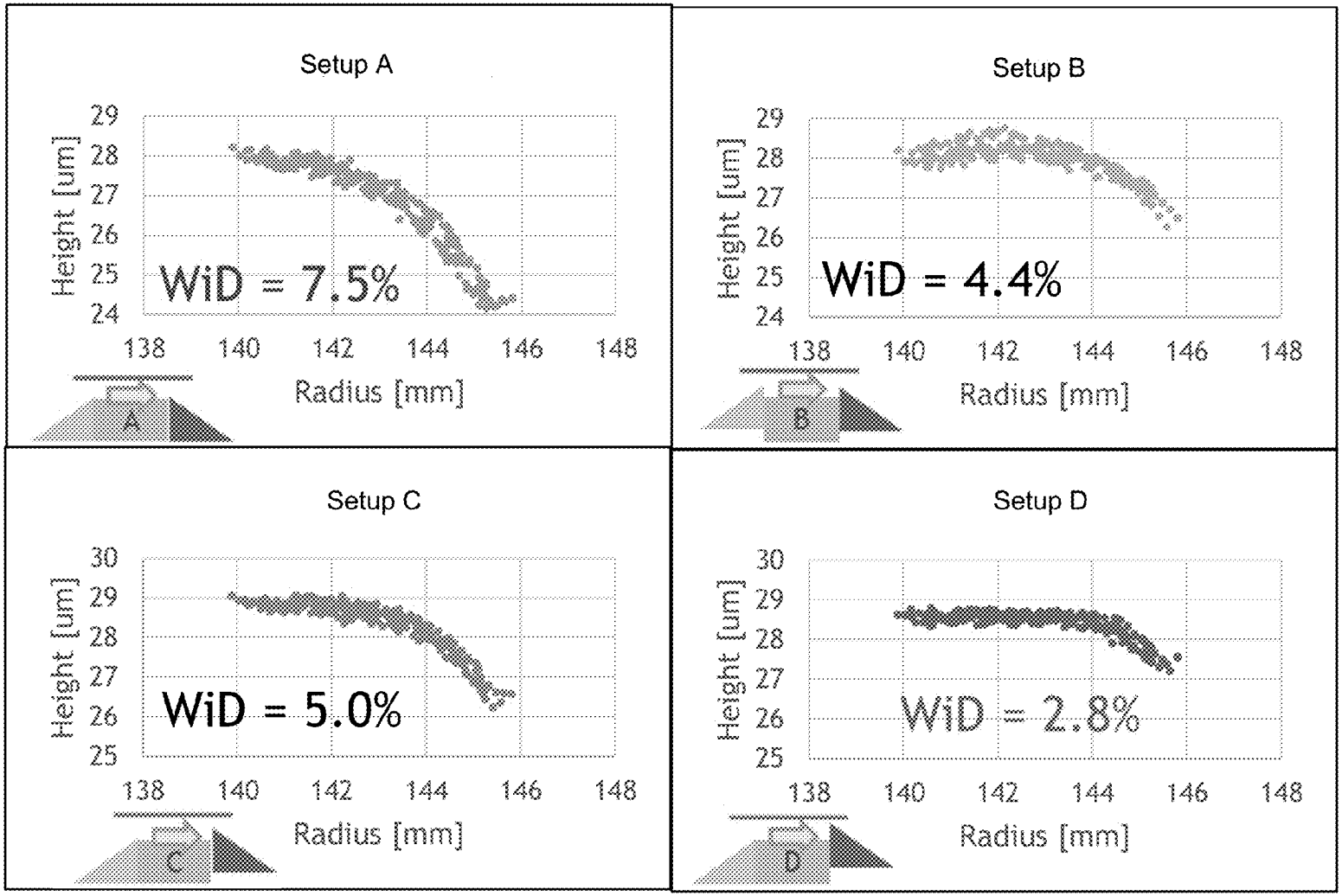

FIGS. 27A-27C present the experimental setup used for a number of experiments described in relation to FIGS. 28-30. In this series of tests, an edge flow element 2710 was installed in a CIRP 2704 at varying heights at different positions. Four different setups were used, labeled in FIG. 27A as A, B, C, and D. Shims of varying heights were used to position the edge flow element 2710 at the different heights. As shown in FIG. 27A, the edge flow element 2710 was conceptually divided into an upstream portion 2710*a* (between about the 9 o'clock position and the 3 o'clock position) and a downstream portion 2710*b* (between about the 4 o'clock position and the 8 o'clock position). The upstream portion 2710*a* of the edge flow element 2710 was aligned with the inlet to the cross flow manifold (e.g., the center of the inlet was positioned at about the 12 o'clock position). The different setups tested are described in the table in FIG. 27B. In FIG. 27A, it should be understood that the CIRP 2710 is generally much longer/wider than shown in the bottom portion of the figure.

The table in FIG. 27B describes three gap heights relevant to the experimental setup. The first gap height (the wafer-CIRP gap) corresponds to the distance between the substrate surface and the raised portion of the CIRP. This is the height of the cross flow manifold. The second gap height (the upstream gap) corresponds to the distance between the substrate and the topmost portion of the edge flow element for the upstream portion of the edge flow element. Similarly, the third gap height (the downstream gap) corresponds to the distance between the substrate and the topmost portion of the edge flow element for the downstream portion of the edge flow element. In setup A, the upstream gap and downstream gap are each the same size as the substrate-CIRP gap. Here, the top of the edge flow element is flush with the raised portion of the CIRP. In setup B, the upstream and downstream gaps are equal, and are both smaller than the substrate-CIRP gap. In this example, the edge flow element extends to a position that is higher than the raised portion of the CIRP in an azimuthally symmetric way. In setup C, the upstream gap is the same size as the substrate-CIRP gap, while the downstream gap is smaller. In this example, the edge flow element is flush with the raised portion of the CIRP at the upstream locations on the edge flow element, and is higher than the raised portion of the CIRP at downstream locations of the edge flow element. Setup D is similar to setup C, with an even smaller downstream gap. Smaller gaps between the edge flow element and the substrate are a result of using larger shims between the edge flow element and the CIRP. FIG. 27C depicts modeling results related to the cross flow velocity of electrolyte at different locations. This figure shows geometry of the basic experimental setup in relation to FIGS. 27A and 27B.

FIG. 28 presents experimental results related to setups A and B described in relation to FIGS. 27A-27C. For this experiment, the substrate was not rotated during electroplating. The graph in FIG. 28 illustrates plated bump height vs. radial position on the substrate. The results indicate that setup B resulted in substantially more uniform bump height near the edge of the substrate compared to setup A. This suggests that raising the edge flow element above the plane of the raised portion of the CIRP can have substantial benefits on plating uniformity.

FIG. 29 presents experimental data related to setups A-D described in relation to FIGS. 27A-27C. The graph illustrates within-die non-uniformity vs. radial position on the substrate. Lower degrees of non-uniformity are desired. In various embodiments, there may be a goal of <5% within-die non-uniformity. The D setup performed best (lowest non-uniformity). The B and C setups also performed better than the A setup. As such, it is believed that there are particular benefits to raising an edge flow element above the plane of the raised CIRP, particularly (but not necessarily exclusively) at downstream locations on the edge flow element.

FIG. 30 presents experimental results depicting plated bump height vs. radial position on the substrate for setups A-D described in relation to FIGS. 27A-27C. Setup D resulted in the most uniform edge profile, with the lowest within-die non-uniformity. The "WiD" values shown in FIG. 30 relate to the within-die thickness non-uniformities that were observed on the substrates after plating.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

Additional Examples

A few observations that suggest that improved cross flow through the cross flow manifold 226 is desirable are presented in this section. Throughout this section, two basic plating cell designs are tested. Both designs contain a confinement ring 210, sometimes referred to as a flow diverter, defining a cross flow manifold 226 on top of the channeled ionically resistive plate 206. Neither design includes an edge flow element, though such an element may be added to either setup, as desired. The first design, sometimes referred to as the control design and/or the TC1 design, does not include a side inlet to this cross flow manifold 226. Instead, in the control design, all flow into the cross flow manifold 226 originates below the CIRP 206 and travels up through the holes in the CIRP 206 before impinging on the wafer and flowing across the face of the substrate. The second design, sometimes referred to as the second design and/or the TC2 design, includes a cross flow injection manifold 222 and all associated hardware for injecting fluid directly into the cross flow manifold 226 without passing through the channels or pores in the CIRP 206 (note that in some cases, however, the flow delivered to the cross flow injection manifold passes through dedicated channels near the periphery of the CIRP 206, such channels being distinct/separate from the channels used to direct fluid from the CIRP manifold 208 to the cross flow manifold 226).

FIGS. 10A and 10B through FIGS. 12A and 12B compare the flow patterns achieved using a control plating cell having no side inlet (10A, 11A, and 12A) vs. a second plating cell having a side inlet to the cross flow manifold 10B, 11B, and 12B).

Figure 10A:
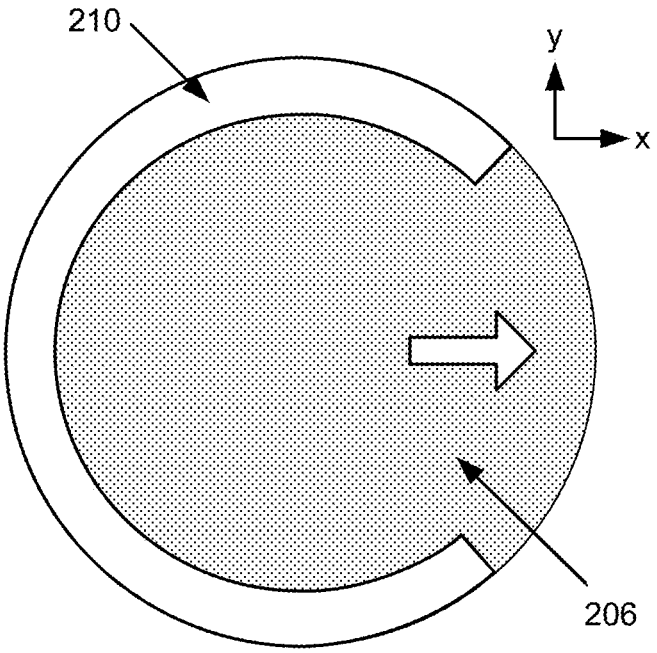
FIG. 10A shows a simplified top view of a CIRP and flow confinement ring where no side inlet is used.
Figure 10B:
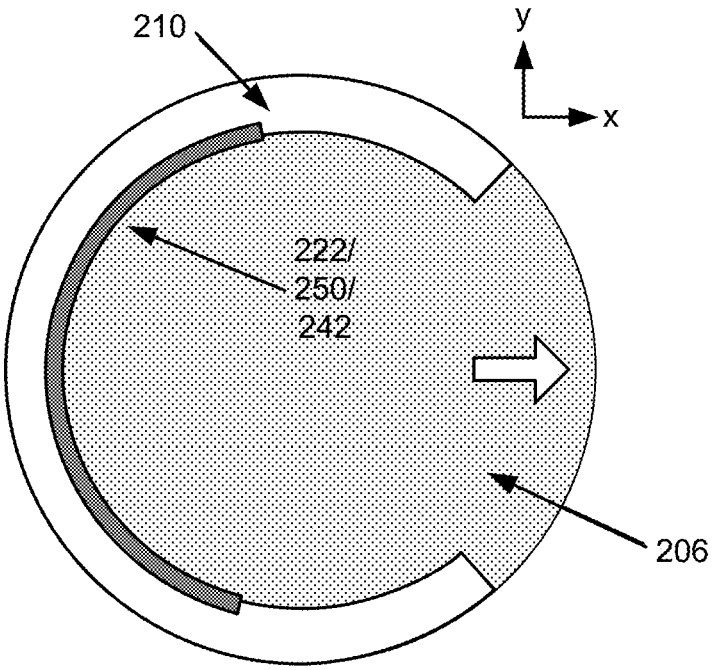
FIG. 10B shows a simplified top view of a CIRP, flow confinement ring, and cross flow side inlet according to various embodiments disclosed herein.

FIG. 10A shows a top-down view of part of a control design plating apparatus. Specifically, the figure shows a CIRP 206 with a flow diverter 210. FIG. 10B shows a top-down view of part of the second plating apparatus, specifically showing the CIRP 206, flow diverter 210 and cross flow injection manifold 222/cross flow manifold inlet 250/cross flow showerhead 242. The direction of flow in FIGS. 10A-10B is generally left to right, towards the outlet 234 on the flow diverter 210. The designs shown in FIGS. 10A-10B correspond to the designs modeled in FIGS. 11A-11B through 12A-12B.

Figure 11A:
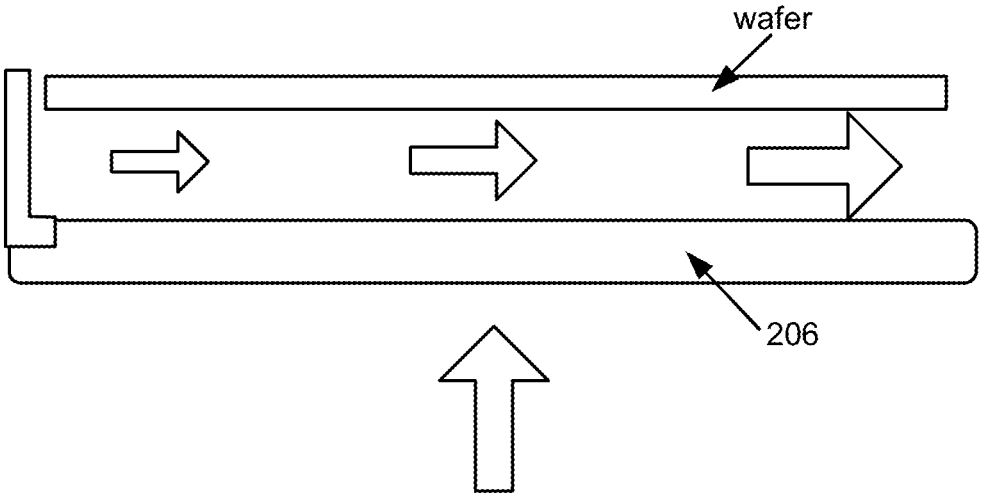
FIGS. 11A-11B illustrate the cross flow through the cross flow manifold for the apparatus shown in FIGS. 10A-10B, respectively.
Figure 11B:
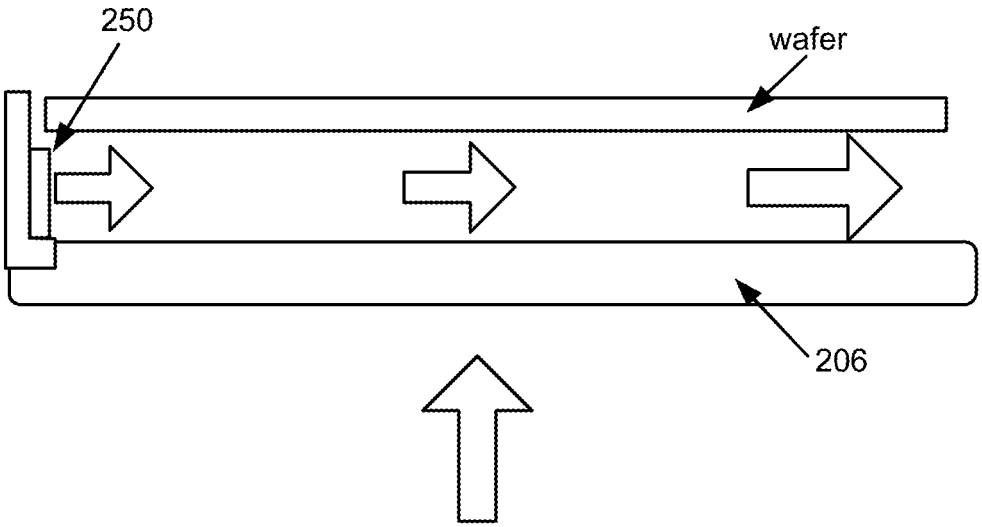

FIG. 11A shows the flow through the cross flow manifold 226 for the control design. In this case, all the flow in the cross flow manifold 226 originates from below the CIRP 206. The magnitude of the flow at a particular point is indicated by the size of the arrows. In the control design of FIG. 11A, the magnitude of the flow increases substantially throughout the cross flow manifold 226 as additional fluid passes through the CIRP 206, impinges upon the wafer, and joins the cross flow. In the current design of FIG. 11B, however, this increase in flow is much less substantial. The increase is not as great because a certain amount of fluid is delivered directly into the cross flow manifold 226 through the cross flow injection manifold 222 and associated hardware.

Figure 12A:
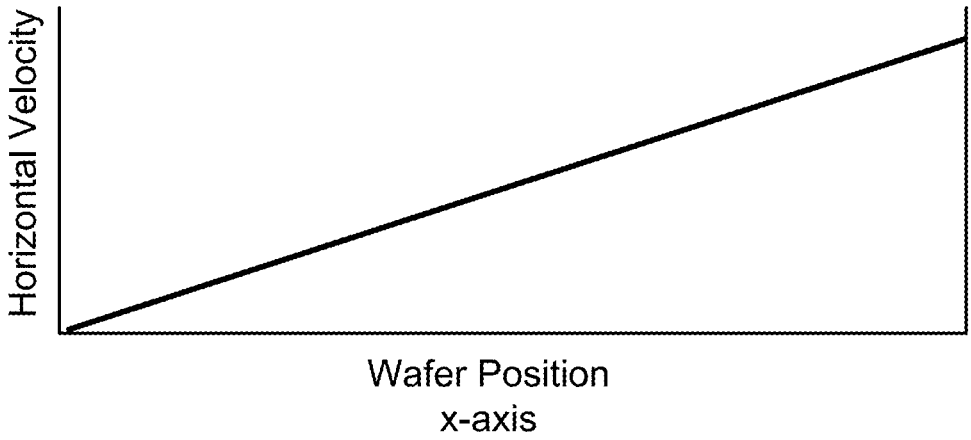
FIGS. 12A-12B are graphs showing the horizontal cross flow velocity during plating vs. wafer position for the apparatus shown in FIGS. 10A-10B, respectively.

FIG. 12A depicts the horizontal velocity across the face of a substrate plated in the control design apparatus shown in FIG. 10A. Notably, the flow velocity starts at zero (at the position opposite the flow diverter outlet) and increases until reaching the outlet 234. Unfortunately, the average flow at the center of the wafer is relatively low in the control embodiments. As a consequence, the jets of catholyte emitted from the channels of the channeled ionically resistive plate 206 predominate hydrodynamically in the center region. The problem is not as pronounced towards the edge regions of the work piece because the rotation of the wafer creates an azimuthally averaged cross flow experience.

Figure 12B:
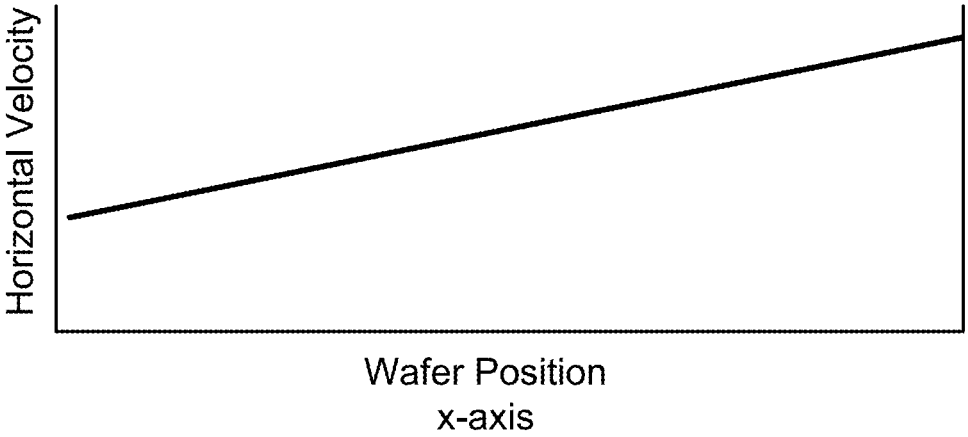

FIG. 12B depicts the horizontal velocity across the face of a substrate plated in the current design shown in FIG. 10B. In this case, the horizontal velocity starts at the inlet 250 at a non-zero value due to the fluid injected from the cross flow injection manifold 222, through the side inlet 250 and into the cross flow manifold 226. Further, the flow rate at the center of the wafer is increased in the current design, as compared to the control design, thereby reducing or eliminating the region of low cross flow near the center of the wafer where the impinging jets may otherwise dominate. Thus, the side inlet substantially improves the uniformity of cross flow rates along the inlet-to-outlet direction, and will result in more uniform plating thickness.

OTHER EMBODIMENTS

While the above is a full description of the specific embodiments, various modifications, alternative constructions and equivalents may be used. Therefore, the above description and illustrations should not be taken as limiting the scope of the present invention which is defined by the appended claims.

What is claimed is:

1. An electroplating apparatus comprising:

(a) an electroplating chamber configured to contain an electrolyte and an anode while electroplating metal onto a substantially planar substrate;

(b) a substrate holder configured to hold the substantially planar substrate such that a plating face of the substrate is separated from the anode during electroplating, the substrate holder comprising a cup that supports the substrate at its periphery;

(c) an ionically resistive element including a substrate-facing surface that is separated from the plating face of the substrate by a gap of about 10 mm or less, the gap forming a cross flow manifold between the ionically resistive element and the substrate, wherein the ionically resistive element is at least coextensive with the plating face of the substrate during electroplating, and wherein the ionically resistive element is adapted to provide ionic transport through the ionically resistive element during electroplating;

(d) a side inlet to the cross flow manifold for introducing electrolyte to the cross flow manifold;

(e) a side outlet to the cross flow manifold for receiving electrolyte flowing in the cross flow manifold, wherein the side inlet and side outlet are positioned proximate azimuthally opposing perimeter locations on the plating face of the substrate during electroplating, and wherein the side inlet and side outlet are adapted to generate cross flowing electrolyte in the cross flow manifold; and (f) a sealing member for wholly or partially sealing one or more outlets to the cross flow manifold other than the side outlet, wherein the sealing member is positioned at least partially below the cup of the substrate holder, and wherein when the sealing member is engaged the apparatus is in a sealed state, and when the sealing member is not engaged the apparatus is in an unsealed state; and (g) a controller configured to cause intermittently switching between the sealed state and the unsealed state during electroplating.

2. The apparatus of claim 1, further comprising a flow confinement element positioned peripherally in the cross flow manifold between the ionically resistive element and the substrate holder.

3. The apparatus of claim 2, further comprising a leakage gap between a surface of the substrate holder and a surface of the flow confinement element, wherein the sealing member is configured to seal the leakage gap when the substrate holder is sufficiently near the flow confinement element.

4. The apparatus of claim 3, wherein the sealing member seals at least about 75% of the leakage gap.

5. The apparatus of claim 4, wherein the sealing member seals about 100% of the leakage gap.

6. The apparatus of claim 2, wherein the side outlet is formed in the flow confinement element.

7. The apparatus of claim 6, wherein the side outlet comprises a vent region in the flow confinement element, the vent region spanning between about 20-120 degrees proximate the periphery of the substrate.

8. The apparatus of claim 2, wherein the sealing member is fixedly or releasably attached to the flow confinement element.

9. The apparatus of claim 2, wherein the sealing member is fixedly or releasably attached to a scaffold that is different from the substrate holder and the flow confinement element.

10. The apparatus of claim 1, wherein the sealing member comprises a compressible material.

11. The apparatus of claim 10, wherein the sealing member comprises a fluoropolymer elastomer.

12. The apparatus of claim 11, wherein the fluoropolymer elastomer comprises between about 65-70% fluorine.

13. The apparatus of claim 1, wherein the sealing member is fixedly or releasably attached to the substrate holder.

14. The apparatus of claim 1, wherein the controller is configured to cause rotating the substrate while the apparatus is in the unsealed state.

15. The apparatus of claim 14, wherein the controller is configured to cause not rotating the substrate while the apparatus is in the sealed state.

16. A method for electroplating on a substrate, the method comprising:

(a) receiving a substantially planar substrate in a substrate holder of an electroplating apparatus, where the substrate holder comprises a cup configured to support the substrate at its periphery such that the plating face of the substrate is exposed and is separated from an anode during electroplating, (b) immersing the substrate in electrolyte, where a gap of about 10 mm or less is formed between the plating face of the substrate and an upper surface of an ionically resistive element, the gap forming a cross flow manifold, wherein the ionically resistive element is at least coextensive with the plating face of the substrate, and wherein the ionically resistive element is adapted to provide ionic transport through the ionically resistive element during electroplating, (c) flowing electrolyte in contact with the substrate in the substrate holder (i) from a side inlet, into the cross flow manifold, and out a side outlet, and, optionally, (ii) from below the ionically resistive element, through the ionically resistive element, into the cross flow manifold, and out the side outlet, wherein the side inlet and side outlet are positioned proximate azimuthally opposed perimeter locations on the plating face of the substrate, wherein the side inlet and side outlet are designed or configured to generate cross flowing electrolyte in the cross flow manifold during electroplating, and wherein a sealing member wholly or partially seals one or more outlets to the cross flow manifold other than the side outlet during at least a portion of electroplating, wherein when the sealing member is engaged the electroplating apparatus is in a sealed state, and when the sealing member is not engaged the electroplating apparatus is in an unsealed state, wherein the sealing member is positioned at least partially below the cup of the substrate holder; and (d) intermittently switching the electroplating apparatus between the sealed state and the unsealed state while electroplating material onto the plating face of the substrate while flowing the electrolyte as in (c).

17. The method of claim 16, wherein electroplating material in (d) comprises (i) electroplating material while rotating the substrate when the electroplating apparatus is in the unsealed state, (ii) electroplating material while engaging the sealing member to seal the cross flow manifold of the electroplating apparatus, (iii) electroplating material while maintaining the substrate rotationally stationary when the electroplating apparatus is in the sealed state, and (iv) electroplating material while disengaging the sealing member to unseal the cross flow manifold of the electroplating apparatus.

18. The method of claim 17, wherein operations (i)-(iv) of electroplating material in (d) are performed at least three times during electroplating on the substrate.

19. The method of claim 17, wherein the electroplating apparatus is in the sealed state for more than half of a total plating time.

20. The method of claim 16, wherein electroplating material in (d) comprises (i) applying a first current to the substrate while maintaining the substrate rotationally stationary when the electroplating apparatus is in the sealed state, and (ii) either (A) applying no current to the substrate, or (B) applying a current that is different from the first current while rotating the substrate when the electroplating apparatus is in the unsealed state.

* * * * *